US008545122B2

(12) United States Patent
Tanaka et al.

(10) Patent No.: US 8,545,122 B2
(45) Date of Patent: Oct. 1, 2013

(54) BINDING DEVICE

(75) Inventors: Kanji Tanaka, Ashiya (JP); Hiroshi Arai, Kawachinagano (JP); Hiroshi Nakano, Ibaraki (JP)

(73) Assignee: Lihit Lab., Inc., Osaka (JP)

( * ) Notice: Subject to any disclaimer, the term of this patent is extended or adjusted under 35 U.S.C. 154(b) by 641 days.

(21) Appl. No.: 11/721,299

(22) PCT Filed: Dec. 7, 2005

(86) PCT No.: PCT/JP2005/022492
§ 371 (c)(1),
(2), (4) Date: Jul. 1, 2009

(87) PCT Pub. No.: WO2006/062140
PCT Pub. Date: Jun. 15, 2006

(65) Prior Publication Data

US 2009/0279940 A1 Nov. 12, 2009

(30) Foreign Application Priority Data

Dec. 8, 2004 (JP) ..... 2004/018307

(51) Int. Cl.

| | |
|---|---|
| ***B42F 3/02*** | (2006.01) |
| ***B42F 13/02*** | (2006.01) |
| ***B42F 13/00*** | (2006.01) |
| ***B42F 13/20*** | (2006.01) |
| ***B42F 3/00*** | (2006.01) |
| ***B42F 13/12*** | (2006.01) |

(52) U.S. Cl.
USPC ..... 402/29; 402/19; 402/20; 402/26; 402/31; 402/35; 402/39; 402/70; 402/73; 402/75

(58) Field of Classification Search
USPC ..... 402/5, 19, 20, 26, 29, 31, 35, 39, 402/70, 73, 75, 80 R
See application file for complete search history.

(56) References Cited

U.S. PATENT DOCUMENTS

| | | | | |
|---|---|---|---|---|
| 7,223,040 | B2 * | 5/2007 | Koike et al. | 402/19 |
| 7,296,946 | B2 * | 11/2007 | Cheng et al. | 402/19 |
| 2003/0123923 | A1 * | 7/2003 | Koike et al. | 402/19 |

FOREIGN PATENT DOCUMENTS

| | | |
|---|---|---|
| JP | 2003-251973 | 9/2003 |
| JP | 2004-255835 | 9/2004 |
| WO | 2004/028828 A1 | 4/2004 |

OTHER PUBLICATIONS

Official communication issued in the counterpart International Application No. PCT/JP2005/022492, mailed on Mar. 14, 2006.

*Primary Examiner* — Dana Ross
*Assistant Examiner* — Justin V Lewis
(74) *Attorney, Agent, or Firm* — Keating & Bennett, LLP

(57) ABSTRACT

A binding device includes a plurality of binding rings, a holding member which enables the binding rings to be disposed with a spacing therebetween, an operating member having a surface to which base portions of the binding rings are secured such that the binding rings are disposed with a spacing therebetween, the operating member including a pair of operating pieces movable in the holding member in a longitudinal direction of the holding member, and an opening-closing member which causes the binding rings to be changed in an opening direction. The opening-closing member includes an elastic member. The elastic member is provided in the operating member such that a distance between the operating pieces in an opening-closing direction of the binding rings is maintained at a distance enabling the pair of the operating pieces to be moved and is arranged to move the pair of the operating pieces defining the operating member relative to each other in respective opposite directions and so as to elastically urge the pair of the operating pieces in a direction allowing the binding rings to be held in an opened state.

4 Claims, 68 Drawing Sheets

(A)

(B)

(A)

(B)

(C)

(A)

(B)

(A)

(B)

(A)

(B)

(C)

BINDING DEVICE

BACKGROUND OF THE INVENTION

1. Field of the Invention

The present invention relates to a binding device, and in particular, to a binding device used as, for example, a ring binder or a file.

2. Description of the Related Art

An example of conventional binding devices is disclosed in, for example, Japanese Patent Laid-Open Publication No. 2004-255835 (Patent Document 1). In the binding device disclosed in this publication, an operating member having binding rings attached thereto is secured by holding projections provided in a holding member. Furthermore, binding ring-engaging portions on respective free ends of ring halves defining each of the binding rings are engaged with each other, whereby each of the annular binding rings is provided, and the transverse cross-sectional shape of the binding rings is a substantially ellipsoidal shape.

In the above conventional binding device, the operating member is secured by the holding projections and provided in the holding member. However, it is very difficult to provide the holding projections to the holding member, and therefore the manufacturing of the entire binding device is complicated and requires much effort. Furthermore, when the binding rings in a closed state are opened, the operating member often does not operate smoothly.

SUMMARY OF THE INVENTION

To overcome the problems described above, preferred embodiments of the present invention provide a binding device in which smooth opening and closing of binding rings is facilitated and which can be easily manufactured.

According to a preferred embodiment of this invention, a binding device includes a plurality of annular binding rings each including two ring halves each having a binding ring-engaging portion on a free end thereof, the binding ring-engaging portions being engaged with each other, whereby each of the annular binding rings is provided; a holding member having a length which enables the binding rings to be disposed with a spacing therebetween; and an operating member having a surface to which base portions of the respective binding rings are secured such that the binding rings are disposed with a spacing therebetween. The operating member includes a pair of operating pieces inside the holding member, the operating pieces being movable within the holding member in a longitudinal direction of the holding member such that the binding rings are secured to the holding member, and an opening-closing member which, when the binding rings are opened, moves the operating pieces within the holding member in the longitudinal direction of the holding member and causes the binding rings to be changed in an opening direction such that the operating pieces are held in a direction approaching an inner surface of the holding member, wherein the opening-closing member includes an elastic member, the elastic member being provided in the operating member such that a distance between the operating pieces in an opening-closing direction of the binding rings is held at a distance enabling the pair of the operating pieces to be moved and being provided so as to move the pair of the operating pieces defining the operating member relative to each other in respective opposite directions and so as to elastically urge the pair of the operating pieces in a direction enabling the binding rings to be held in an opened state.

The opening-closing member may include a coil spring, the coil spring being provided in the operating member, one end extending from a coil portion of the coil spring being engaged with one of the operating pieces of the operating member, the other end extending from the coil portion being engaged with the other operating piece of the operating member, the opening-closing member being configured such that the distance between the operating pieces is maintained according to a distance extending from the coil portion.

In the operating member, one of the base portions of the binding rings is preferably secured to one of the operating pieces and the other base portion of the binding rings is preferably secured to the other operating piece, and wherein, when the binding rings are closed, the operating member is held in a state in which abutting edges of the operating pieces abut against each other at a position away from the inner surface of the holding member.

The opening-closing member may be configured such that a movement restricting member stops movement of the pair of the operating pieces of the operating member in respective opposite directions.

The opening-closing member may include a coil spring, the coil spring being provided in abutting edges of the pair of the operating pieces defining the operating member and being provided in the operating member such that one end extending from a coil portion of the coil spring presses one of the operating pieces of the operating member and such that the other end extending from the coil portion presses the other operating piece of the operating member.

According to preferred embodiments of the present invention, a binding device is provided which includes a plurality of annular binding rings each including two ring halves each having a binding ring-engaging portion on a free end thereof, the binding ring-engaging portions being engaged with each other, whereby each of the annular binding rings is formed; a holding member having a length which enables the binding rings to be disposed with a spacing therebetween; an operating member having a surface to which base portions of the respective binding rings are secured such that the binding rings are disposed with a spacing therebetween. The operating member includes a pair of operating pieces inside the holding member, the operating pieces being movable within the holding member in a longitudinal direction of the holding member such that the binding rings are secured to the holding member, and an opening-closing member which, when the binding rings are opened, moves the operating pieces within the holding member in the longitudinal direction of the holding member and causes the binding rings to be changed in an opening direction such that the operating pieces are held in a direction approaching an inner surface of the holding member, wherein the opening-closing member includes an elastic member, the elastic member being provided in the operating member such that a distance between the operating pieces in an opening-closing direction of the binding rings is maintained at a distance enabling the pair of the operating pieces to be moved and being provided so as to move the pair of the operating pieces defining the operating member relative to each other in respective opposite directions and so as to elastically urge the pair of the operating piece in a direction enabling the binding rings to be maintained in an opened state. Therefore, a binding device is obtained in which smooth opening and closing of the binding rings is facilitated and which is manufactured easily.

The binding device may be configured such that the opening-closing member includes a coil spring, the coil spring being provided in the operating member, one end extending from a coil portion of the coil spring being engaged with one of the operating pieces of the operating member, the other end extending from the coil portion being engaged with the other operating piece of the operating member, the opening-closing member being configured such that the distance between the operating pieces is maintained according to a distance extending from the coil portion.

When the binding device is configured as above, the operating member can be smoothly moved in the holding member while the distance between the operating pieces is maintained at an optimal distance. Therefore, a binding device is obtained in which smooth opening and closing of the binding rings is facilitated and which is manufactured easily.

Furthermore, the binding device may be configured such that, in the operating member, one of the base portions of the binding rings is secured to one of the operating pieces and the other base portion of the binding rings is secured to the other operating piece, and wherein, when the binding rings are closed, the operating member is held in a state in which abutting edges of the operating pieces abut against each other at a position away from the inner surface of the holding member. In this manner, the operating member can be smoothly moved in the holding member while the distance between the operating pieces is maintained at an optimal distance. Therefore, a binding device is obtained in which smooth opening and closing of the binding rings is facilitated and which is manufactured easily.

Moreover, the binding device may be configured such that the opening-closing member is arranged such that a movement restricting member stops movement of the pair of the operating pieces of the operating member in respective opposite directions. In this manner, the operating member can be smoothly moved in the holding member while the distance between the operating pieces can be maintained at an optimal distance. Therefore, a binding device is obtained in which smooth opening and closing of the binding rings is facilitated and which is manufactured easily.

Furthermore, the binding device may be configured such that the opening-closing member includes a coil spring, the coil spring being provided in abutting edges of the pair of the operating pieces defining the operating member and being provided in the operating member such that one end extending from a coli portion of the coil spring presses one of the operating pieces of the operating member and that the other end extending from the coil portion presses the other operating piece of the operating member. In this manner, the operating member can be smoothly moved in the holding member while the distance between the operating pieces can be maintained at an optimal distance. Therefore, a binding device is obtained in which smooth opening and closing of the binding rings is facilitated and which is manufactured easily.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 15(A) being a cross-sectional view taken along the line A-A in FIG. 14, and FIG. 15(B) being a cross-sectional view taken along the line B-B in FIG. 14.

FIG. 45(A) being a cross-sectional view taken along the line A-A in FIG. 44, and FIG. 45(B) being a cross-sectional view taken along the line B-B in FIG. 44.

FIG. 49(A) being a schematic plan view, and FIG. 49(B) being a schematic front view.

FIG. 50(A) being a schematic plan view, and FIG. 50(B) being a schematic front view.

FIG. 51(A) being a schematic plan view, and FIG. 51(B) being a schematic front view.

DETAILED DESCRIPTION OF PREFERRED EMBODIMENTS

Figure 1:
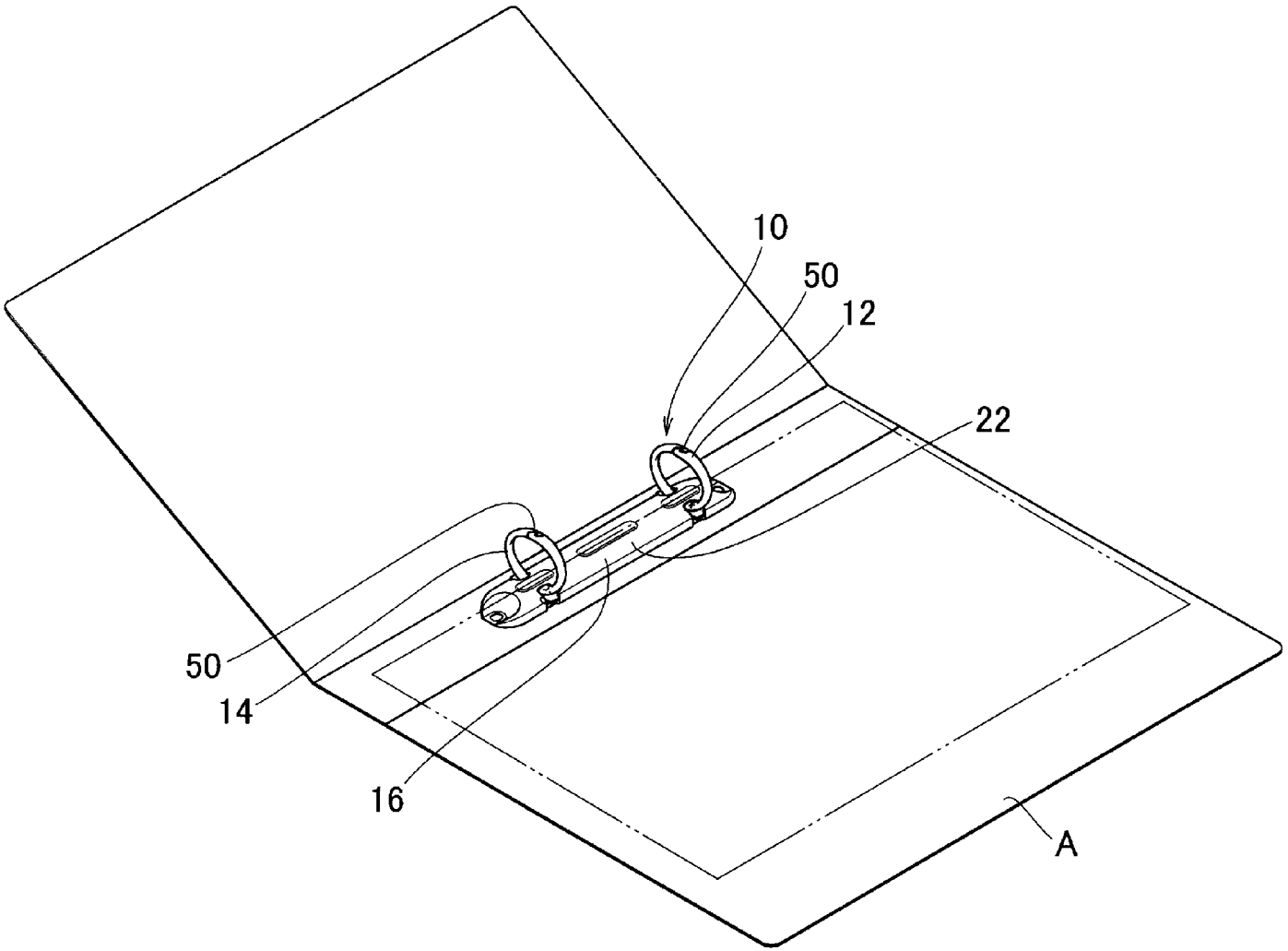
FIG. 1 is a perspective view illustrating a file with a binding device of a preferred embodiment according to the present invention, the binding device being opened.
Figure 2:
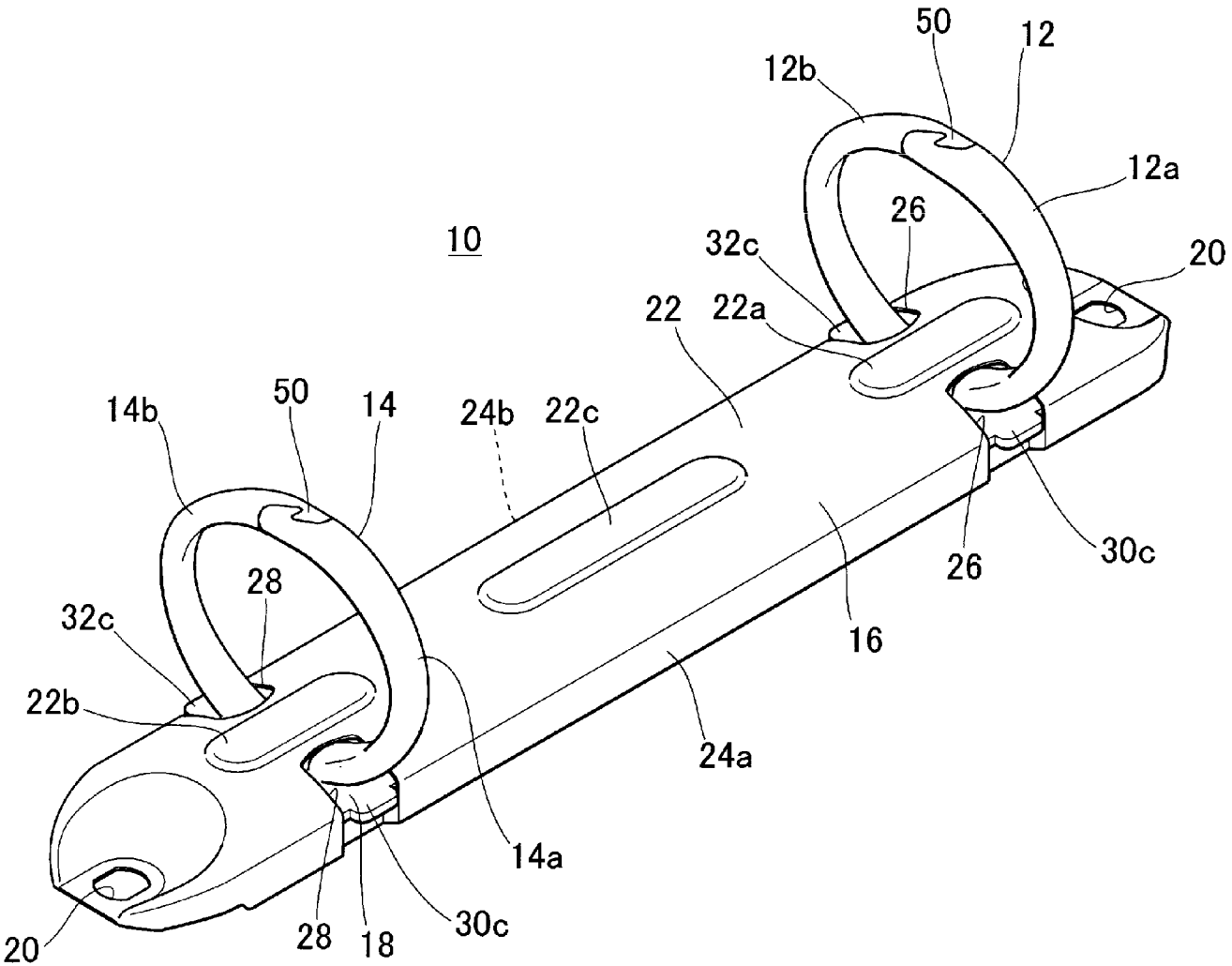
FIG. 2 is a perspective view illustrating an example of the binding device of this preferred embodiment according to the present invention.
Figure 3:
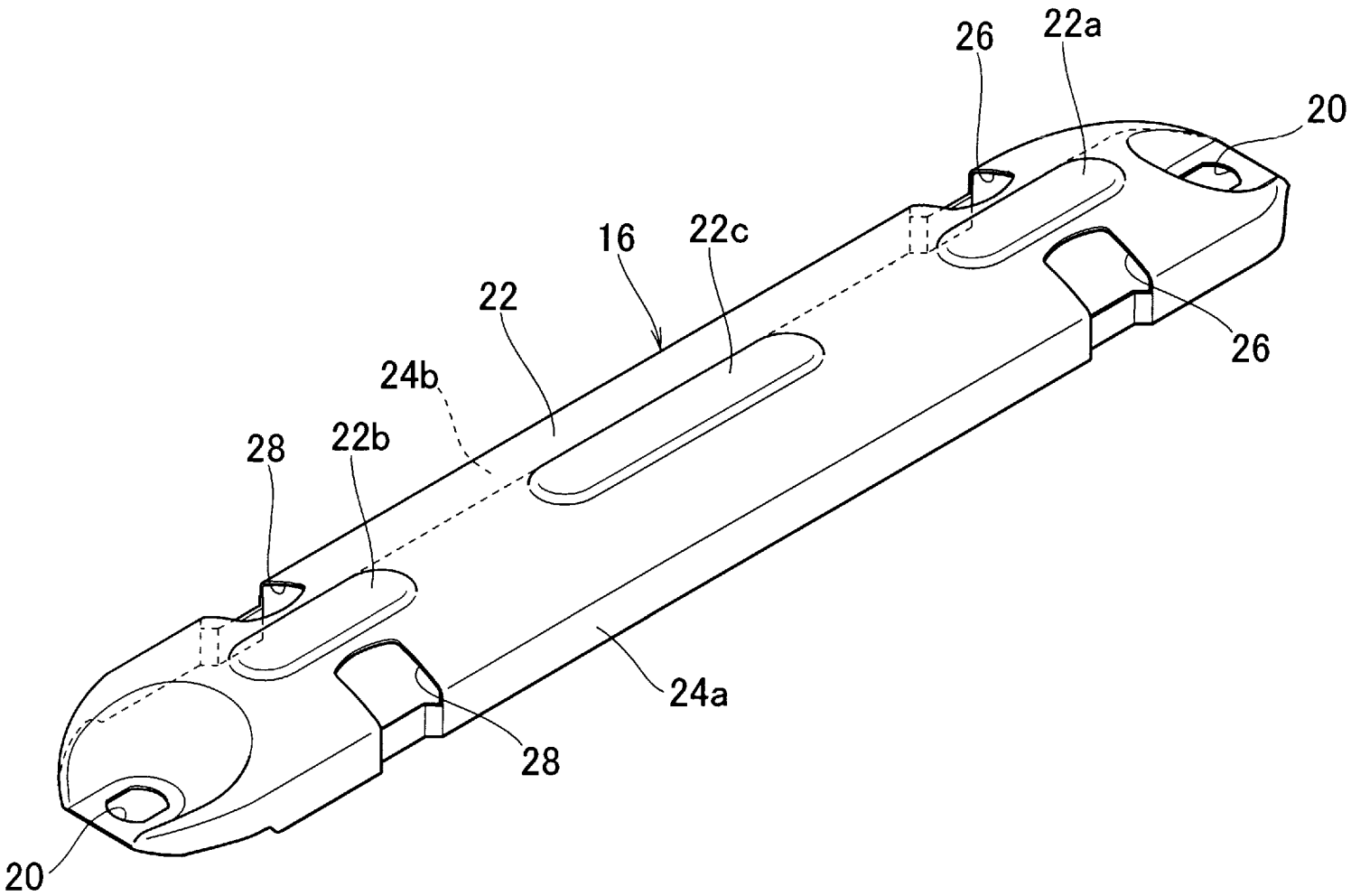
FIG. 3 is a perspective view of a holding member.
Figure 4:
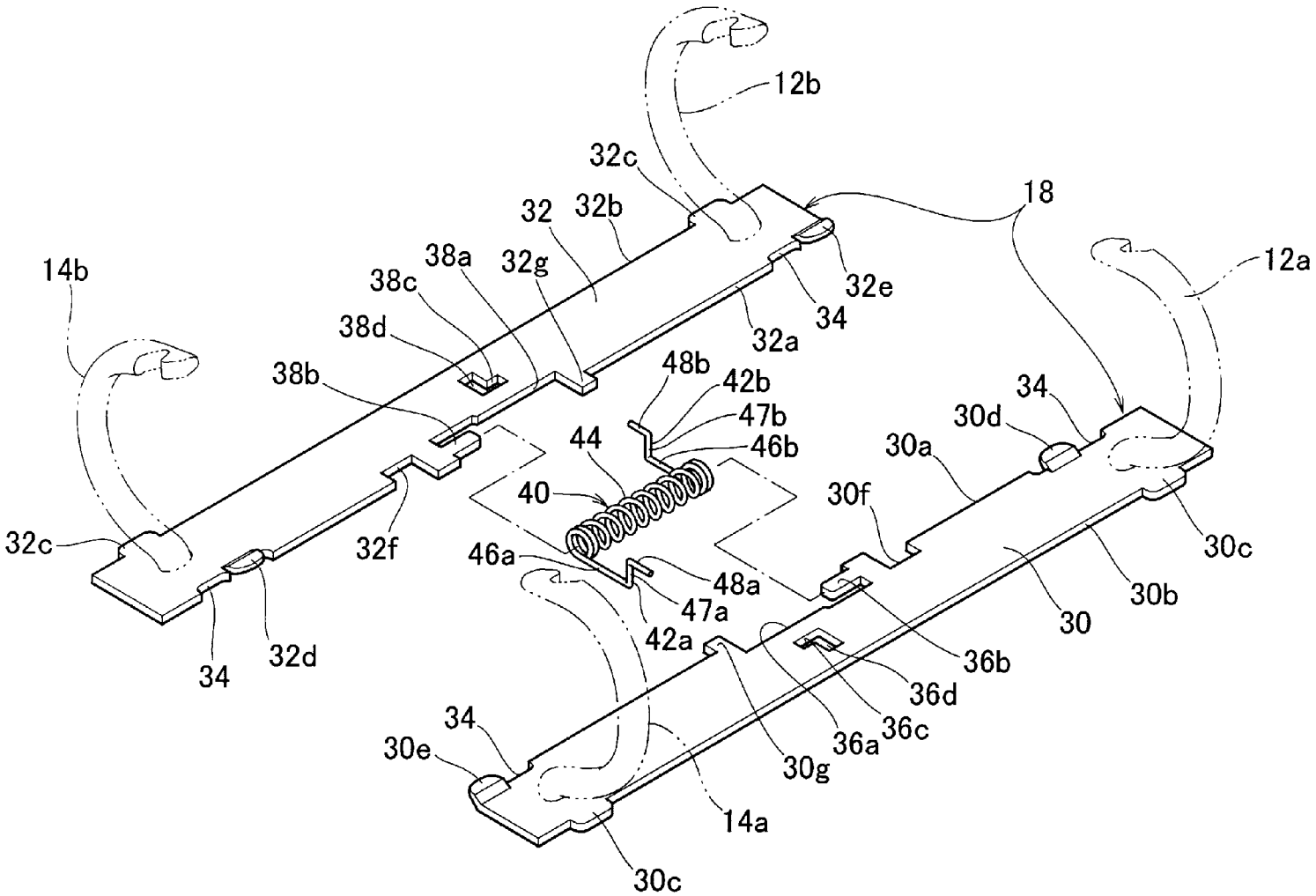
FIG. 4 is a schematic perspective view of an operating member and an opening-closing member.
Figure 5:
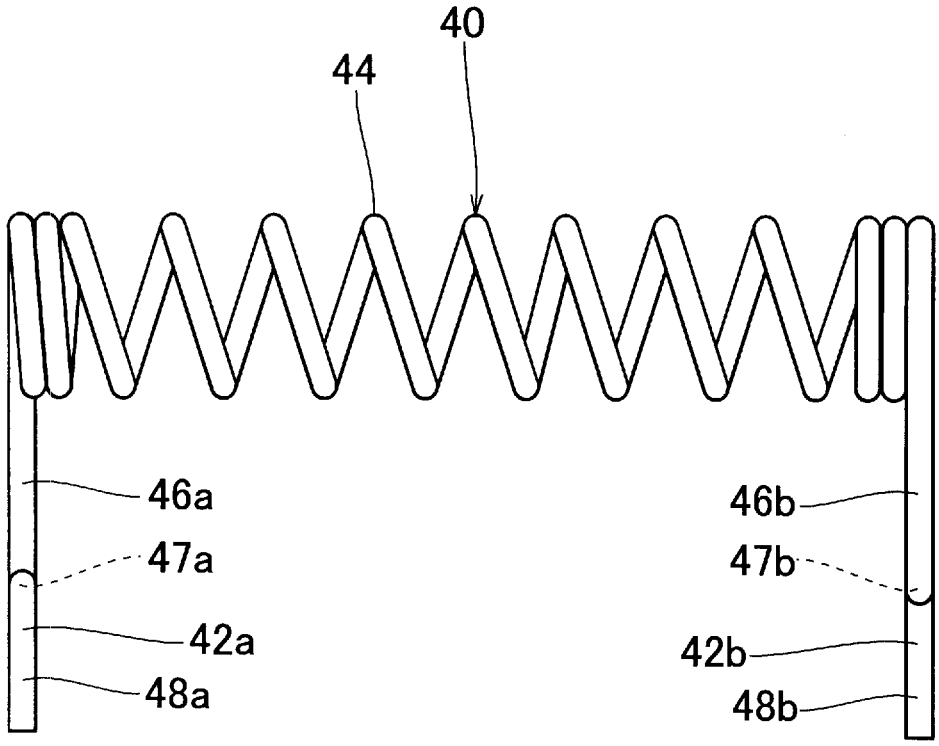
FIG. 5 is a plan view of the opening-closing member.
Figure 6:
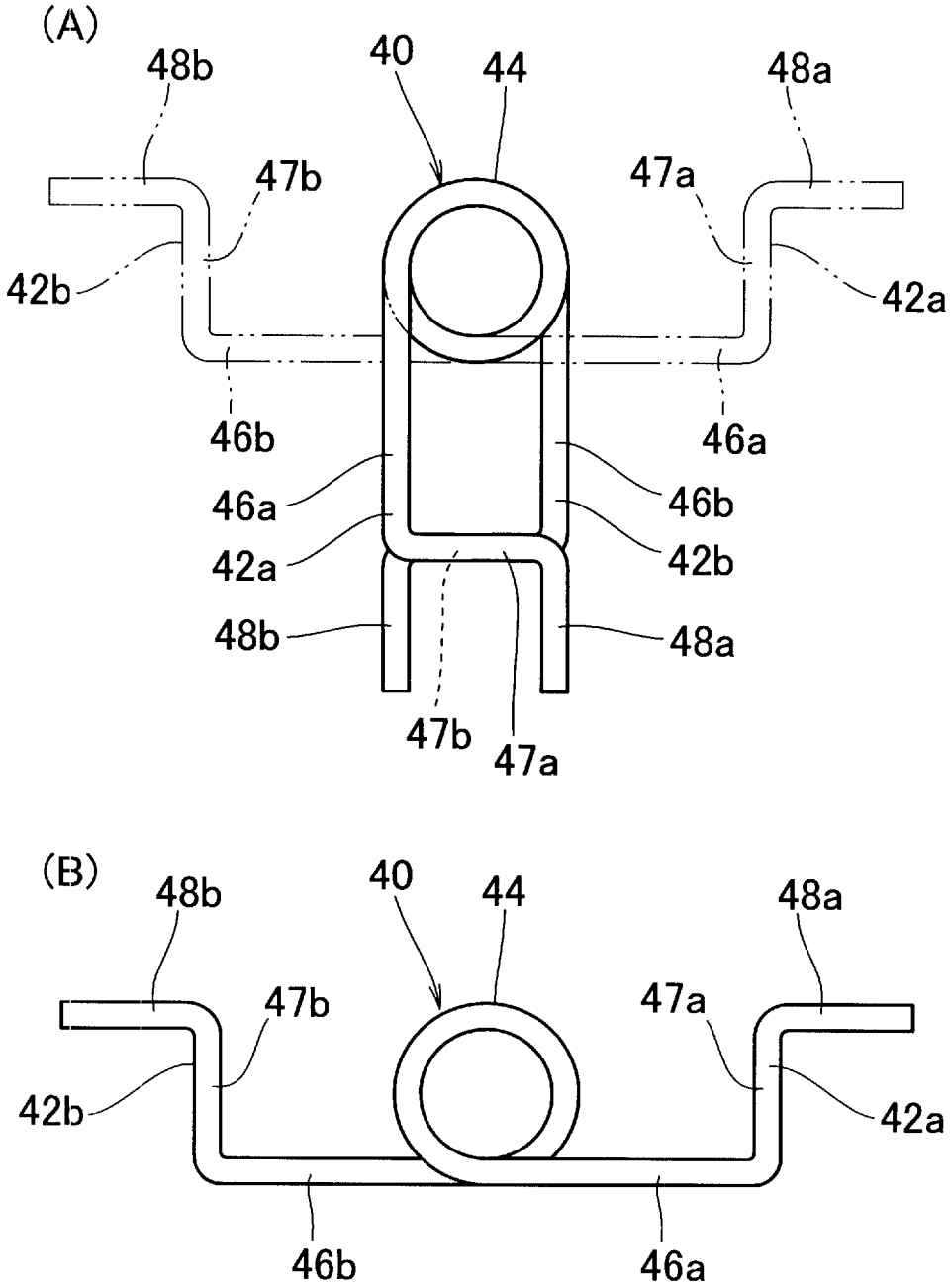
FIGS. 6(A) and 6(B) are schematic side views of the opening-closing member, FIG. 6(A) being a schematic side view of an original state, and FIG. 6(B) being a schematic side view of a state in which a force is applied in a circumferential direction of a coil portion.
Figure 7:
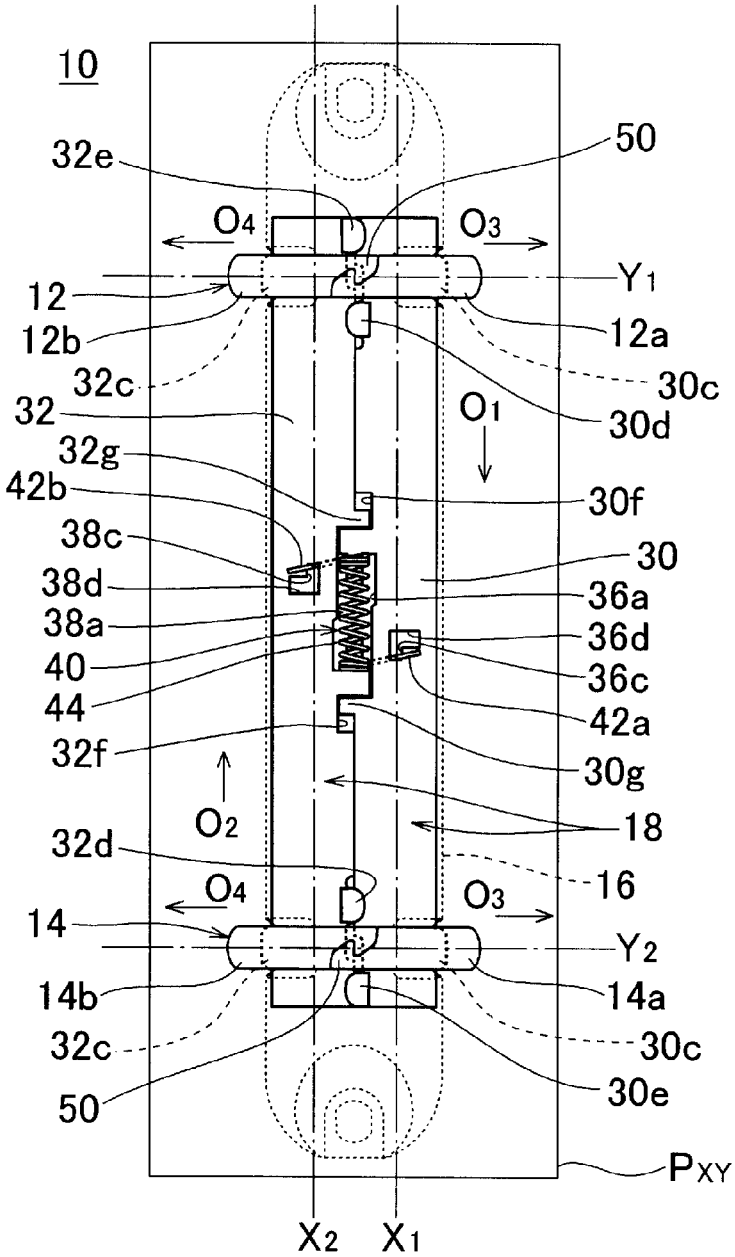
FIGS. 7(A) and 7(B) are schematic views of the binding rings and the operating member, FIG. 7(A) being a schematic plan view illustrating the binding rings and the operating member in a closed state, and FIG. 7(B) being a schematic right side view of a second operating piece.
Figure 7:
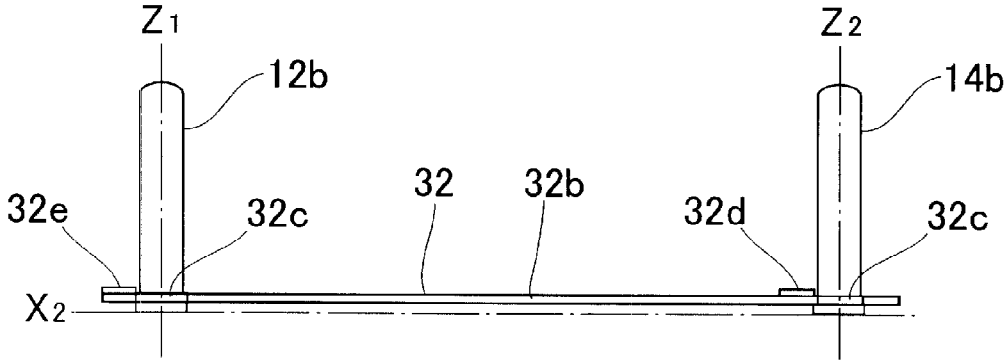
Figure 8:
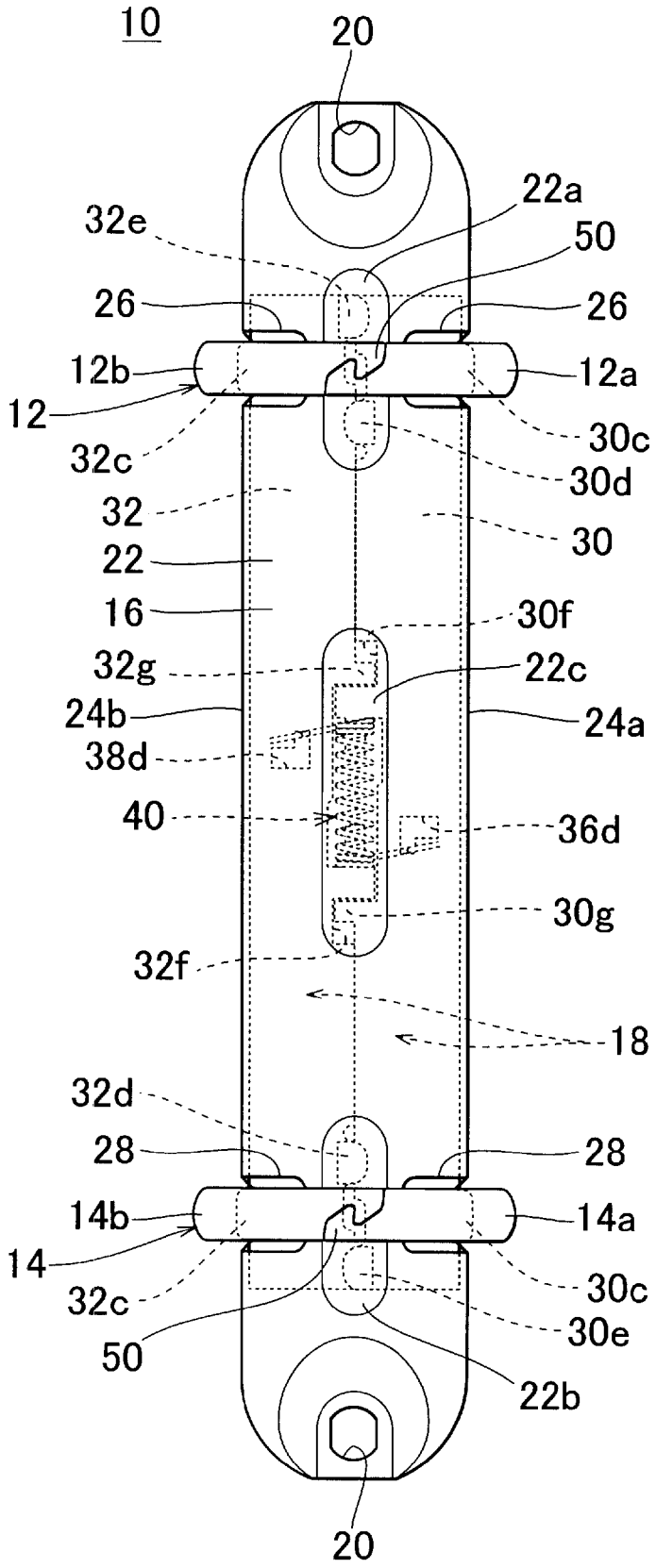
FIG. 8 is a plan view of the binding device in the closed state.
Figure 9:
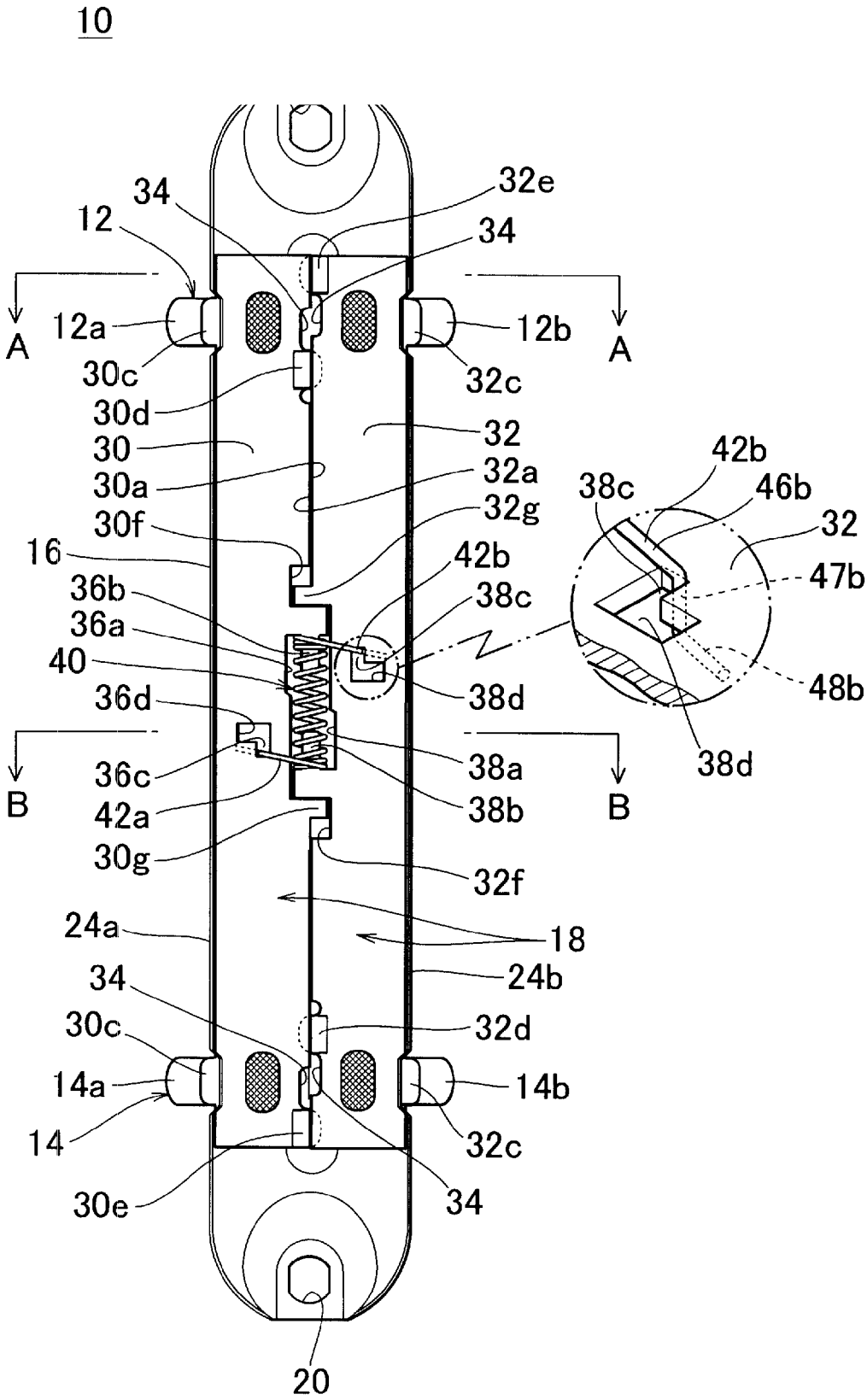
FIG. 9 is a bottom view of the binding device in the closed state.
Figure 11:
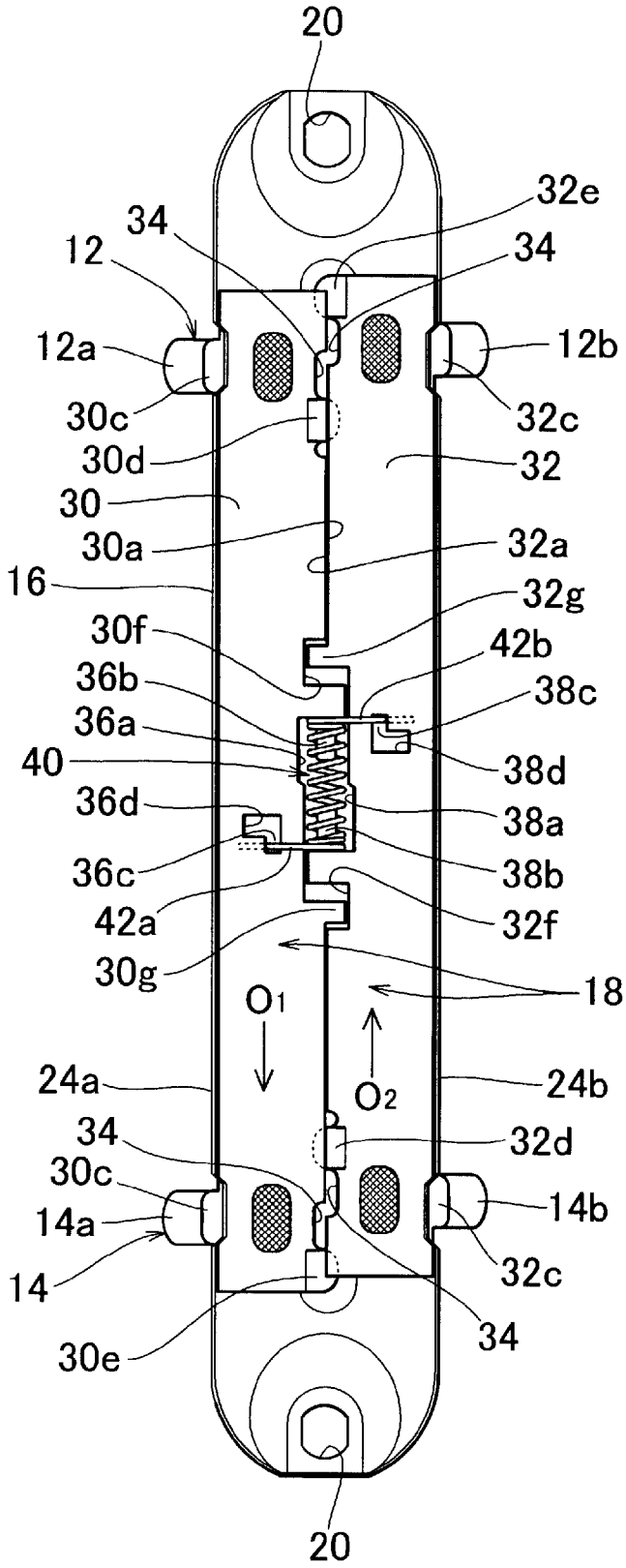
FIG. 11 is a bottom view of the binding device, illustrating a state in which the binding rings are being opened.
Figure 12:
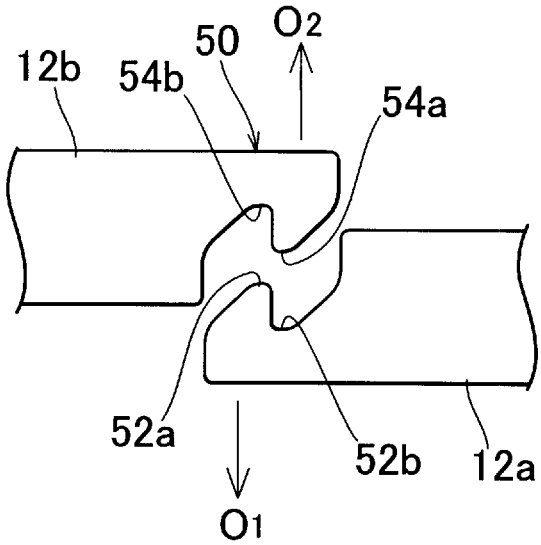
FIG. 12 is a schematic view of the binding rings of the binding device, illustrating the state in which the binding rings are being opened.
Figure 12:
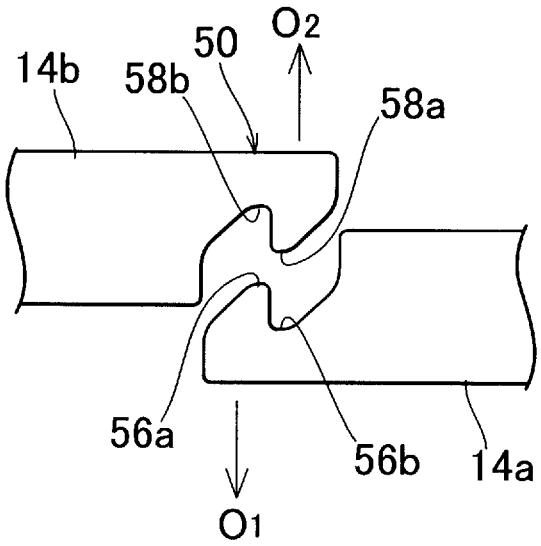
Figure 13:
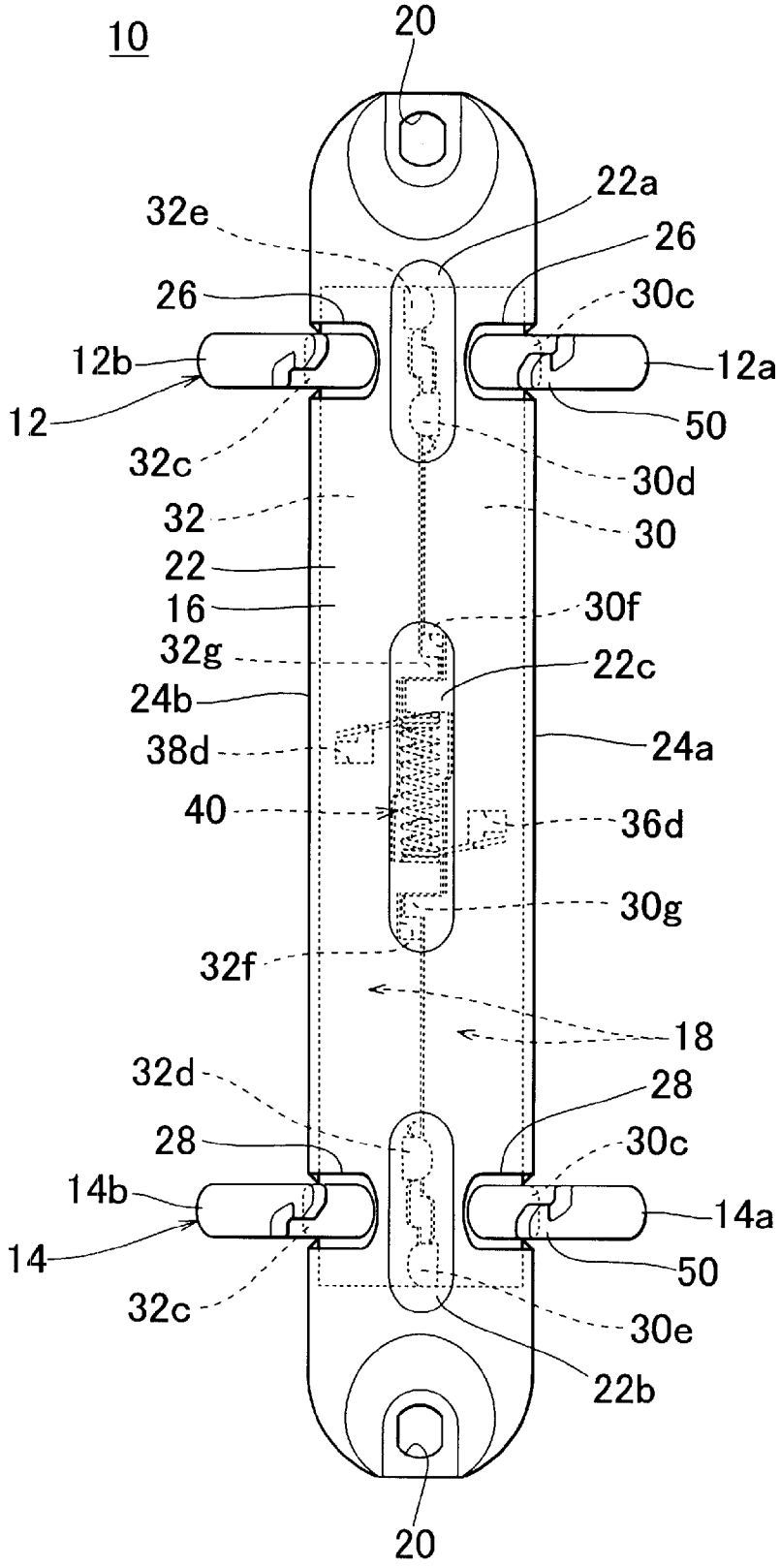
FIG. 13 is a plan view of the binding device in an opened state.

FIG. 1 is a perspective view illustrating a file in which a binding device according to a preferred embodiment of the present invention is provided. FIG. 2 is a schematic perspective view illustrating an example of the binding device of the preferred embodiment according to the present invention, and FIG. 3 is a perspective view of a holding member. FIG. 4 is a perspective view of an operating member and an opening-closing member. FIG. 5 is a plan view of the opening-closing member. FIGS. 6(A) and 6(B) are schematic side views of the opening-closing member, FIG. 6(A) being a schematic side view of an original state, and FIG. 6(B) being a schematic side view of a state in which a force is applied in a circumferential direction of a coil part. FIGS. 7(A) and 7(B) are schematic views of the binding rings and the operating member, FIG. 7(A) being a schematic plan view of the binding rings and the operating member in a closed state, and FIG. 7(B) being a schematic right side view of a second operating piece. FIG. 8 is a plan view of the binding device in the closed state. FIG. 9 is a bottom view of the binding device in the closed state. FIGS. 10(A) and 10(B) are cross-sectional side views of the binding device in the closed state, FIG. 10(A) being a cross-sectional view taken along the line A-A in FIG. 9, and FIG. 10(B) being a cross-sectional view taken along the line B-B in FIG. 9. FIG. 11 is a bottom view of the binding device, illustrating a state in which the binding rings are being opened. FIG. 12 is a schematic view of the binding rings of the binding device, illustrating the state in which the binding rings are being opened.

A binding device 10 shown in FIGS. 1 to 12 is fastened to the inner surface of a back cover between a pair of left and right fold lines provided substantially in the center of a cover A made of a relatively hard sheet material, such as cardboard. As a fastening method, the binding device 10 is fastened by inserting a fastener such as a bolt with a nut and an eyelet into an attaching hole 20 (described later) provided in both the longitudinal end portions of the binding device 10 and is integrated with the back cover.

Here, a description is provided of the case of using a bolt with a nut as the fastener; however, the fastener is not limited thereto. For example, a screw, an eyelet, a rivet, or other suitable fasteners may be used. Furthermore, fastening to the back cover may be performed by a fastening method such as ultrasonic welding or high frequency welding.

The binding device 10 includes a substantially annular first binding ring 12 and a substantially annular second binding ring 14 defining a pair with the first binding ring 12, which are made of metal; a holding member 16 having a length which enables the first and second binding rings 12 and 14 to be disposed with a spacing therebetween, and an operating member 18 having a surface to which the base portions of each of the first and second binding rings 12 and 14 are secured with a spacing between the first and second binding rings 12 and 14, the operating member 18 being movably secured inside the holding member 16 such that the first and second binding rings 12 and 14 are secured to the holding member 16.

The holding member 16 has a substantially rectangular shape in plan view having a length which enables the first and second binding rings 12 and 14 to be disposed with a predetermined spacing therebetween. Furthermore, both of the end portions of the holding member 16, or portions in the vicinity of the attaching hole 20 for attaching the holding member 16 to the cover A, have a substantially semicircular arc shape in plan view.

The holding member 16 has a bound object-mounting portion 22 which extends inwardly between the vicinities longitudinally outside the portions for securing the first and second binding rings 12 and 14 and which has a substantially semicircular arc shaped cross-section having a bulging portion at the approximate center. In addition, the holding member 16 is configured to have a holding space inside the bound object-mounting portion 22 so that the operating member 18 and other related elements are contained in the holding space.

Along both of the edges of the bound object-mounting portion 22 of the holding member 16, holding walls 24*a* and 24*b* are respectively provided, each of which extends in the longitudinal direction substantially from one end of the bound object-mounting portion 22 to the other end and slidably holds the operating member 18. In this preferred embodiment, the holding walls 24*a* and 24*b* are provided consecutively so as to hang down from substantially entire portions, respectively, each extending, in the longitudinal direction of the holding member 16, inwardly between the vicinities outside the first and second binding rings 12 and 14. Furthermore, the holding walls 24*a* and 24*b* are in parallel to each other and have substantially the same plate-like shape.

The operating member 18 to be described in detail later is accommodated in the holding space surrounded by the holding walls 24*a* and 24*b* and the bound object-mounting portion 22.

The bound object-mounting portion 22 of the holding member 16 is provided with first and second through holes 26 and 28 which allow the first and second binding rings 12 and 14, respectively, to loosely pass therethrough with a predetermined distance (a predetermined length defined by Japanese Industrial Standards or the like) between the binding rings 12 and 14.

Each of the first and second through holes 26 and 28 is provided in two portions, i.e., left and right portions which are separated by a predetermined distance in the width direction of the holding member 16 so as to conform to a ring half 12*a* and a ring half 12*b* defining the first binding ring 12 or a ring half 14*a* and a ring half 14*b* defining the second binding ring 14.

The operating member 18 is composed of a pair of a first operating piece 30 and a second operating piece 32 each made of a metal plate having a substantially rectangular shape in plan view.

The first and second operating pieces 30 and 32 are configured with outside edges 30*b* and 32*b*, respectively, which are in parallel with the holding walls 24*a* and 24*b*, respectively, in the longitudinal direction of the respective operating pieces and which slide along the inner surfaces of the holding walls 24*a* and 24*b*, respectively. The first and second operating pieces 30 and 32 are symmetric with respect to a point and are formed with an abutting edge 30*a* and an abutting edge 32*a*, respectively. The abutting edges 30*a* and 32*a* are provided along the inner edges of the first and second operating pieces 30 and 32, respectively, so as to be in parallel with the outside edges 30*b* and 32*b*, respectively, and are arranged to abut the pair of the first and second operating pieces 30 and 32 with each other. Furthermore, when the first and second operating pieces 30 and 32 are juxtaposed along the longitudinal direction thereof within the holding space of the holding member 16, the first and second operating pieces 30 and 32 are engaged with each other at the inner edges thereof so as to be bendable. More specifically, the abutting edges 30*a* and 32*a* abut against each other, and the outside edges 30*b* and 32*b* are brought into contact with the inner surfaces of the holding walls 24*a* and 24*b* of the holding member 16, respectively.

When no force is applied from the outside, the first and second operating pieces 30 and 32 form a V shape, i.e., are directed in a direction away from the inner surface of the bound object-mounting portion 22 of the holding member 16 (the abutting edges 30*a* and 32*a* are positioned below a plane $P_{xy}$ shown in FIG. 7). Alternatively, the first and second operating pieces 30 and 32 form an inverted V shape, i.e., are directed in a direction approaching the inner surface of the bound object-mounting portion 22 of the holding member 16 (the abutting edges 30*a* and 32*a* are positioned above the plane $P_{xy}$ shown in FIG. 7). The first and second operating pieces 30 and 32 are provided inside the holding space of the holding member 16 so as to maintain the V-shaped state or the inverted V-shaped state.

The plane $P_{xy}$ is a plane including left-right axes $Y_1$ and $Y_2$ and front-rear axes $X_1$ and $X_2$ (shown in FIG. 7) and passing portions on the first and second operating pieces 30 and 32, i.e., four portions to each of which one of the base portions of the first binding ring 12 or the second binding ring 14 is secured.

In the operating member 18, the base portion of the ring half 12*a* defining the first binding ring 12 is secured to the surface (the upper surface) of one of the operating pieces, i.e., the first operating piece 30, which surface faces the inner surface of the bound object-mounting portion 22 of the holding member 16. In addition, the base portion of the ring half 14*a* defining the second binding ring 14 is secured to this surface so as to be separated from the ring half 12*a* by a predetermined distance.

Furthermore, the base portion of the ring half 12*b* defining the first binding ring 12 is secured to the surface (the upper surface) of the other operating piece, i.e., the second operating piece 32, whose surface faces the bound object-mounting portion 22 of the holding member 16. In addition, the base portion of the ring half 14*b* defining the second binding ring 14 is secured to this surface so as to be separated from the ring half 12*b* by a predetermined distance.

The pair of the operating pieces, i.e., the first and second operating pieces 30 and 32, include a protruding portion 30*c* and a protruding portion 32*c*, respectively, each of which is inserted in the through holes, i.e., the first and second through holes 26 and 28, provided in the holding member 16. The pair of the first and second operating pieces 30 and 32 abut against each other with the protruding portions 30*c* and 32*c*, which are inserted in the first and second through holes 26 and 28. The first and second operating pieces 30 and 32 are held in the holding member 16 so as to be rotationally movable in a direction of opening-closing the first and second binding rings 12 and 14, so that the abutting edges 30*a* and 32*a* are disposed close to the inner surface of the holding member 16 when the binding rings, i.e., the first and second binding rings 12 and 14, are opened and that the abutting edges 30*a* and 32*a* are separated away from the inner surface of the holding member 16 when the first and second binding rings 12 and 14 are closed.

The first and second operating pieces 30 and 32 are provided with the abutting edges 30*a* and 32*a*, respectively, on the inner side thereof. The abutting edges 30*a* and 32*a* are substantially linear, and the pair of the operating pieces abut against each other along the abutting edges 30*a* and 32*a*. Furthermore, the first and second operating pieces 30 and 32 are provided with the outside edges 30*b* and 32*b*, respectively, on the outer side thereof, the outside edges 30*b* and 32*b* being substantially parallel to the abutting edges 30*a* and 32*a*, respectively, and being substantially linear.

The protruding portion 30*c* is provided at front and rear positions, i.e., at two positions close to the attachment positions of the base portions of the ring halves 12*a* and 14*a*, respectively. In addition, the protruding portion 32*c* is provided at front and rear positions, i.e., at two positions close to the attachment positions of the base portions of the ring halves 12*b* and 14*b*. The protruding portions 30*c* and 32*c* protrude outwardly from the holding walls 24*a* and 24*b* of the holding member 16, respectively, so as to allow the first and second binding rings 12 and 14 to be opened and closed.

The protruding portions 30*c* and 32*c* have a tongue-like shape which has a length that enables them to protrude outwardly from the through holes (the first and second through holes 26 and 28) of the holding member 16 and has a width that enables the operating member 18 to move in the longitudinal direction of the holding member 16.

The operating pieces are made of a thin plate of metal or plastic, and the operating pieces are integrally formed with the respective protruding portions.

The first operating piece 30 is provided with engaging portions 30*d* and 30*e* which are provided for engaging the pair of the operating pieces with each other and protrude from the abutting edge 30*a* of the first operating piece 30 toward the abutting edge 32*a* of the second operating piece 32. In addition, engaging portions 32*d* and 32*e* for engaging the pair of the operating pieces with each other are provided to protrude from the abutting edge 32*a* of the second operating piece 32 toward the abutting edge 30*a* of the first operating piece 30.

The engaging portions 30*d* and 30*e* and the engaging portions 32*d* and 32*e* extend toward the upper side of the second and first operating pieces 32 and 30, respectively, opposed to each other, and thus, are formed to allow the first and second operating pieces 30 and 32 to oscillate about the abutting edges 30*a* and 32*a*.

Each of the engaging portions 30*d* and 30*e* and the engaging portions 32*d* and 32*e* has a substantially U shape in plan view having a base portion and a retaining portion, the base portion protruding an amount corresponding to the thickness of the operating member 18 toward the inner surface side of the bound object-mounting portion 22 of the holding member 16, the retaining portion protruding from the end of the base portion. The retaining portion functions to prevent disengagement of the first operating piece 30 or the second operating piece 32, which is one of the pair of the operating pieces, i.e., the first and second operating pieces 30 and 32. Each of the engaging portions 30*d* and 30*e* and the engaging portions 32*d* and 32*e* protrudes toward the inner surface side of the bound object-mounting portion 22 of the holding member 16. The retaining portion comes into contact with the surface of the first operating piece 30 or the second operating piece 32, which is one of the operating pieces of the pair of the operating pieces, i.e., the first and second operating pieces 30 and 32, the surface being on the inner surface side of the bound object-mounting portion 22 of the holding member 16.

Each of the outermost engaging portions 30*e* and 32*e* has a width which enables the edge of the operating member 18 to be positioned within the width even when the first and second operating pieces 30 and 32 are moved in opposite directions.

The outermost engaging portions 30*e* and 32*e* are configured to be separated from the inward engaging portions 30*d* and 32*d*, respectively, by an appropriate distance so that the portion attached to the base portion of the first binding ring 12 or the second binding ring 14 is located therebetween. A clearance portion 34 for inserting a rod-like jig G between the abutting edges 30*a* and 32*a* of the first and second operating pieces 30 and 32 is provided between the outermost engaging portion 30*e* and the inward engaging portion 32*d* and between the outermost engaging portion 32*e* and the inward engaging portion 30*d*.

Figure 10:
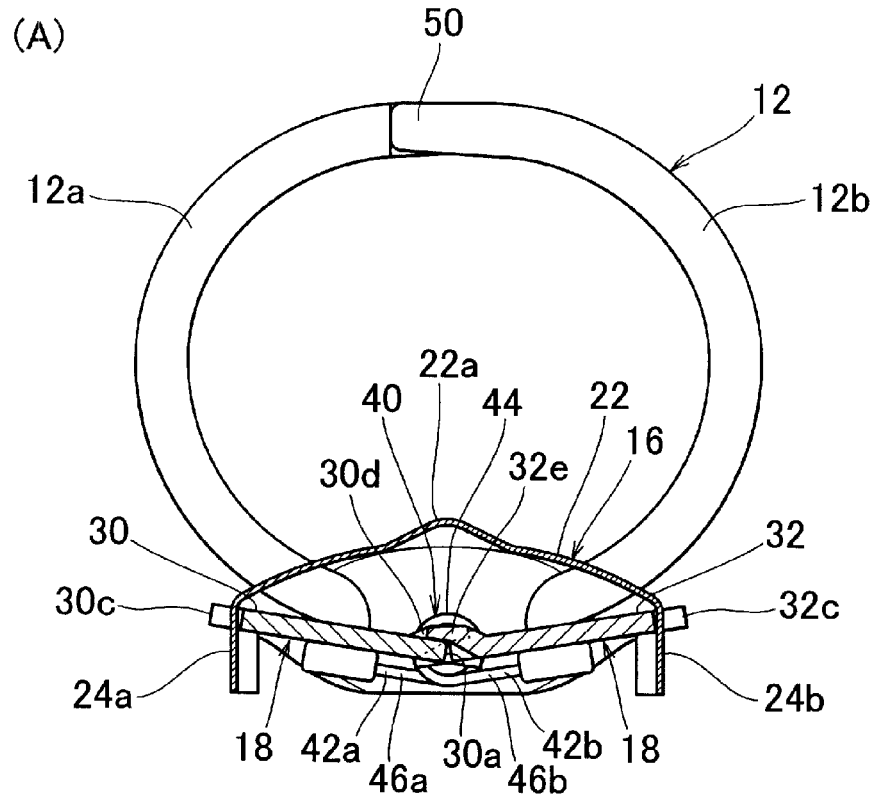
FIGS. 10(A) and 10(B) are cross-sectional side views of the binding device in the closed state, FIG. 10(A) being a cross-sectional view taken along the line A-A in FIG. 9, and FIG. 10(B) being a cross-sectional view taken along the line B-B in FIG. 9.
Figure 10:
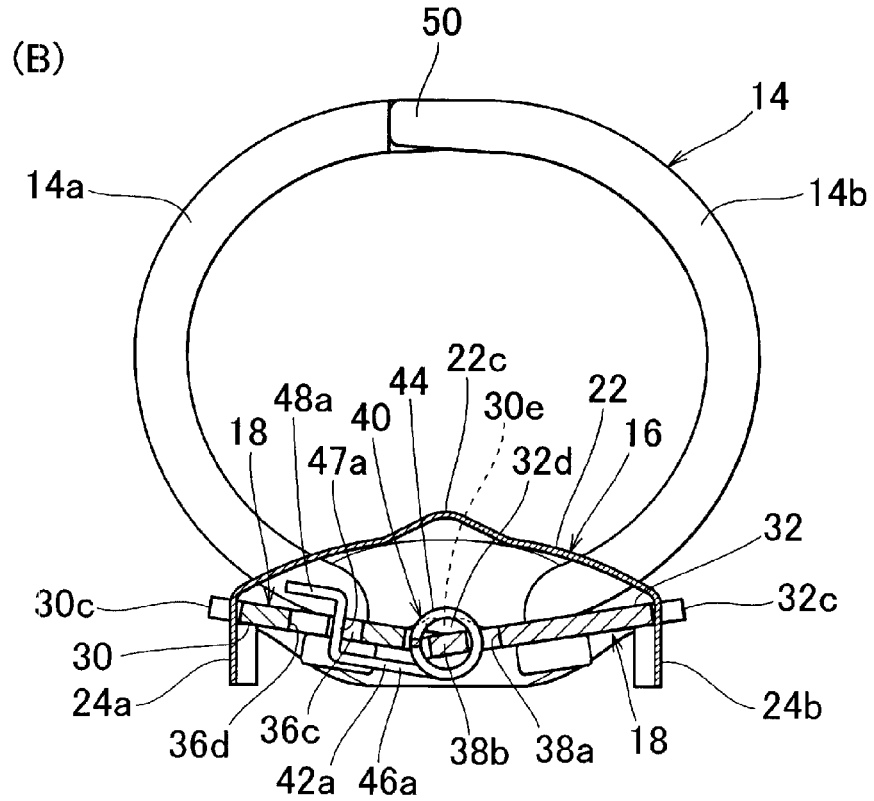
Figure 15:
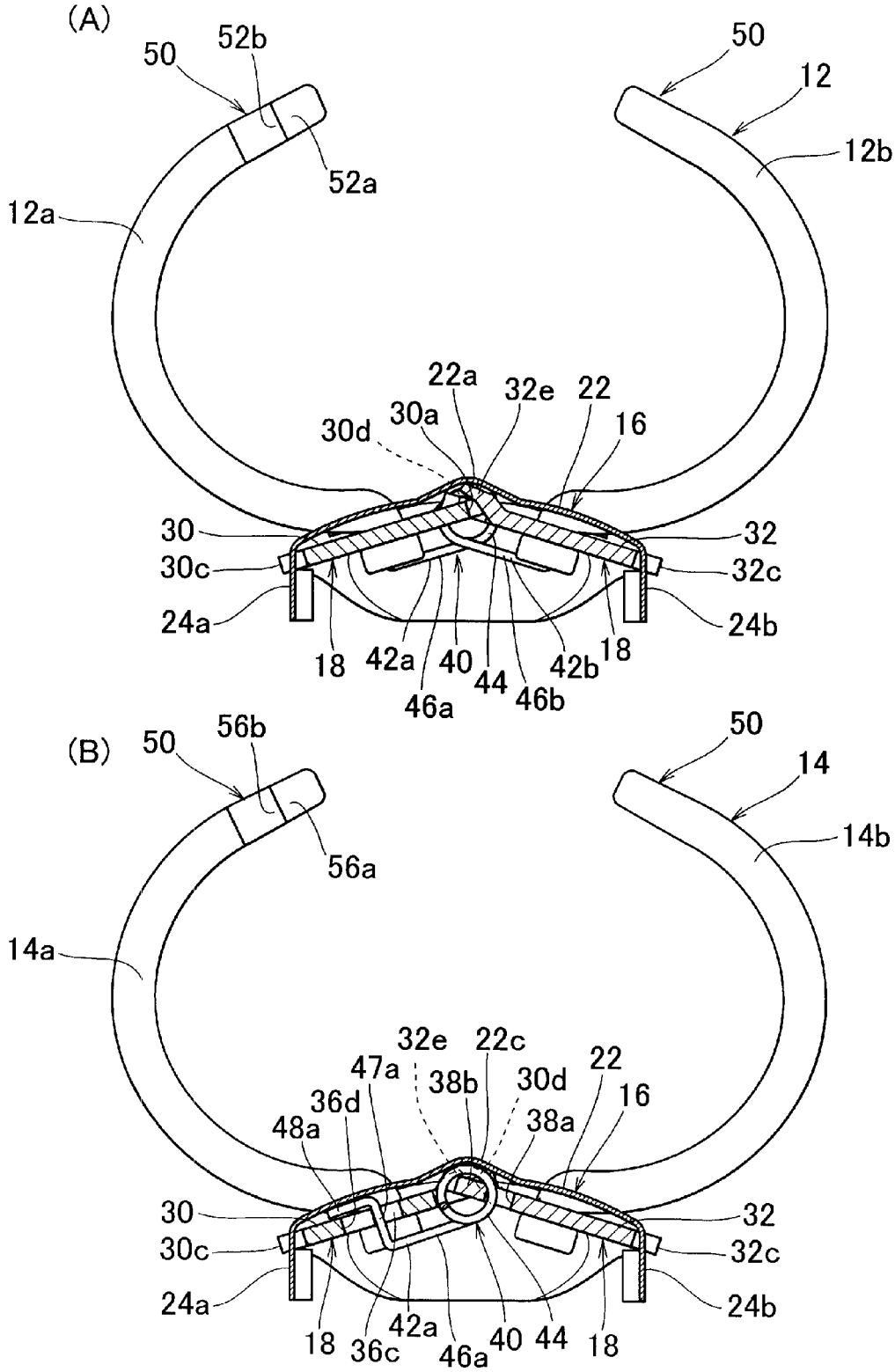
FIGS. 15(A) and 15(B) are cross-sectional side views of the binding device in the opened state.
Figure 16:
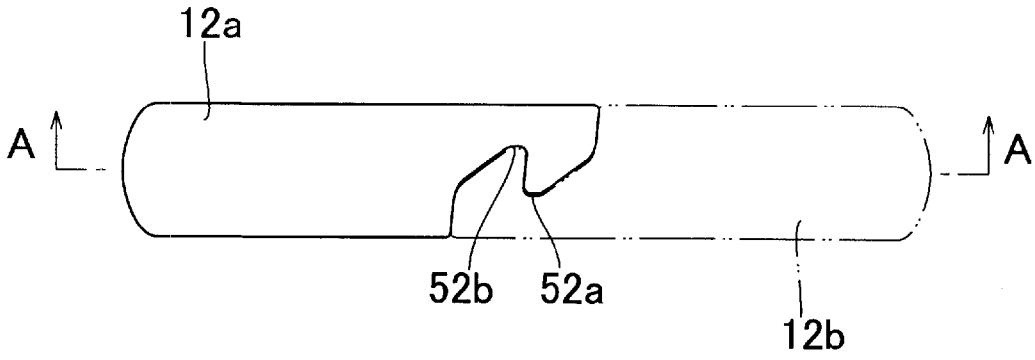
FIGS. 16(A), 16(B), and 16(C) are schematic views illustrating engaging portions of the binding rings, FIG. 16(A) being a schematic plan view, FIG. 16(B) being a schematic cross-sectional view taken along the line A-A in FIG. 16(A), and FIG. 16(C) being a schematic front view.
Figure 16:
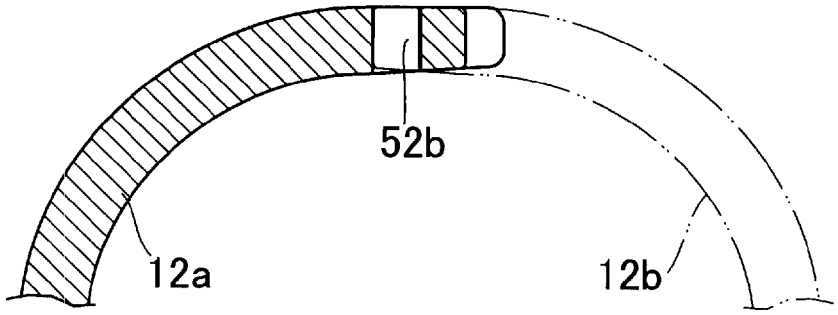
Figure 16:
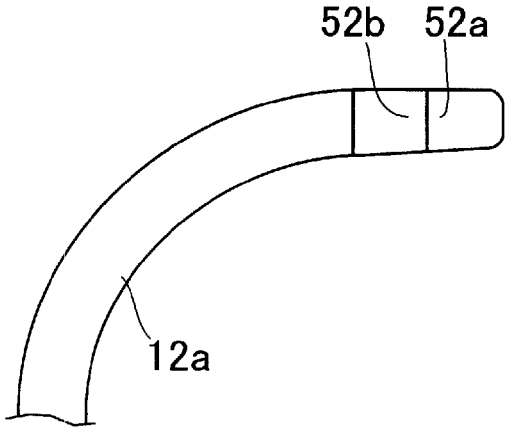

As shown in FIG. 10, when the first and second binding rings 12 and 14 are closed, the first and second operating pieces 30 and 32 defining the operating member 18 are secured in the space inside the holding member 16 so as to be held in a state (i.e., a V-shaped state) in which the abutting edges 30*a* and 32*a* of the first and second operating pieces 30 and 32 abut against each other with the abutting edges 30*a* and 32*a* directed in a direction away from the inner surface of the holding member 16 (the inner surface of the bound object-mounting portion 22). In addition, as shown in FIG. 15, when the first and second binding rings 12 and 14 are opened, the first and second operating pieces 30 and 32 defining the operating member 18 are secured in the space inside the holding member 16 so as to be held in a state (i.e., in an inverted V-shaped state) in which the abutting edge 32*a* of the second operating piece 32 abuts on the inner surface of the holding member 16 (the inner surface of the bound object-mounting portion 22) with the abutting edges 30*a* and 32*a* directed in a direction approaching the inner surface.

Furthermore, the first and second operating pieces 30 and 32 defining the operating member 18 are slidably disposed such that, when the operating pieces 30 and 32 are directed in a direction approaching the inner surface of the bound object-mounting portion 22 of the holding member 16, i.e., are in an inverted V-shaped state, the first and second operating pieces 30 and 32 can be movable in the longitudinal direction of the first and second operating pieces 30 and 32, i.e., a direction parallel to the line ($X_1$ in FIG. 7) connecting the ring halves 12*a* and 14*a* secured to the first operating piece 30 and parallel to the line ($X_2$ in FIG. 7) connecting the ring halves 12*b* and 14*b* secured to the second operating piece 32.

Each of the first and second operating pieces 30 and 32 is provided with a movement restricting portion, which is provided in the vicinities outside gap portions 36*a* and 38*a* and opening-closing member-securing portions 36*b* and 38*b*. The movement restricting portion is provided to restrict the movement of the first and second operating pieces 30 and 32 in the longitudinal direction.

The movement restricting portion includes a restricting recess 30*f*, a restricting projection 30*g*, a restricting recess 32*f*, and a restricting projection 32*g*, the restricting recess 30*f* and the restricting projection 30*g* being provided in the abutting edge 30*a* of the first operating piece 30, the restricting recess 32*f* and the restricting projection 32*g* being provided in the abutting edge 32*a* of the second operating piece 32.

The restricting recess 30*f* is a hole which is provided in the vicinity outside the opening-closing member-securing portion 36*b* and has a square U shape in plan view recessed from the abutting edge 30*a* in the width direction. The restricting projection 32*g* is a projection which has a square U shape in plan view and is configured so as to loosely fit into the restricting recess 30*f*. The restricting projection 32*g* and the restricting recess 30*f* are configured such that the restricting projection 32*g* fits loosely into the restricting recess 30*f* to allow the first and second operating pieces 30 and 32 to move in opposite longitudinal directions inside the restricting recess 30*f*.

The restricting recess 32*f* is a hole which is provided in the vicinity outside the opening-closing member-securing portion 38*b* and has a square U shape in plan view recessed from the abutting edge 32*a* in the width direction. The restricting projection 30*g* is a projection which has a square U shape in plan view and is configured so as to loosely fit into the restricting recess 32*f*. The restricting projection 30*g* and the restricting recess 32*f* are configured such that the restricting projection 30*g* fits loosely into the restricting recess 32*f* to allow the first and second operating pieces 30 and 32 to move in opposite longitudinal directions inside the restricting recess 32*f*.

An opening-closing member 40 for shifting the first and second binding rings 12 and 14 in the opening-closing direction is provided between the abutting edge 30*a* of the first operating piece 30 and the abutting edge 32*a* of the second operating piece 32.

The opening-closing member 40 is a twisted coil spring including a coil portion 44 and securing end portions 42*a* and 42*b* which extend continuously from the respective ends of the coil part 44 in a direction orthogonal to the central axis of the coil part 44. In an original state in which no twisting moment is generated, the securing end portions 42*a* and 42*b* protrude in a circumferential direction so as to be parallel to each other. The securing end portions 42*a* and 42*b* are provided with linear securing portions 46*a* and 46*b*, respectively, which protrude from the coil portion 44, intermediate portions 47*a* and 47*b*, respectively, which are provided on free end sides of the securing portions 46*a* and 46*b*, respectively, and engaging ends 48*a* and 48*b* which are provided on free end sides of the intermediate portions 47*a* and 47*b*, respectively, i.e., on respective one sides of the intermediate portions 47*a* and 47*b* which sides are opposite to the securing portions 46*a* and 46*b*. The securing portions 46*a* and 46*b* are orthogonal to the intermediate portions 47*a* and 47*b*, respectively, and the intermediate portions 47*a* and 47*b* are orthogonal to the engaging ends 48*a* and 48*b*, respectively.

In an original state in which no twisting moment is generated, the one securing portion 46*a* and the other securing portion 46*b* are arranged so as to be parallel to each other, and the one engaging end 48*a* and the other engaging end 48*b* are arranged so as to be parallel to each other.

A gap portion 36*a* is formed near a substantially central portion of the abutting edge 30*a* of the first operating piece 30 defining the binding device 10, and a gap portion 38*a* is formed near a substantially central portion of the abutting edge 32*a* of the second operating piece 32. In addition, the opening-closing member-securing portion 36*b* for engaging the opening-closing member 40 protrudes from one end of the gap portion 36*a*. Furthermore, the opening-closing member-securing portion 38*b* for engaging the opening-closing member 40 protrudes from one end of the gap portion 38*a*.

The opening-closing member-securing portions 36*b* and 38*b* are configured so as to be separated in a direction of the line $X_1$ or $X_2$, the line $X_1$ connecting the base portion for securing the first binding ring 12 to the first operating piece 30, the line $X_2$ connecting the base portion for securing the second binding ring 14 to the second operating piece 32.

Both ends of the coil portion 44 are engaged with the opening-closing member-securing portions 36*b* and 38*b*, respectively, and the opening-closing member 40 is accommodated in the gap portions 36*a* and 38*a*.

Furthermore, the operating member 18 includes supporting portions 36*c* and 38*c* in order to support the end portions extending from both the ends of the coil portion 44 of the opening-closing member 40.

The securing end portions extending from both ends of the coil portion 44 of the opening-closing member 40 are engaged with and supported by the supporting portion 36*c* of the first operating piece 30 and the supporting portion 38*c* of the second operating piece 32, respectively.

More specifically, one securing end portion 42*a* is supported by the supporting portion 36*c* of the first operating piece 30 opposed to the second operating piece 32 provided with the opening-closing member-securing portion 38*b* engaging with the end of the coil portion 44. Furthermore, the other securing end portion 42*b* is supported by the supporting portion 38*c* of the second operating piece 32 opposed to the first operating piece 30 provided with the opening-closing member-securing portion 36*b*.

Each of the securing portions 46*a* and 46*b* has a constant length, and the intermediate portions 47*a* and 47*b* are engaged with the supporting portions 36*c* and 38*c*, respectively, of the operating member 18. Therefore, the securing end portions 42*a* and 42*b* keep the distance between the first and second operating pieces 30 and 32 constant, the first and second operating pieces 30 and 32 abutting against each other along the abutting edge 30*a* of the first operating piece 30 and the abutting edge 32*a* of the second operating piece 32. In addition, the securing end portions 42*a* and 42*b* bring the first and second operating pieces 30 and 32 close to each other to maintain an optimal state of the positional relationship between the first and second operating pieces 30 and 32.

Therefore, when the first and second binding rings 12 and 14 defining the binding rings are opened or closed, the first and second operating pieces 30 and 32 oscillate about the abutting edges 30*a* and 32*a* serving as a pivot. In this case, even when the sum of the width of the first operating piece 30 and the width of the second operating piece 32 reaches maximum value, i.e., even when the first and second operating pieces 30 and 32 are in a plane state (a neutral state), an appropriate gap is provided between the outermost edge of the first operating piece 30 and the holding wall 24*a* of the holding member 16 and between the outermost edge of the second operating piece 32 and the holding wall 24*b* of the holding member 16. In addition, the first and second operating pieces 30 and 32 of the operating member 18 can be smoothly moved in the holding space of the holding member 16.

In a state in which each of the first and second binding rings 12 and 14 is defined by combining the corresponding ring halves, the distance, in the longitudinal direction of the holding member 16, between both end portions of the opening-closing member 40 (the distance between the engaging end 48*a* of the securing end portion 42*a* and the engaging end 48*b* of the securing end portion 42*b*) is less than the distance between both the ends of the coil portion 44.

Furthermore, by moving the pair of the first and second operating pieces 30 and 32 oppositely in the longitudinal direction of the holding member 16, each of the first and second binding rings 12 and 14 defined by combining the corresponding ring halves is separated. When each of the first and second binding rings 12 and 14 is separated, both end portions of the opening-closing member 40 are brought into a state in which they are substantially parallel to each other in plan view, and the opening-closing member 40 urges the first and second operating pieces 30 and 32 to thereby release the ring halves 12*a* and 12*b* from each other and the ring halves 14*a* and 14*b* from each other.

The opening-closing member-securing portions 36*b* and 38*b* protrude toward the center of the gap portions 36*a* and 38*a*, respectively, so as to be aligned along the linear abutting edges 30*a* and 32*a*, respectively, and have a thickness and length suitable for being inserted into a through hole formed inside the coil portion 44 of the opening-closing member 40.

The supporting portions 36*c* and 38*c* are fine holes extending in the respective longitudinal directions of the first and second operating pieces 30 and 32, respectively, (an $O_1$ direction for the first operating piece 30 and an $O_2$ direction for the second operating piece 32 (see FIG. 7)). Furthermore, the supporting portions 36*c* and 38*c* are provided so as to be continuous with insertion holes 36*d* and 38*d*, respectively, for inserting the securing end portions 42*a* and 42*b* from one principal surface of the first and second operating pieces 30 and 32, respectively, toward the other principal surface.

The one securing end portion 42*a* is parallel to the other securing end portion 42*b* in an original state. However, the securing end portions 42*a* and 42*b* are extended in a direction obliquely intersecting the longitudinal direction of the first and second operating pieces 30 and 32, respectively. In other words, the securing end portions 42*a* and 42*b* are extended in a direction obliquely intersecting the line ($X_1$ shown in FIG. 7) connecting the portion for securing the ring half 12*a* and the portion for securing the ring half 14*a* each on the first operating piece 30 and in a direction obliquely intersecting the line ($X_2$ shown in FIG. 7) connecting the portion for securing the ring half 12*b* and the portion for securing the ring half 14*b* each on the second operating piece 32, respectively. Furthermore, when the opening-closing member 40 is in a closed state, the securing end portion 42*a* (in particular, the securing portion 46*a*) and the securing end portion 42*b* (in particular, the securing portion 46*b*), which are originally parallel and close to each other, are separated from each other. Thus, the securing end portion 42*a* is engaged with the second operating piece 32, and the securing end portion 42*b* is engaged with the first operating piece 30, whereby a twisted state is generated.

The securing end portion 42*a* is extended from the side of the gap portion 38*a* of the second operating piece 32 through the underside of the opening-closing member-securing portion 38*b* and reaches the topside of the supporting portion 36*c* from the underside of the first operating piece 30.

The securing end portion 42*b* is extended from the side of the gap portion 36*a* of the first operating piece 30 through the underside of the opening-closing member-securing portion 36*b* and reaches the topside of the supporting portion 38*c* from the underside of the second operating piece 32.

Therefore, the securing end portion 42*a* is easily attached to the first operating piece 30 and functions to rotate and open the first operating piece 30 with a strong force acting downwardly. Furthermore, the securing end portion 42*b* is easily attached to the second operating piece 32 and functions to rotate and open the second operating piece 32 with a strong force acting downwardly.

When the first and second binding rings 12 and 14 start being opened with a hand, i.e., when the binding ring-engaging portions 50 of each of the first and second binding rings 12 and 14 are disengaged, the elasticity of the opening-closing member 40 causes the first and second operating pieces 30 and 32 defining the operating member 18 to move in directions which cause the ring halves 12*a* and 12*b* of the first binding ring 12 to be separated from each other (the ring half 12*a* to move in the $O_1$ direction and the ring half 12*b* to move in the $O_2$ direction (see FIG. 7)) and which cause the ring halves 14*a* and 14*b* of the second binding ring 14 to be separated from each other (the ring half 14*a* to move in the $O_1$ direction and the ring half 14*b* to move in the $O_2$ direction (see FIG. 7)). At this time, the twisted opening-closing member 40 attempts to return to the original state and thus acts to separate the ring halves 12*a* and 12*b* and the ring halves 14*a* and 14*b* in the circumferential direction of the coil part 44 (an $O_3$ direction for ring halves 12*a* and 14*a* and an $O_4$ direction for the ring halves 12*b* and 14*b*).

That is, the elasticity of the opening-closing member 40 causes the first operating piece 30 to move in the direction for disengaging the binding ring-engaging portions 50 (the $O_1$ direction) and causes the second operating piece 32 to move in the direction for disengaging the binding ring-engaging portions 50 (the $O_2$ direction).

Then, the elasticity of the opening-closing member 40 gradually brings the first and second operating pieces 30 and 32 defining the operating member 18 from a V-shaped state to a planar state (a neutral state) and brings them from the planar state to an inverted V-shaped state.

In a state in which the first and second binding rings 12 and 14 are opened, the opening-closing member 40 acts to hold the abutting edge 30*a* of the first operating piece 30 and the abutting edge 32*a* of the second operating piece 32 in the inverted V-shaped state, i.e., in a state in which the abutting edges 30*a* and 32*a* are brought close to the inner surface of the bound object-mounting portion 22 of the holding member 16.

The bound object-mounting portion 22 of the holding member 16 includes a bulging portion 22*a* which extends in the longitudinal direction and is provided to prevent the engaging portions 30*d* and 32*e* from abutting against the inner surface of the bound object-mounting portion 22 when the engaging portions 30*d* and 32*e* rotate upwardly. Furthermore, the bound object-mounting portion 22 includes a bulging portion 22*b* which extends in the longitudinal direction and is provided to prevent the engaging portions 30*e* and 32*d* from abutting against the inner surface of the bound object-mounting portion 22 when the engaging portions 30*e* and 32*d* rotate upwardly.

Moreover, the bound object-mounting portion 22 of the holding member 16 includes a bulging portion 22*c* which extends in the longitudinal direction and is provided to prevent the opening-closing member 40 from abutting against the inner surface of the bound object-mounting portion 22 when the opening-closing member 40 moves upward.

The first binding ring 12 includes the ring halves 12*a* and 12*b* each having a semicircular arc shape so as to form a substantially annular shape, and the second binding ring 14 includes the ring halves 14*a* and 14*b* each having a semicircular arc shape so as to form a substantially annular shape. Furthermore, the binding ring-engaging portion 50 is provided at the end of the ring halves 12*a* and 12*b* and at the end of the ring halves 14*a* and 14*b*, i.e., at the top portion of each of the first and second binding rings 12 and 14, in order to allow sheets S to be bound by inserting the ring halves into binding holes provided in the sheets S in advance.

The ring halves 12*a* and 12*b* defining the first binding ring 12 are annularly engaged with each other by engaging the binding ring-engaging portion 50 of the ring half 12*a* with the binding ring-engaging portion 50 of the ring half 12*b*.

Furthermore, the ring halves 14*a* and 14*b* defining the second binding ring 14 are annularly engaged with each other by engaging the binding ring-engaging portion 50 of the ring half 14*a* with the binding ring-engaging portion 50 of the ring half 14*b*.

In this preferred embodiment, the ring halves 12*a* and 12*b* defining the first binding ring 12 and the ring halves 14*a* and 14*b* defining the second binding ring 14 have the same shape, i.e., the same curvature (radius of curvature).

Figure 17:
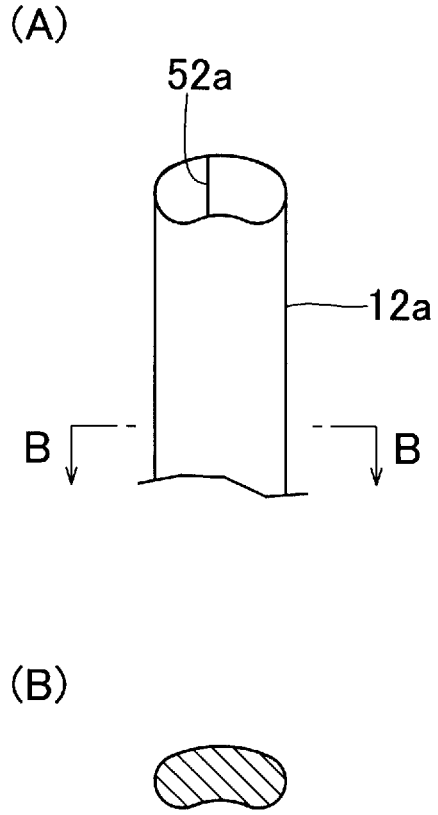
FIGS. 17(A) and 17(B) are schematic views illustrating the engaging portion of one of the binding rings, FIG. 17(A) being a schematic side view, and FIG. 17(B) being a schematic cross-sectional view taken along the line B-B in FIG. 17(A).
Figure 18:
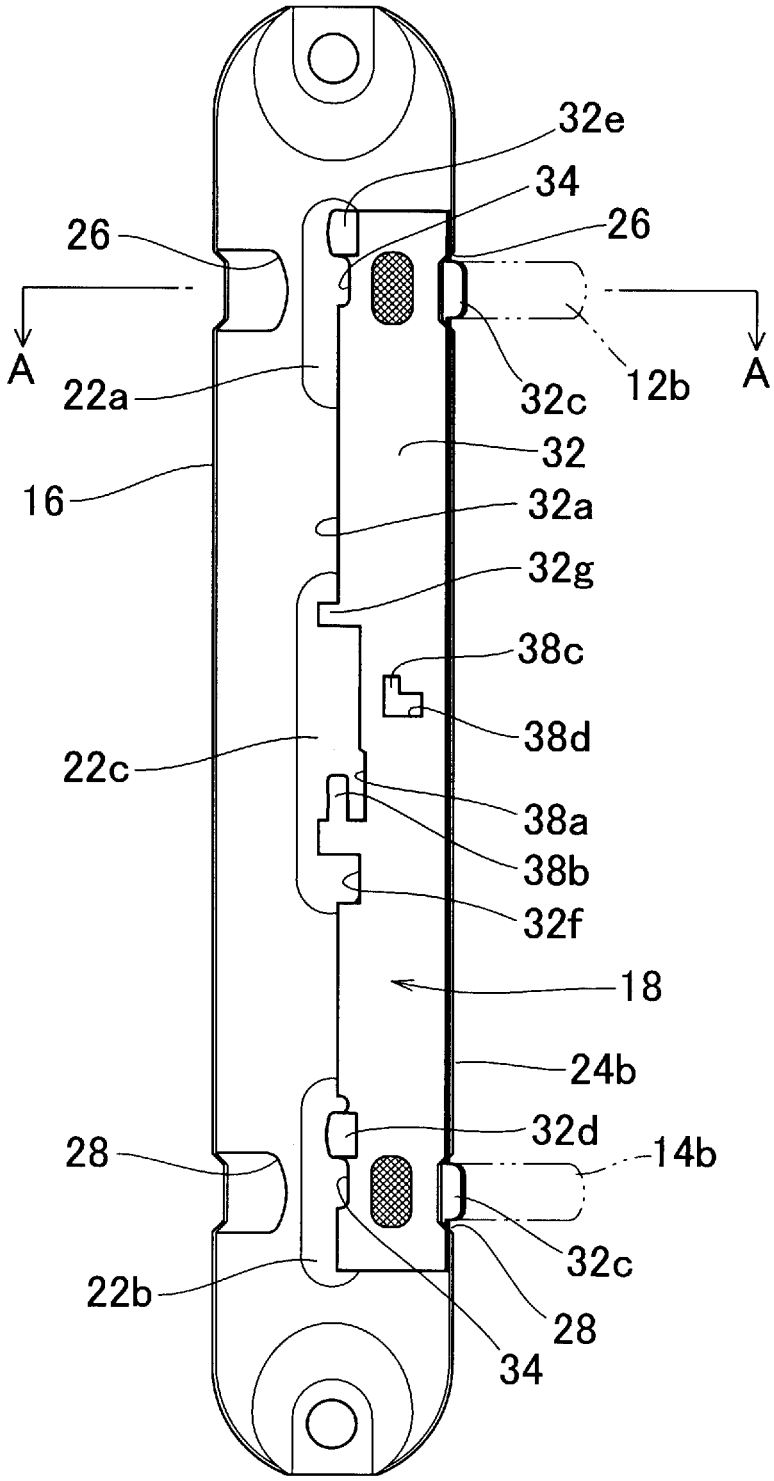
FIG. 18 is a bottom view illustrating the manner of attaching the operating member.
Figure 19:
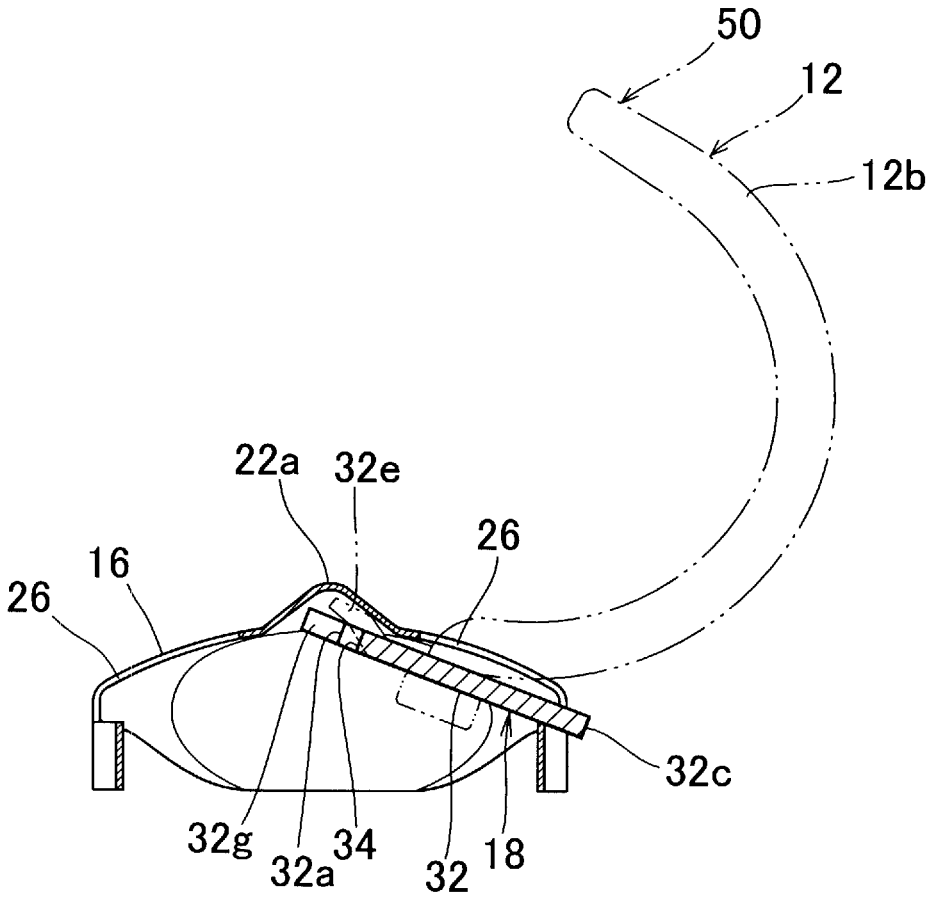
FIG. 19 is a cross-sectional side view illustrating the manner of attaching the operating member.

The first and second binding rings 12 and 14 defining the binding rings may be formed by widening a metal-made wire rod having a circular cross-section in a direction for disengaging the binding ring-engaging portions 50 ($O_1$ and $O_2$ directions of FIG. 12) and by pressing the central portion of the wire rod to bend in a direction for closing the binding rings, as shown in FIG. 17. Each of the first and second binding rings 12 and 14 shown in FIG. 17 is in a shape having a substantially bean-shaped cross-section. In the substantially bean-shaped cross-section, the central portion thereof protrudes in a direction for opening the binding ring (the $O_3$ direction in FIG. 7 for the ring halves 12*a* and 14*a* and the $O_4$ direction in FIG. 7 for the ring halves 12*b* and 14*b*), and the both edges thereof are bent in a direction for closing the binding ring.

Specifically, when the annular first and second binding rings 12 and 14 are viewed from the opening-closing direction, a wavy surface is provided on the inner side of the first and second binding rings 12 and 14, and the outer side of the first and second binding rings 12 and 14 is configured into a semicircular arc shape. Furthermore, as viewed from a direction for disengaging the binding rings, each of the first and second binding rings 12 and 14 has opposite outside edges formed into a semicircular arc shape.

Conventional binding rings having a circular cross-section do not resist deformation when the diameter is small. When the diameter is increased, the cross-sectional area increases which increases the cost for the material therefor. Furthermore, since binding holes formed in sheets are usually circular holes, conventional binding rings having a substantially rectangular cross-section are not well suited for the binding holes of the sheets and are likely to damage the binding holes of the sheets.

Meanwhile, when the first and second binding rings 12 and 14 defining the binding rings are thin, the binding ring-engaging portions 50 may not be securely fitted with each other.

Thus, it is desirable to increase the width of the first and second binding rings 12 and 14. However, even when a wire rod having a small cross-sectional area is used as a raw wire rod, it is desirable to ensure a required width for a binding ring by machining the raw metal-made wire rod.

Therefore, in the binding rings according to preferred embodiments of the present invention, the central portion of a wire rod for forming the binding rings is pressed to deform the wire rod into a bean-like shape, whereby the width as a whole is increased. That is, the binding rings are formed such that the entire width of the binding rings is increased in a direction for disengaging the binding ring-engaging portions 50, whereby the binding ring-engaging portions 50 can be completely engaged with each other.

The first and second binding rings 12 and 14 stand on the first and second operating pieces 30 and 32 so as to form a plane perpendicular to the plane $P_{xy}$, including the left-right axes $Y_1$ and $Y_2$ and the front-rear axes $X_1$ and $X_2$ (shown in FIG. 7) and passing portions on the first and second operating pieces 30 and 32, i.e., four portions to each of which one of the base portions of the first binding ring 12 or the second binding ring 14 is secured. Furthermore, in this configuration, a circular surface defined by an axis $Z_1$ (shown in FIG. 7) of the first binding ring 12 is parallel to a circular surface constituted by an axis $Z_2$ (shown in FIG. 7) of the second binding ring 14, and these circular surfaces are perpendicular to the plane $P_{xy}$ passing the portions at which the first and second binding rings 12 and 14 are secured to the first and second operating pieces 30 and 32.

Furthermore, the first and second binding rings 12 and 14 are configured such that binding ring-engaging portions 50 thereof can be disengaged in the same direction using fingers.

The binding ring-engaging portion 50 provided at the end of the ring half 12*a* defining the first binding ring 12 is defined by a projection 52*a* at the end portion of the binding ring-engaging portion 50 and a recess 52*b* following the projection 52*a*. Further, the binding ring-engaging portion 50 of the ring half 12*b* is defined by a projection 54*a* at the end of the binding ring-engaging portion 50 and a recess 54*b* following the projection 54*a*. The projections 52*a* and 54*a* and the recesses 52*b* and 54*b* are configured so as to be protruded or recessed in mutually opposite directions, so that they are engaged with each other when the first binding ring 12 is closed. Each of the projections 52*a* and 54*a* has an inclined edge extending from the end to the inside and is configured such that the first and second binding rings 12 and 14 are opened and closed in a sliding manner.

Moreover, the binding ring-engaging portion 50 provided at the end of the ring half 14*a* defining the second binding ring 14 is defined by a projection 56*a* and a recess 56*b* following the projection 56*a*. Further, the binding ring-engaging portion 50 of the ring half 14*b* is defined by a projection 58*a* at the end of the binding ring-engaging portion 50 and a recess 58*b* following the projection 58*a* at the end. The projections 56*a* and 58*a* and the recesses 56*b* and 58*b* are formed so as to be protruded or recessed in mutually opposite directions, so that they are engaged with each other when the second binding ring 14 is closed.

The projection 52*a* defining the binding ring-engaging portion 50 of the ring half 12*a* and the projection 56*a* defining the binding ring-engaging portion 50 of the ring half 14*a* are configured so as to protrude in the same direction.

Further, the recess 54*b* defining the binding ring-engaging portion 50 of the ring half 12*b* and the recess 58*b* defining the binding ring-engaging portion 50 of the ring half 14*b* are configured so as to be recessed in the same direction.

When the binding ring-engaging portions 50 of the first binding ring 12 are disengaged by twisting the top portion of the first binding ring 12 with fingers, the restoring force of the opening-closing member 40 is exerted on the first and second operating pieces 30 and 32, and thus the first binding ring 12 is opened. Here, the restoring force of the opening-closing member 40 is a force for restoring the one securing end portion 42*a* and the other securing end portion 42*b* to the original state in which they are parallel to each other along the circumferential direction of the coil part 44 as shown in FIG. 6(A).

Figure 20:
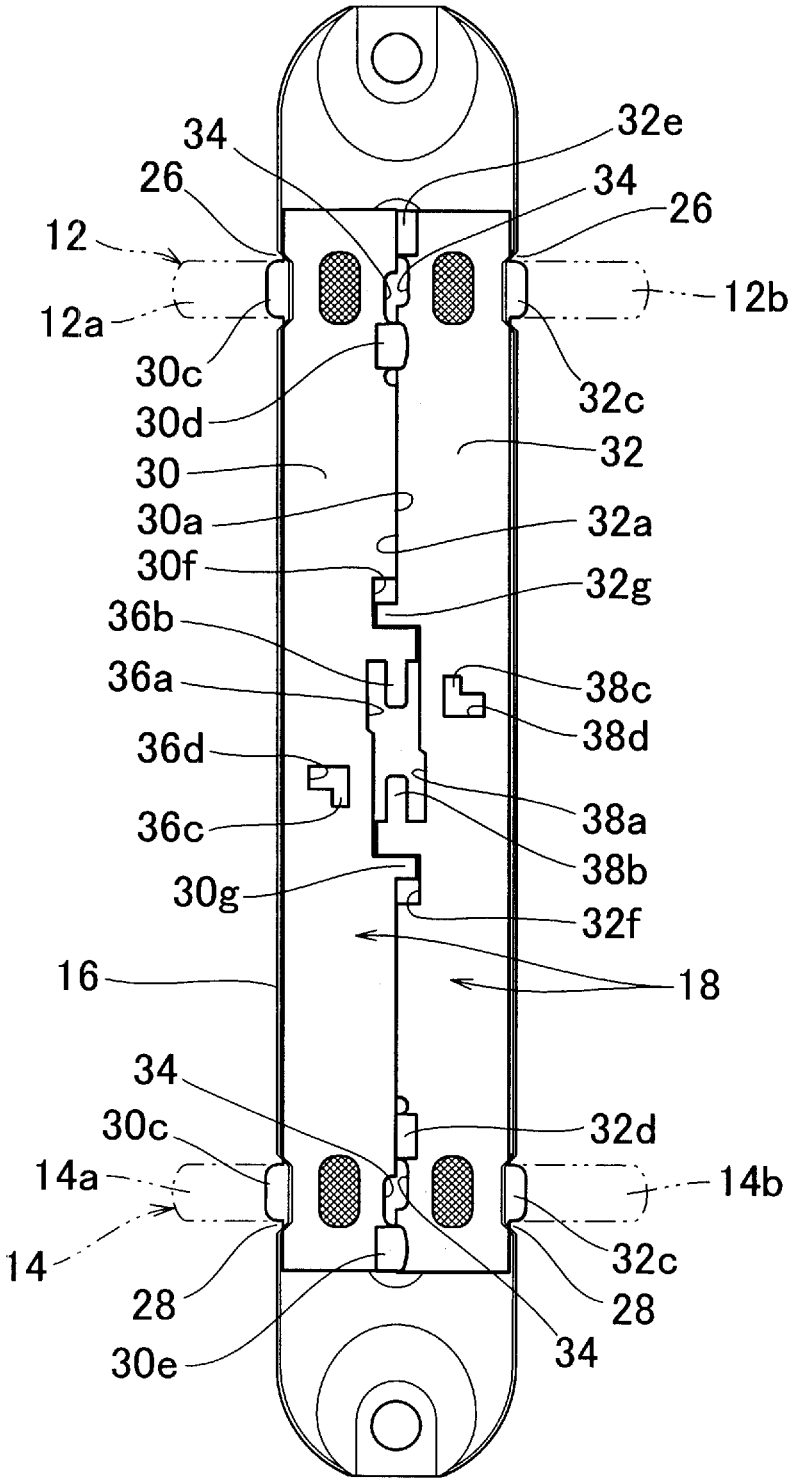
FIG. 20 is a bottom view illustrating the manner of attaching the operating member.
Figure 21:
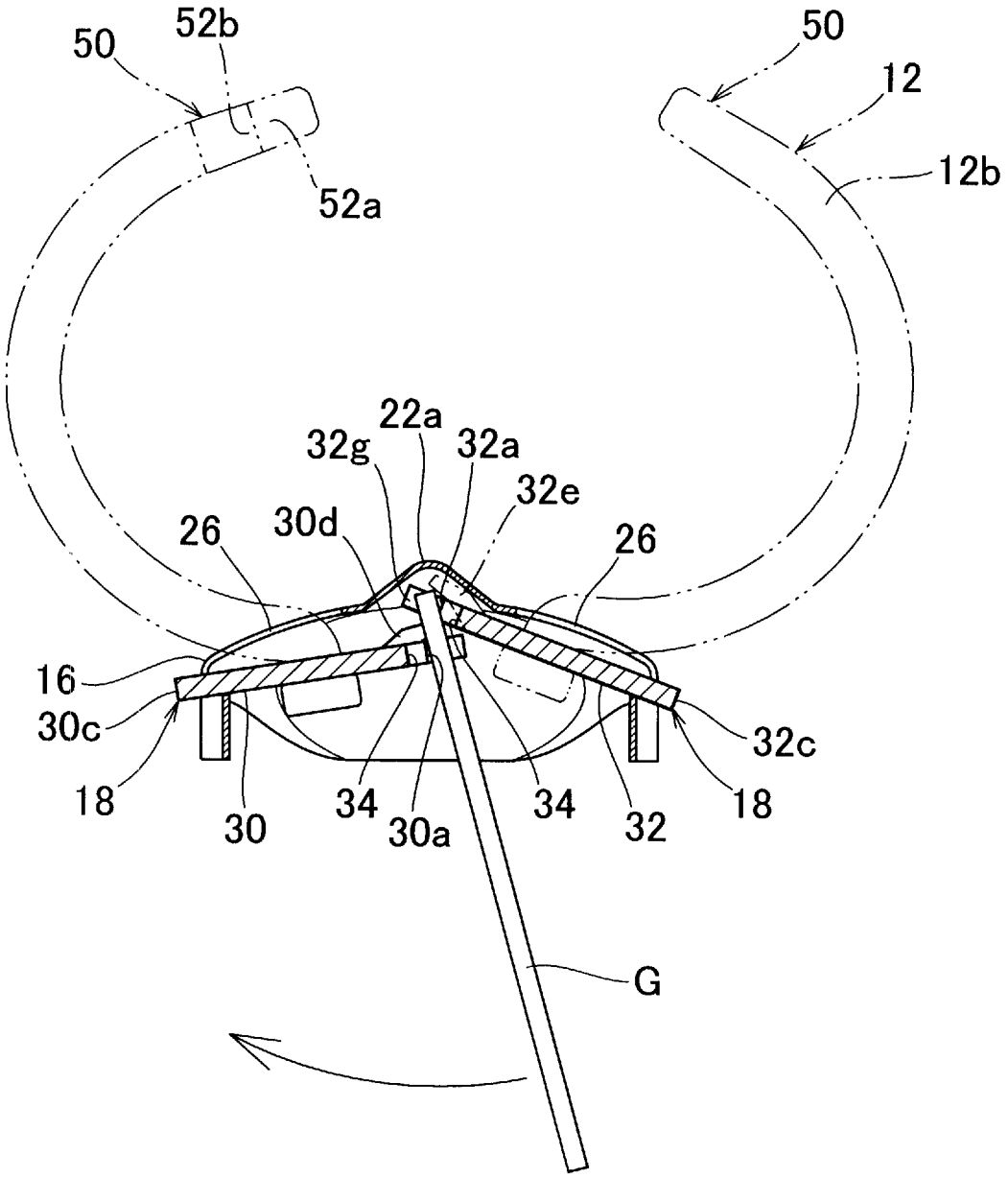
FIG. 21 is a schematic cross-sectional side view illustrating the manner of attaching operating pieces.
Figure 22:
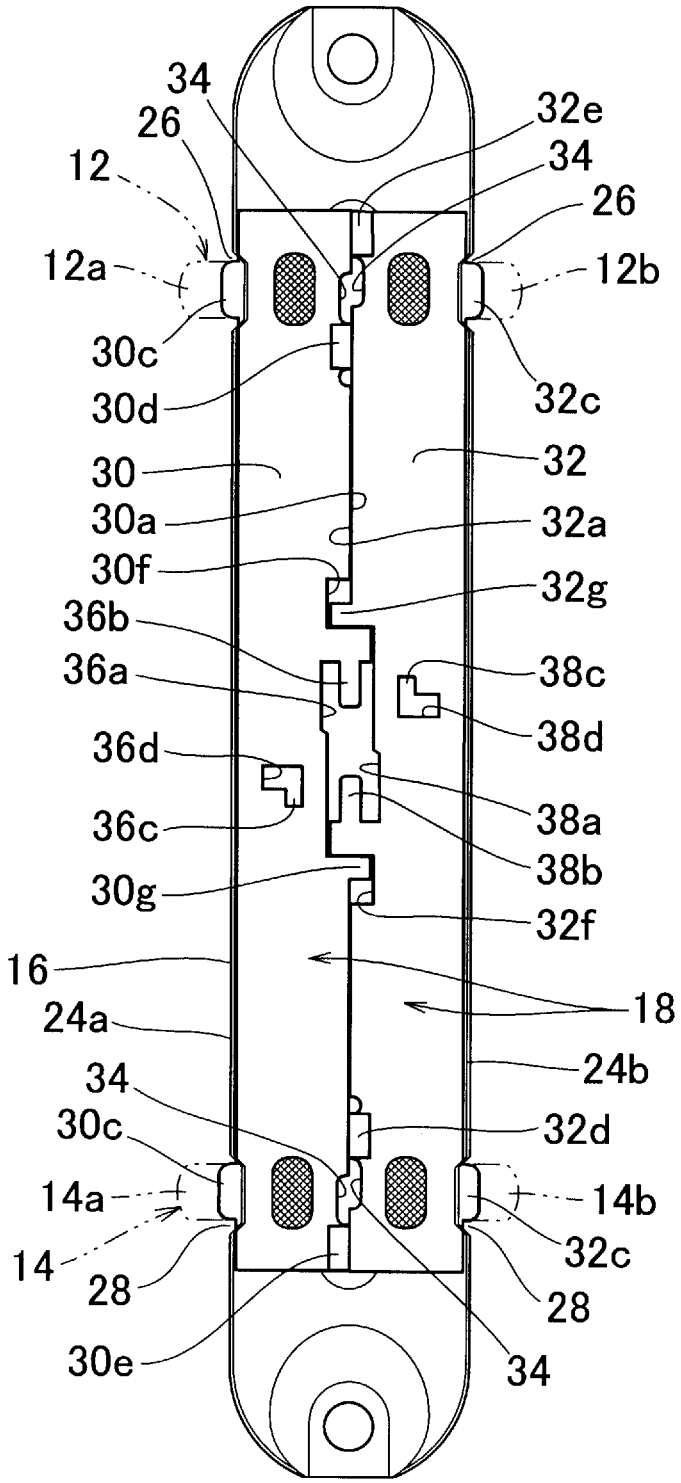
FIG. 22 is a bottom view illustrating the manner of attaching the operating pieces.
Figure 23:
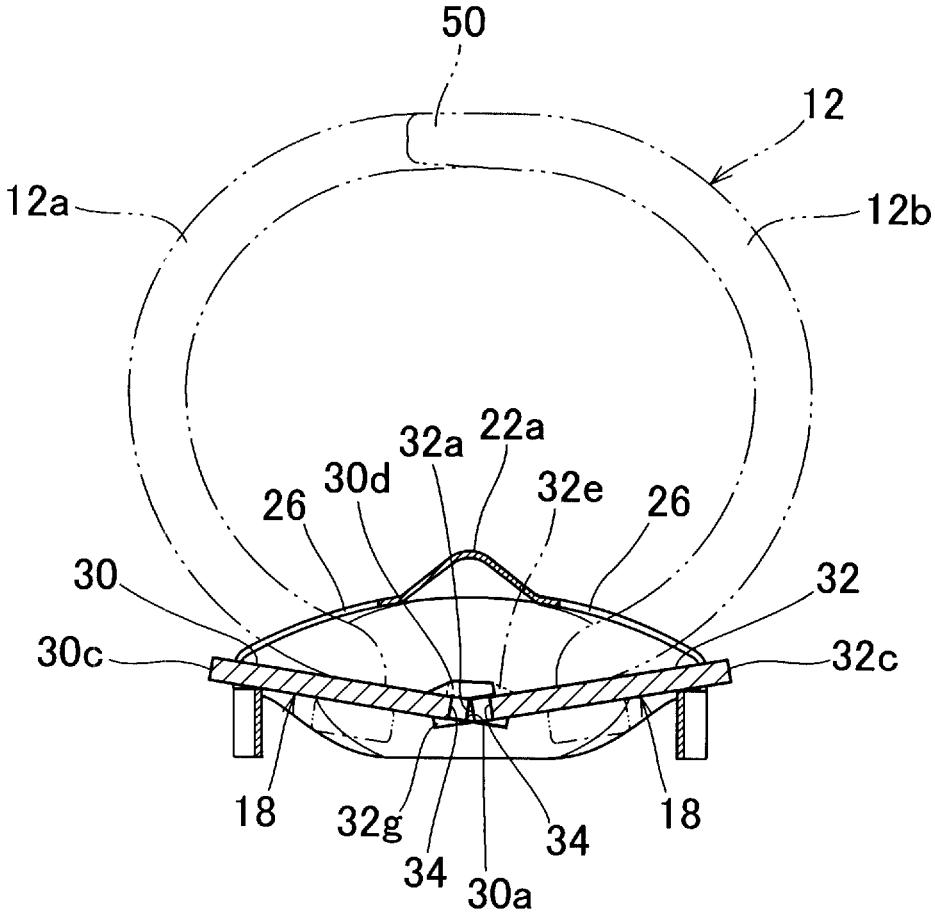
FIG. 23 is a cross-sectional side view illustrating the manner of attaching the operating pieces.

Then, the binding ring-engaging portions 50 of the first and second binding rings 12 and 14 are disengaged (see FIG. 11), and the V-shaped state of the first and second operating pieces 30 and 32 is gradually changed to the planar state (neutral state), and the planar state is changed to the inverted V-shaped state. At this time, the first and second operating pieces 30 and 32 are moved in the respective directions for disengaging the binding ring-engaging portions 50 (the $O_1$ direction for the first operating piece 30 and the $O_2$ direction for the second operating piece 32). Thus, the restricting projection 30*g* of the first operating piece 30 defining the movement restricting portion is moved inside the restricting recess 32*f* of the second operating piece 32 and abuts on an edge of the restricting recess 32*f*, the edge being on the side opposite to the direction for disengaging the binding ring-engaging portions 50. In addition, the restricting projection 32*g* of the second operating piece 32 defining the movement restricting portion is moved inside the restricting recess 30*f* of the first operating piece 30 and abuts on an edge of the restricting recess 30*f*, the edge being on the side opposite to the direction for disengaging the binding ring-engaging portions 50 (see FIG. 20).

Figure 14:
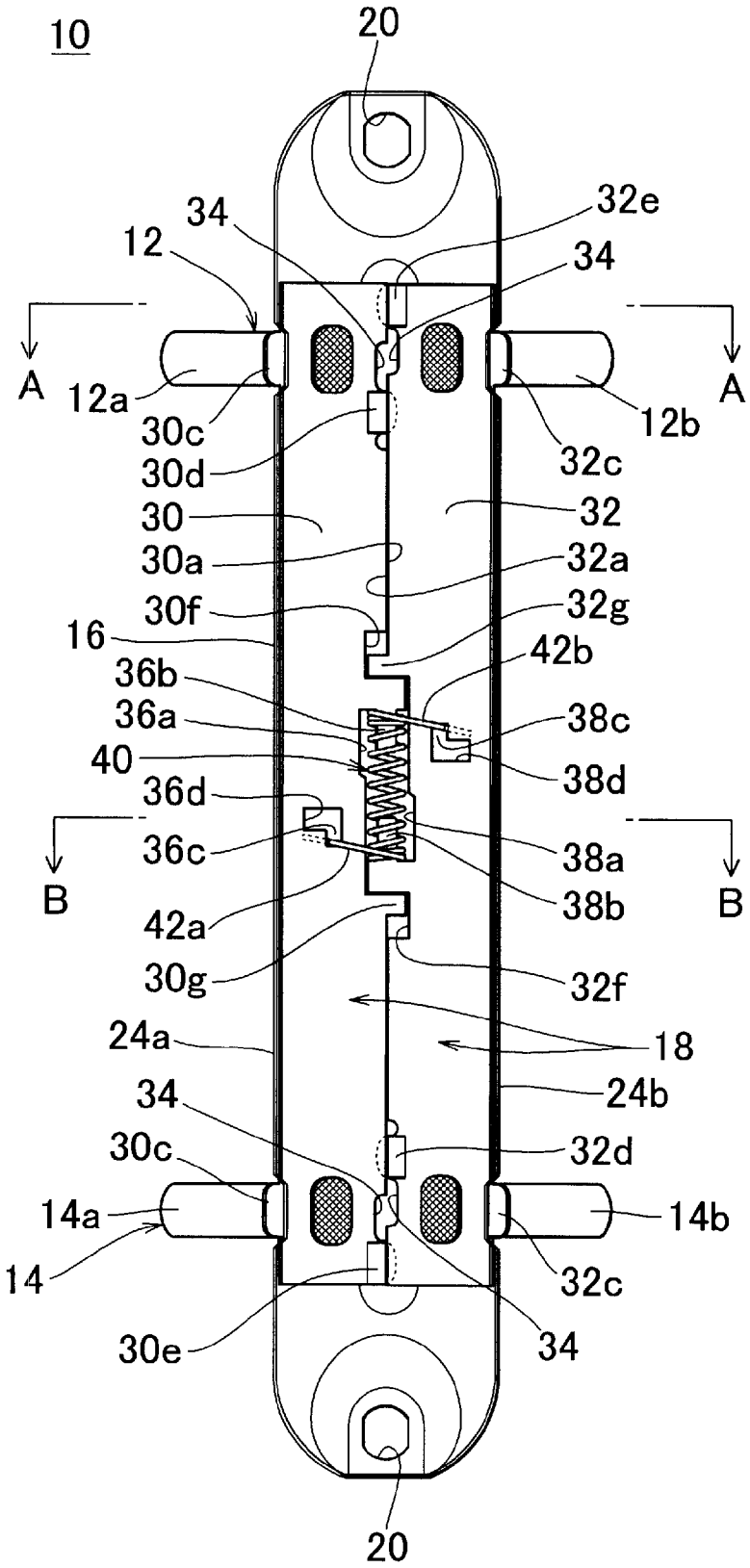
FIG. 14 is a bottom view of the binding device in the opened state.

When the hand is removed from the first binding ring 12, a force is exerted on the first and second operating pieces 30 and 32, for restoring the one securing end portion 42*a* and the other securing end portion 42*b* of the opening-closing member 40 to the original state in which they are parallel to each other along the circumferential direction of the coil part 44 as shown in FIG. 6(A). Therefore, the first and second binding rings 12 and 14 are opened further (the ring halves 12*a* and 14*a* are opened in the $O_3$ direction and the ring halves 12*b* and 14*b* are opened in the $O_4$ direction). In addition, a force for arranging the one securing end portion 42*a* and the other securing end portion 42*b* of the opening-closing member 40 in parallel to each other in plan view is exerted to cause the first and second operating pieces 30 and 32 to move in directions opposite to each other (see FIG. 14).

Specifically, the operating member 18 and the opening-closing member 40 exert an action in the direction for opening the projection 56*a* of the ring half 14*a* and the projection 58*a* of the ring half 14*b* defining the second binding ring 14, and an action in the direction for separating the projection 52*a* of the ring half 12*a* of the first binding ring 12 from the projection 54*a* of the ring half 12*b*. In addition, the operating member 18 and the opening-closing member 40 works such that the projection 56*a* of the ring half 14*a* and the projection 58*a* of the ring half 14*b* defining the second binding ring 14 are separated from each other.

As described above, in this preferred embodiment, by twisting the top portion of the first binding ring 12 or the second binding ring 14 with fingers, the binding ring-engaging portions 50 of the ring halves 12*a* and 12*b* of the first binding ring 12 can be disengaged, and the binding ring-engaging portions 50 of the ring halves 14*a* and 14*b* of the second binding ring 14 can also be disengaged.

When the engagement between the binding ring-engaging portions 50 of the ring halves 12*a* and 12*b* of the first binding ring 12 and the engagement between the binding ring-engaging portions 50 of the ring halves 14*a* and 14*b* of the second binding ring 14 are released, a force is exerted which urges the one securing end portion 42*a* and the other securing end portion 42*b* to come close to each other in the circumferential direction. Therefore, the abutting edge 30*a* of the first operating piece 30 and the abutting edge 32*a* of the second operating piece 32 are brought into an inverted V-shaped state.

Next, a method for mounting the operating member 18 in the holding space of the holding member 16 is described with reference to FIGS. 18 to 23.

First, the first operating piece 30 is mounted in the holding member 16, and then the second operating piece is mounted in the holding member 16. At this time, one of the protruding portions 30*c* passes through one of the first through holes 26 (the right through hole 26 in a plan view of the left-right pair of the through holes 26), and one of the protruding portions 32*c* passes through one of the second through holes 28 (the right through hole 28 in a plan view of the left-right pair of the through holes 28). The engaging portions 30*d* and 30*e* and the engaging portions 32*d* and 32*e* are positioned on the lower side of the first and second operating pieces 30 and 32, respectively, i.e., on a side opposite to the bound object-mounting portion 22 of the holding member 16 of the bound object-mounting portion 22.

Then, the rod-like jig G is pressed into the gap between the clearance portion 34 of the first operating piece and the clearance portion 34 of the second operating piece to increase the distance between the first and second operating pieces 30 and 32, and the engaging portions 30*d* and 30*e* and the engaging portions 32*d* and 32*e* are put onto the upper side of the first and second operating pieces 30 and 32, respectively, i.e., on the bound object-mounting portion 22 side of the holding member 16. Thereafter, the rod-like jig G is pulled out, whereby the abutting edges 30*a* and 32*a* are abutted against each other.

Figure 24:
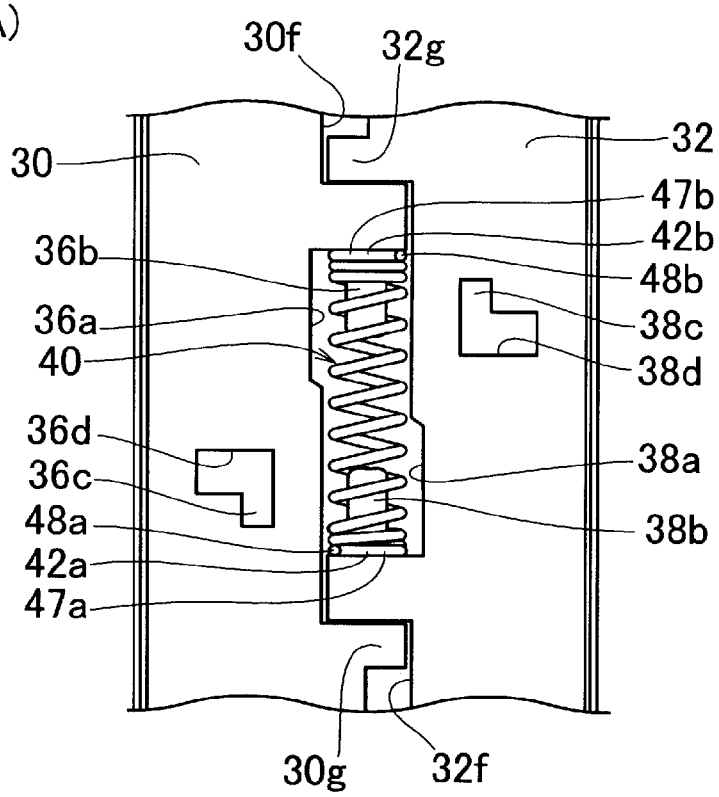
FIGS. 24(A) and 24(B) are a set of schematic bottom views illustrating the manner of attaching the opening-closing member.
Figure 24:
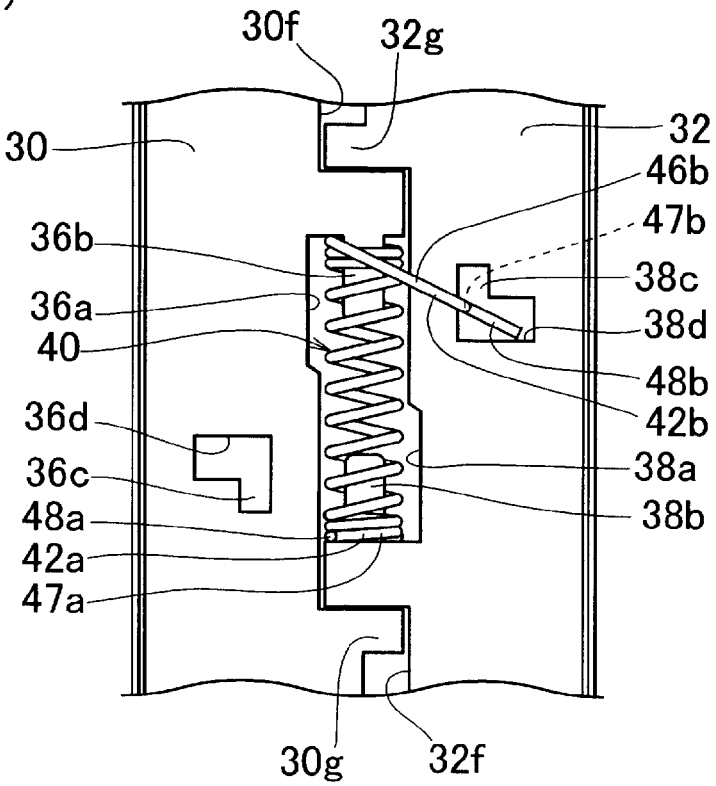
Figure 25:
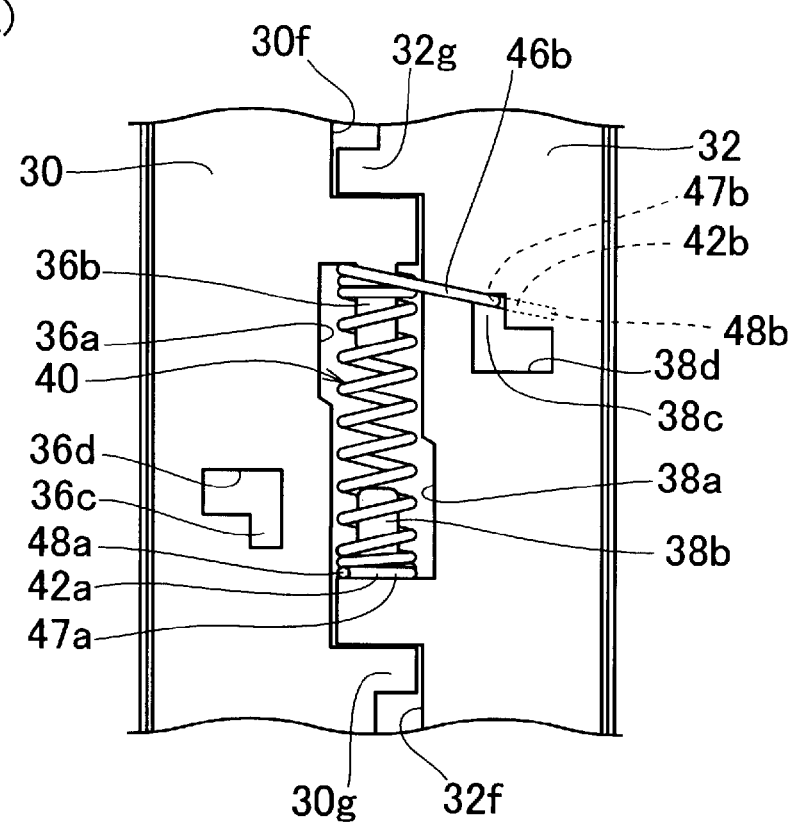
FIGS. 25(A) and 25(B) are a set of schematic bottom views illustrating the manner of attaching the opening-closing member.
Figure 25:
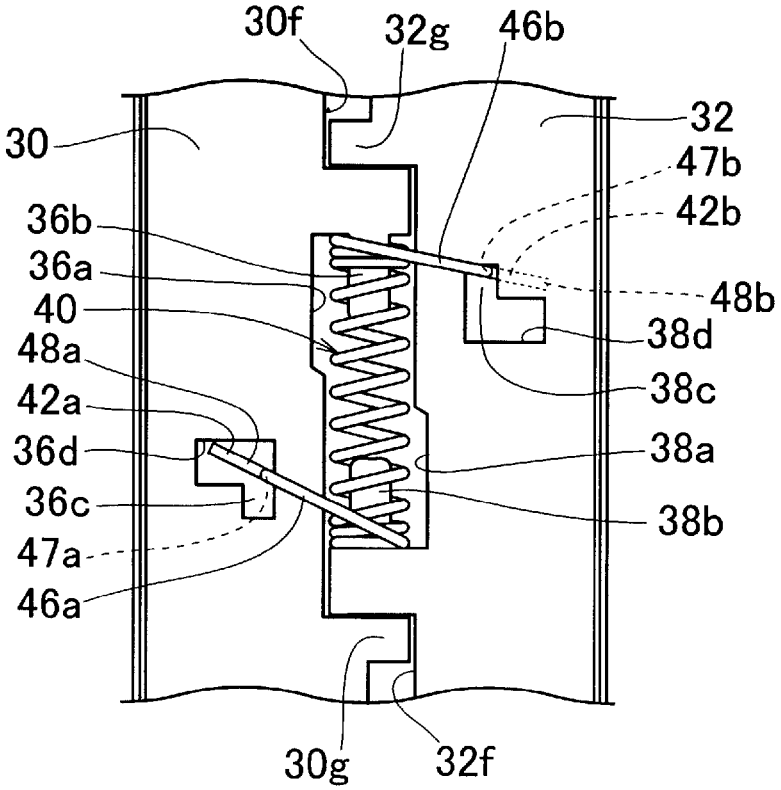
Figure 26:
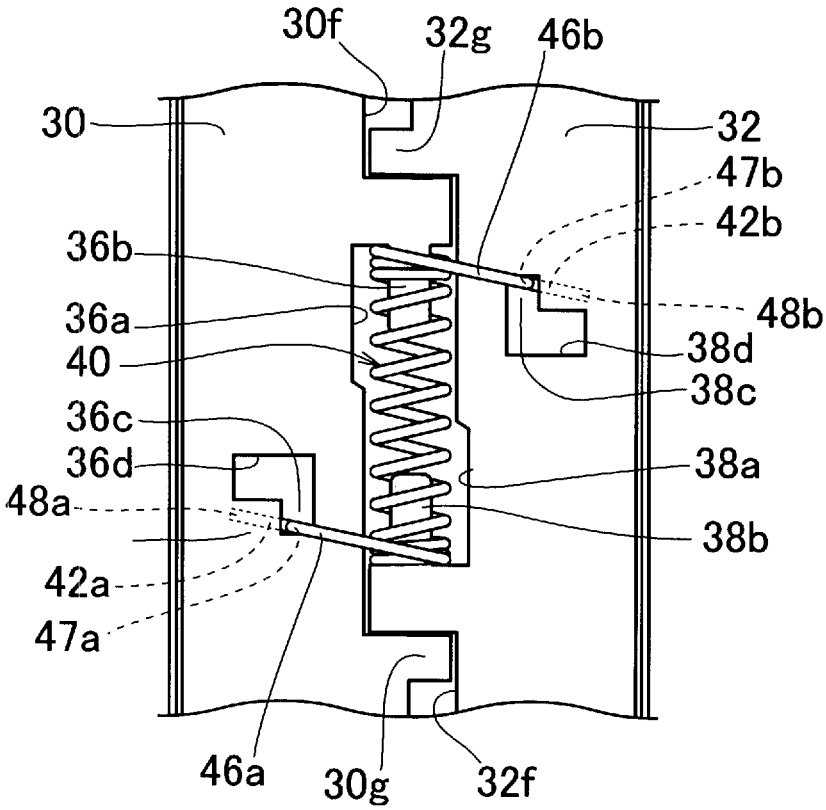
FIG. 26 is a bottom view illustrating the manner of attaching the opening-closing member.
Figure 27:
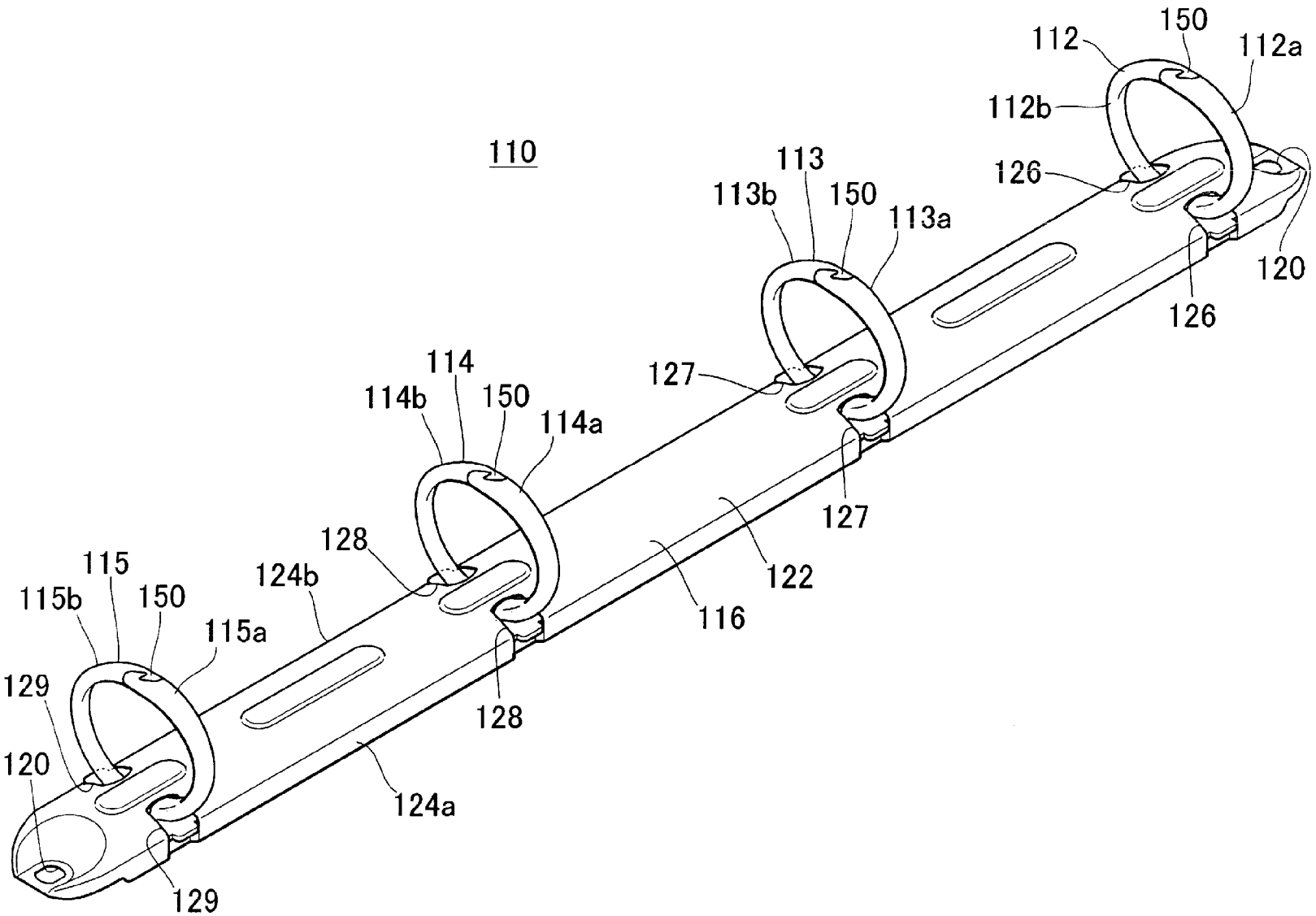
FIG. 27 is a perspective view illustrating an example of a binding device of another preferred embodiment.
Figure 28:
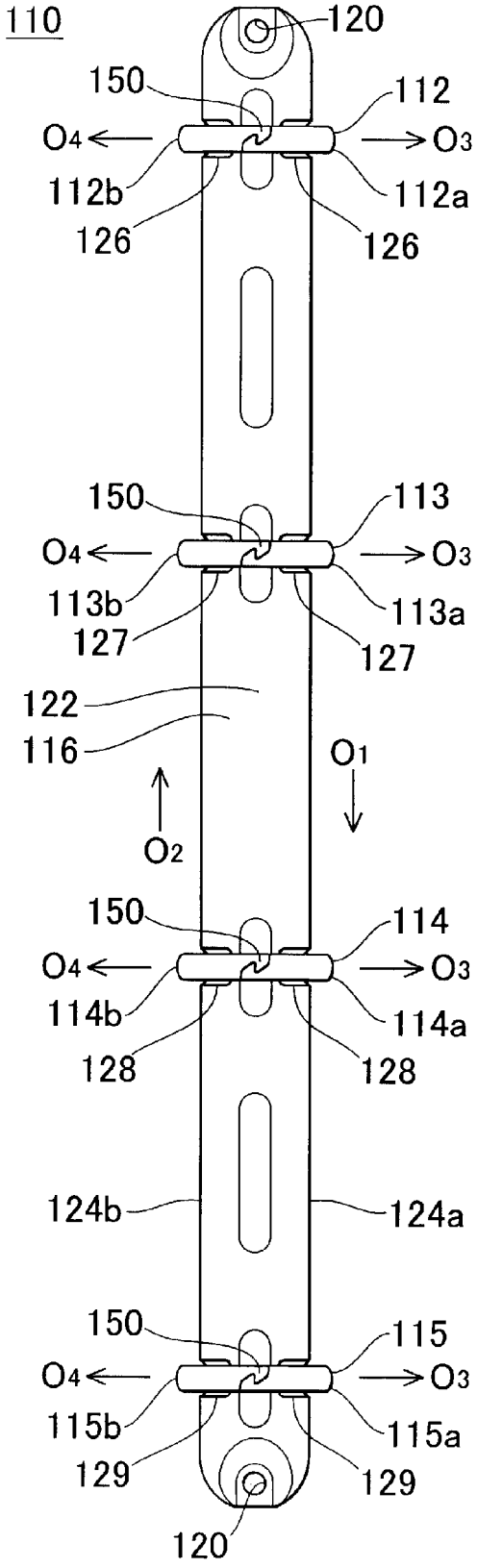
FIG. 28 is a plan view illustrating the example of the binding device of the another preferred embodiment.
Figure 29:
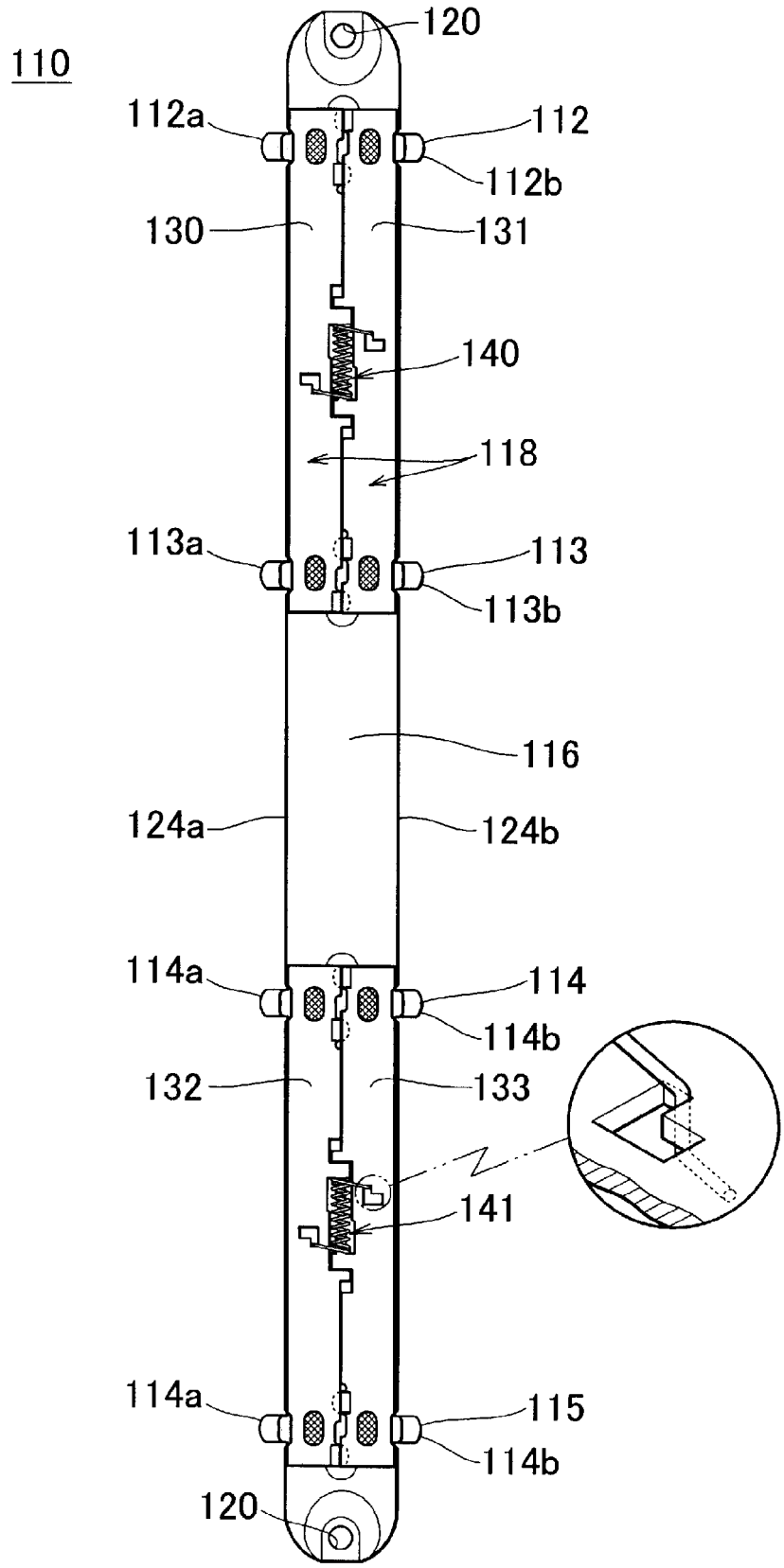
FIG. 29 is a bottom view illustrating the example of the binding device of the another preferred embodiment.
Figure 30:
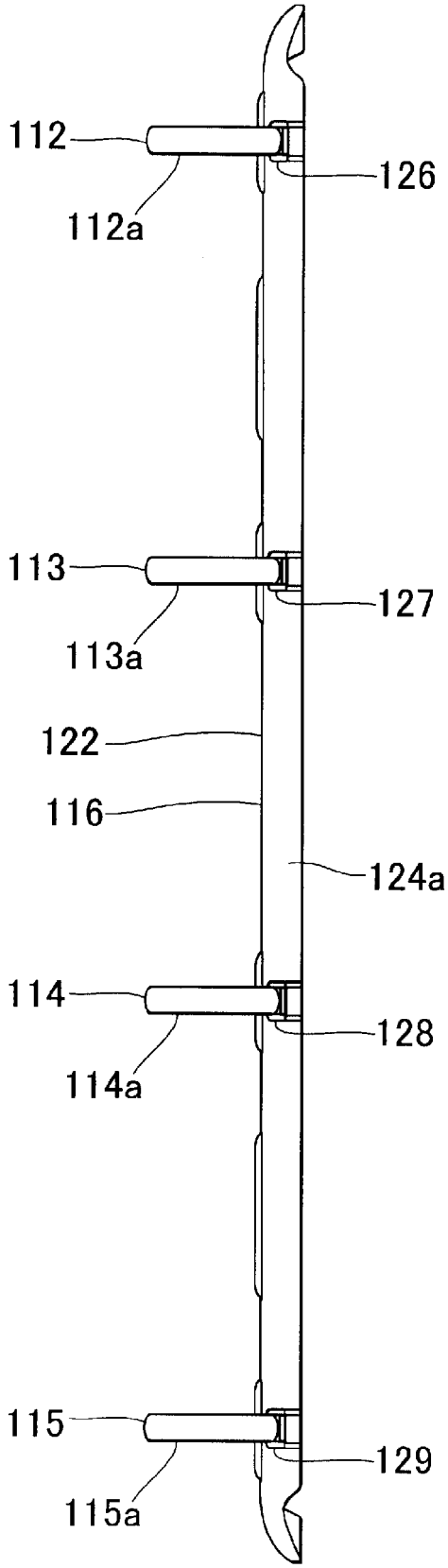
FIG. 30 is a side view illustrating the example of the binding device of the another preferred embodiment.

Next, a method for mounting the opening-closing member 40 to the operating member 18 is described with reference to FIGS. 24 to 26.

The side from which the securing end portions 42*a* and 42*b* extend is directed to the lower side, i.e., the side opposite to the bound object-mounting portion 22 of the holding member 16. The opening-closing member-securing portions 36*b* and 38*b* are inserted into the through hole of the coil portion 44, and the opening-closing member 40 is mounted between the gap portions 36*a* and 38*a*.

L-shaped supporting portions (the intermediate portion 47*a* and the engaging end 48*a*) of the securing end portion 42*a*, which are disposed on the first operating piece 30 side, are inserted into the insertion hole 36*d* of the first operating piece 30, and are displaced slightly to engage with the supporting portion 36*c*.

Furthermore, L-shaped supporting portions (the intermediate portion 47*b* and the engaging end 48*b*) of the securing end portion 42*b* are disposed on the second operating piece 32 side, are inserted into the insertion hole 38*d* of the second operating piece 32, and are displaced slightly to engage with the supporting portion 38*c*.

The binding device 10 may be attached to the cover A using bolts with nuts through the attaching holes 20 with the lower edges of the holding walls 24*a* and 24*b* joined to the cover A.

Furthermore, in the above preferred embodiment, a description has been provided of a two-hole type binding device having two holes such as the first and second binding rings 12 and 14. However, a binding device may be any multi-hole type binding device having more binding rings, such as 3-, 4-, 20-, 26-, or 30-hole type binding device.

Next, another preferred embodiment according to the present invention is described with reference to FIGS. 27 to 30.

A binding device 110 of this preferred embodiment has a configuration substantially the same as the configuration of the binding device 10 of the preferred embodiment described above. However, the configuration of the holding member, the configuration of the operating member, and the configuration of the opening-closing member are different since the number of binding rings is increased. Therefore, a description is primarily provided of these differences.

The binding device 110 includes a pair of substantially annular first and second binding rings 112 and 113 and a pair of substantially annular third and fourth binding rings 114 and 115, each of which is made of metal, a holding member 116 having a length which allows the first and fourth binding rings 112 and 115 to be disposed with a spacing therebetween, and an operating member 118 having a surface to which the base portions of each of the first and fourth binding rings 112 and 115 are secured with a spacing therebetween, the operating member 118 being movably secured inside the holding member 116 such that the first to fourth binding rings 112 to 115 are secured to the holding member 116.

The binding rings are of a four-hole type and include four binding rings, i.e., the first to fourth binding rings 112 to 115. The first binding ring 112 is provided with ring halves 112*a* and 112*b*, and the second binding ring 113 is provided with ring halves 113*a* and 113*b*. The third binding ring 114 is provided with ring halves 114*a* and 114*b*, and the fourth binding ring 115 is provided with ring halves 115*a* and 115*b*.

A binding ring-engaging portion 150 is provided at the end of the ring halves 112*a* and 112*b*, at the end of the ring halves 113*a* and 113*b*, and at the end of the ring halves 114*a* and 114*b*, and at the ring halves 115*a* and 115*b*, i.e., at the top portion of each of the first to fourth binding rings 112 to 115, in order to allow sheets S to be bound by inserting the ring halves into binding holes provided in the sheets S in advance.

The ring halves 112*a* and 112*b* defining the first binding ring 112 are annularly engaged with each other by engaging the binding ring-engaging portion 150 of the ring half 112*a* with the binding ring-engaging portion 150 of the ring half 112*b*.

Furthermore, the ring halves 114*a* and 114*b* defining the third binding ring 114 are annularly engaged with each other by engaging the binding ring-engaging portion 150 of the ring half 114*a* with the binding ring-engaging portion 150 of the ring half 114*b*.

The first to fourth binding rings 112 to 115 defining the binding rings are formed by widening a metal-made wire rod having a circular cross-section in a direction for disengaging the binding ring-engaging portions 150 ($O_1$ and $O_2$ directions of FIG. 28) and pressing the central portion of the wire rod to be bent in a direction for closing the binding rings. The first to fourth binding rings 112 to 115 are formed into a shape having a substantially bean-shaped cross-section. In the substantially bean-shaped cross-section, the central portion thereof protrudes in a direction for opening the binding ring (the $O_3$ direction in FIG. 28 for the ring halves 112*a* to 115*a* and the $O_4$ direction in FIG. 28 for the ring halves 112*b* to 115*b*), and the both edges thereof are bent in a direction for closing the binding ring.

Specifically, when the annular first to fourth binding rings 112 to 115 are viewed from the opening-closing direction, a wavy surface is provided on the inner side of the first to fourth binding rings 112 to 115, and the outer side of the first to fourth binding rings 112 to 115 has a semicircular arc shape. Furthermore, as viewed from a direction for disengaging the binding rings, each of the first to fourth binding rings 112 to 115 has opposite outside edges having a semicircular arc shape.

Conventional binding rings having a circular cross-section do not resist deformation when the diameter is small. When the diameter is increased, the cross-sectional area increases which increases the cost for the material therefor. Since binding holes provided in sheets are usually circular holes, conventional binding rings having a substantially rectangular cross-section are not well suited for the binding holes of sheets and are likely to damage the binding holes of the sheets.

Meanwhile, when the first to fourth binding rings 112 to 115 defining the binding rings are thin, the binding ring-engaging portions 150 may not be securely fitted with each other.

Thus, it is desirable to increase the width of the first to fourth binding rings 112 to 115. However, even when a wire rod having a small cross-sectional area is used as a raw wire rod, it is desirable to ensure a required width for a binding ring by machining the raw metal-made wire rod.

Therefore, in the binding rings according to the present invention, the central portion of a wire rod for forming the binding rings is pressed to deform the wire rod into a bean-like shape, whereby the width as a whole is increased. That is, the binding rings are formed such that the entire width of the binding rings is increased in a direction for disengaging the binding ring-engaging portions 150, whereby the binding ring-engaging portions 150 can be completely and securely engaged with each other.

The holding member 116 has a substantially rectangular shape in plan view having a length which allows the first to fourth binding rings 112 to 115 to be disposed with a predetermined spacing therebetween. Furthermore, both of the end portions of the holding member 116, or portions in the vicinity of an attaching hole 120 for attaching the holding member 116 to a cover A, have a substantially semicircular arc shape in plan view.

The holding member 116 is configured to have a holding space inside a bound object-mounting portion 122, and the operating member 118 and other elements are contained in the holding space.

Along both edges of the bound object-mounting portion 122 of the holding member 116, holding walls are provided, each of which extends in the longitudinal direction of the bound object-mounting portion 122 substantially from one end of the bound object-mounting portion 122 to the other end and slidably holds the operating member 118. In this preferred embodiment, holding walls 124*a* and 124*b* are provided consecutively so as to hang down from substantially entire portions extending, in the longitudinal direction of the holding member 116, inwardly between the vicinities outside the first to fourth binding rings 112 to 115. Furthermore, the holding walls 124*a* and 124*b* are arranged substantially in parallel with each other and have substantially the same plate-like shape. The operating member 118 to be described in detail later is contained in the holding space surrounded by the holding walls 124*a* and 124*b* and the bound object-mounting portion 122.

The bound object-mounting portion 122 of the holding member 116 is provided with first and second through holes 126 and 127 which allow the first and second binding rings 112 and 113, respectively, to loosely pass therethrough with a predetermined distance (a predetermined length defined by Japanese Industrial Standards or the like) between the first and second binding rings 112 and 113. In addition, the bound object-mounting portion 122 of the holding member 116 is also provided with third and fourth through holes 128 and 129 which allow the third and fourth binding rings 114 and 115, respectively, to loosely pass therethrough with a predetermined distance (a predetermined length defined by Japanese Industrial Standards or the like) between the third and fourth binding rings 114 and 115.

Each of the first to fourth through holes 126 to 129 is provided in two portions, i.e., left and right portions which are separated by a predetermined distance in the width direction of the holding member 116 so as to conform to the ring halves constituting the respective binding rings.

In contrast to the operating pieces of the binding device of the above preferred embodiments, the operating pieces defining the operating member 118 have two pairs of operating pieces.

A first operating piece 130 and a second operating piece 131 are configured similarly to the first and second operating pieces 30 and 32, respectively, of the preferred embodiment described above, the base portion of each of the ring halves 112*a* and 113*a* being secured to the first operating piece 130, the base portion of each of the ring halves 112*b* and 113*b* being secured to the second operating piece 131. Furthermore, a third operating piece 132 and a fourth operating piece 133 are configured similarly to the first and second operating pieces 30 and 32, respectively, of the preferred embodiment described above, the base portion of each of the ring halves 114*a* and 115*a* being secured to the third operating piece 132, the base portion of each of the ring halves 114*b* and 115*b* being secured to the fourth operating piece 133.

In the binding devices of the preferred embodiments described above, one opening-closing member is mounted on one pair of the operating pieces. However, in the binding device of this preferred embodiment, one opening-closing member is mounted on each of the two pairs of operating pieces, and thus two opening-closing members, i.e., opening-closing members 140 and 141, are provided.

Next, a description is given of a binding device of another preferred embodiment different from the above preferred embodiment.

Figure 31:
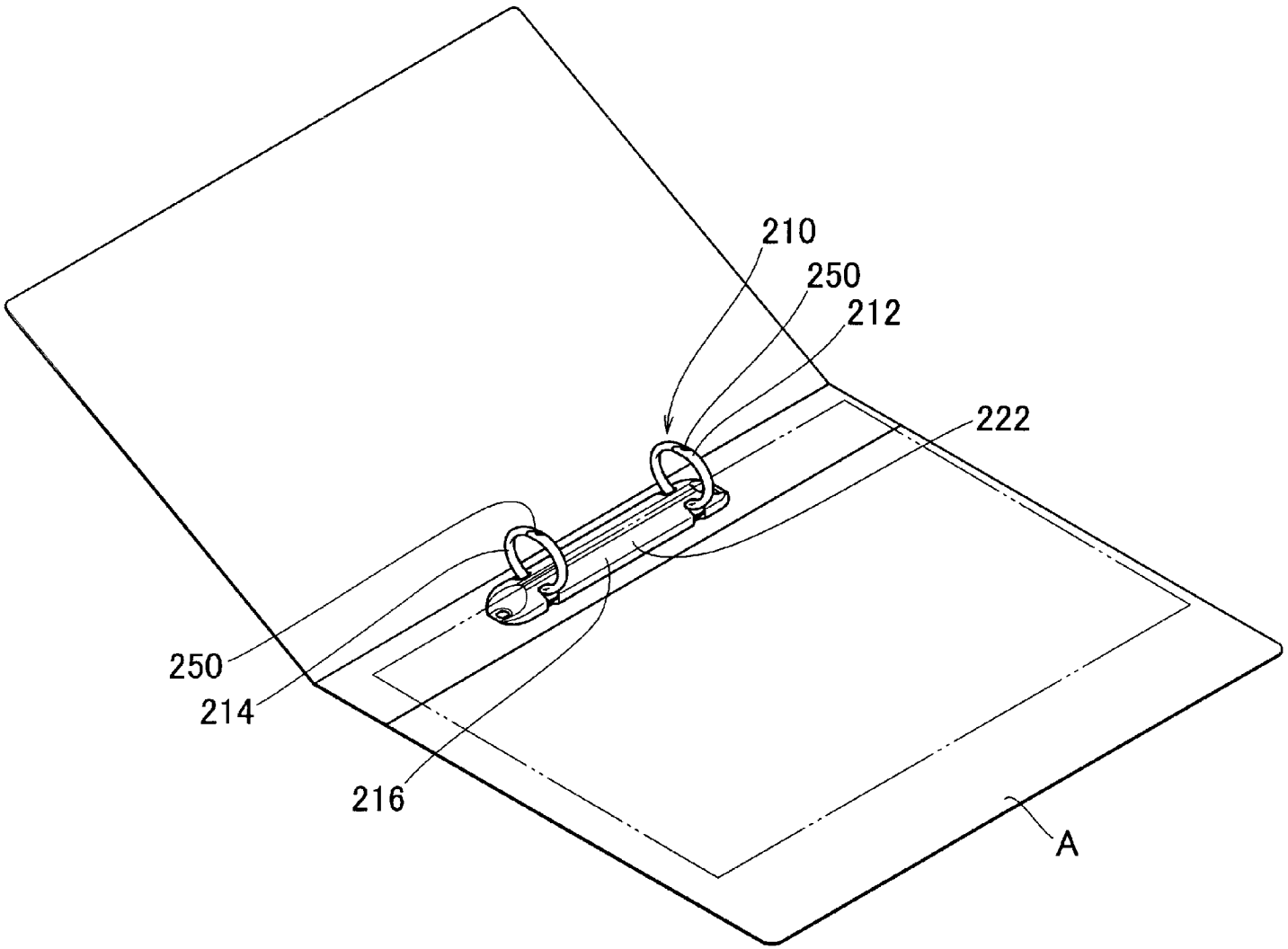
FIG. 31 is a perspective view illustrating a file with a binding device of yet another preferred embodiment according to the present invention, the binding device being opened.
Figure 32:
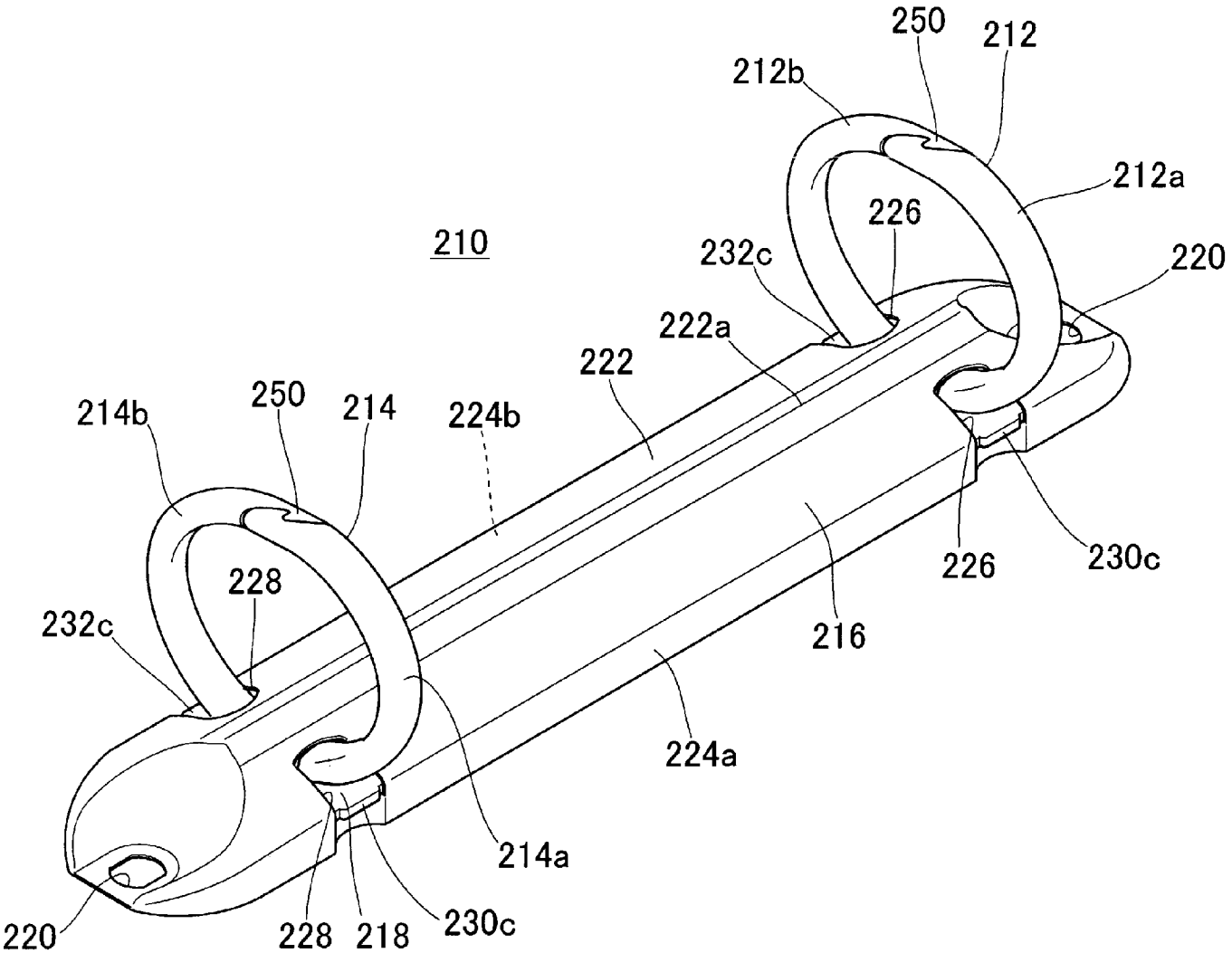
FIG. 32 is a perspective view illustrating an example of the binding device of the other preferred embodiment according to the present invention.
Figure 33:
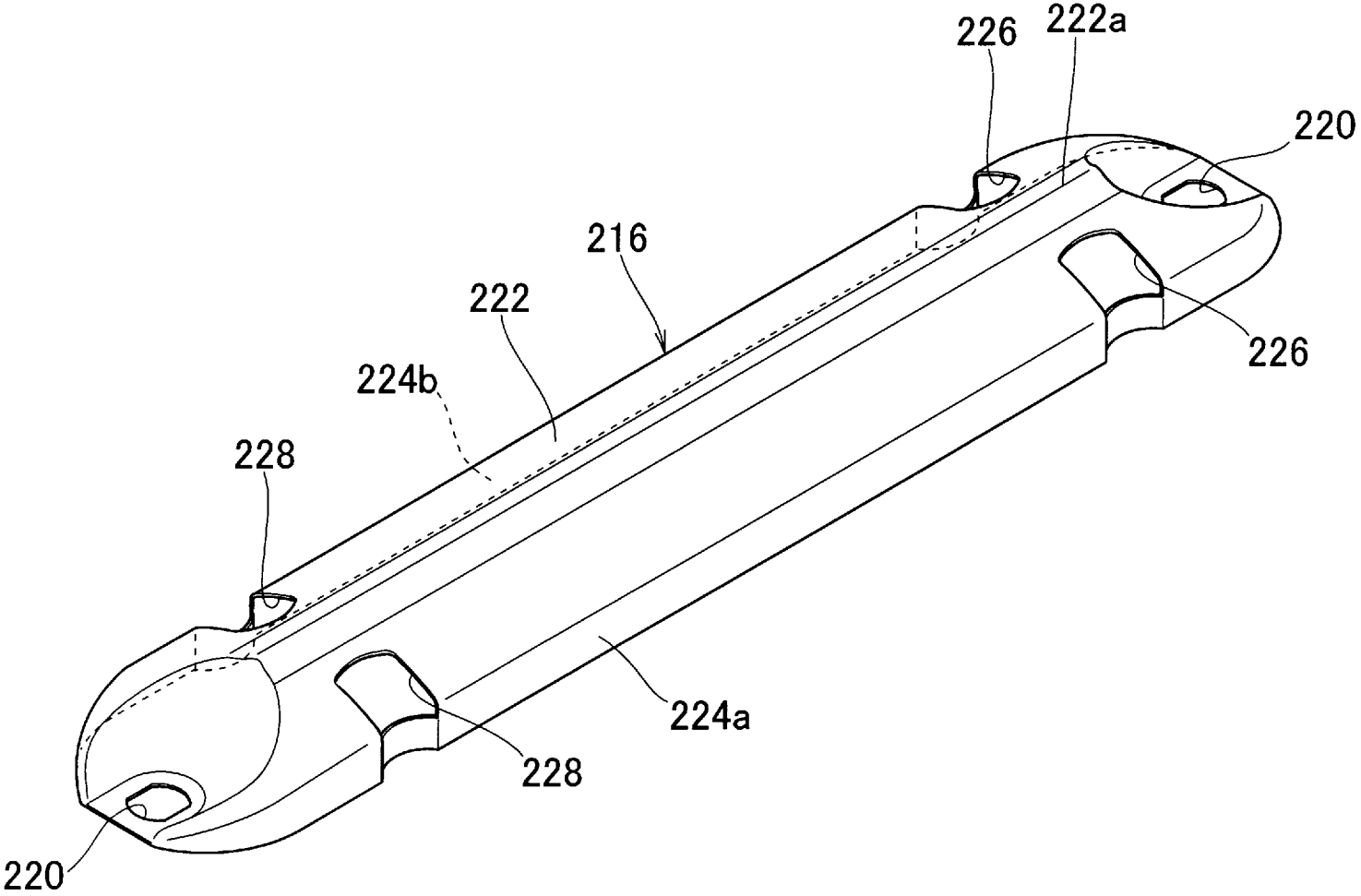
FIG. 33 is a perspective view of a holding member.
Figure 34:
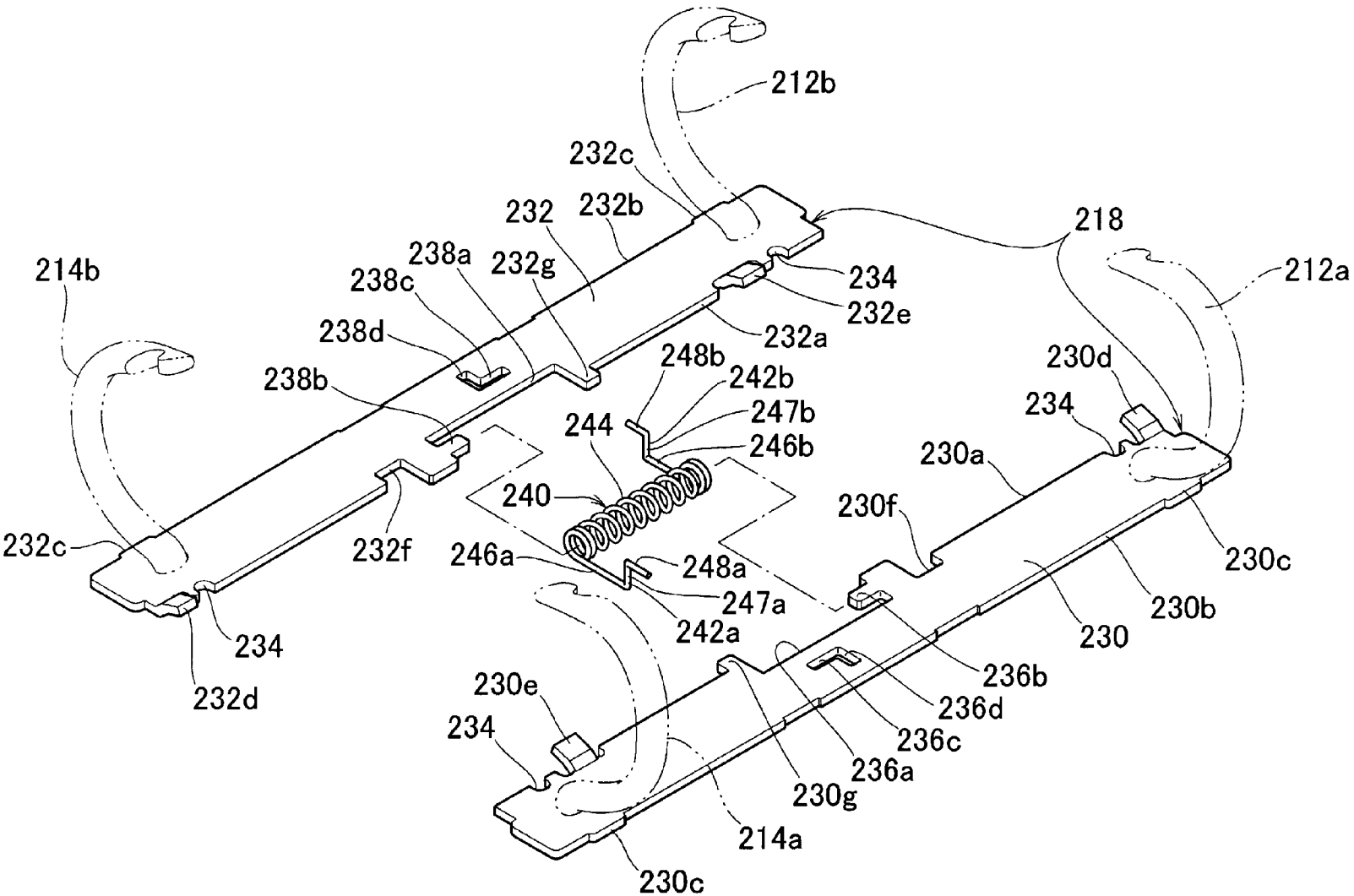
FIG. 34 is a schematic perspective view of an operating member and an opening-closing member.
Figure 35:
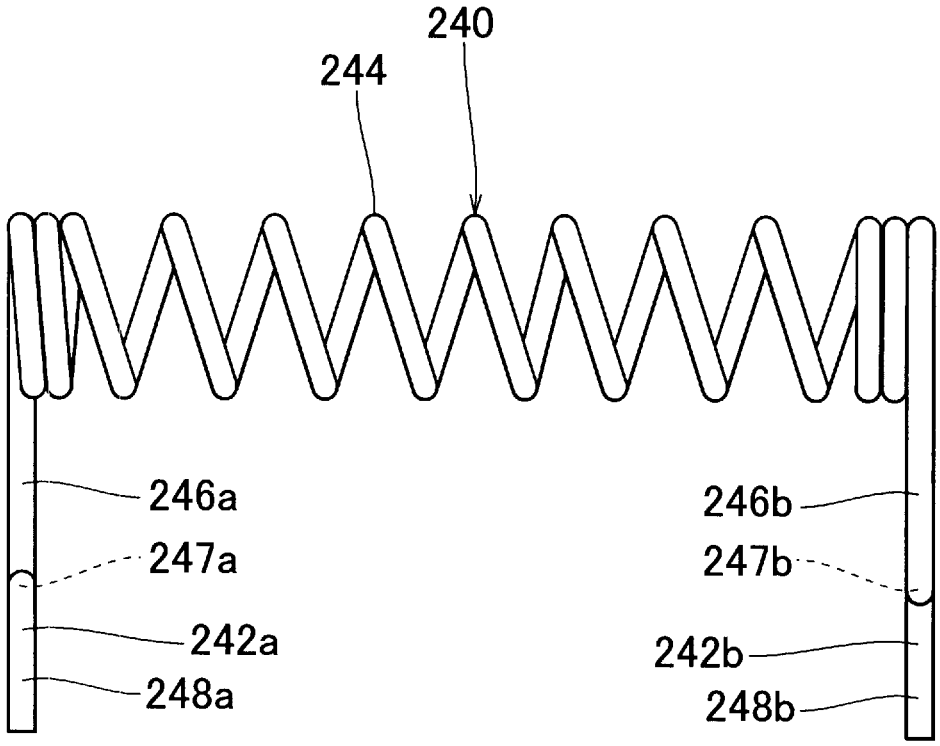
FIG. 35 is a plan view of the opening-closing member.
Figure 36:
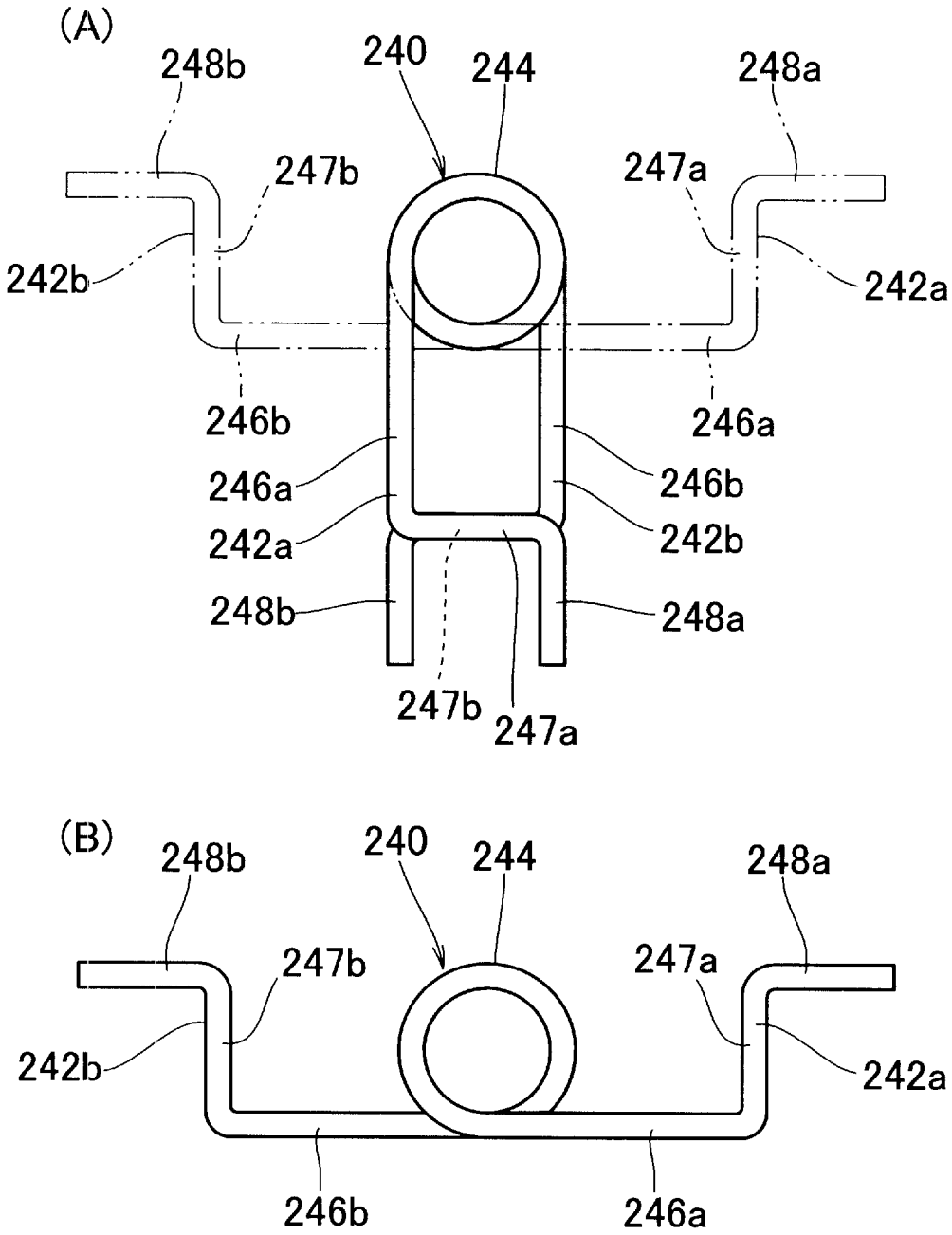
FIGS. 36(A) and 36(B) are schematic side views of the opening-closing member, FIG. 36(A) being a schematic side view of an original state, and FIG. 36(B) being a schematic side view of a state in which a force is applied in a circumferential direction of a coil portion.
Figure 37:
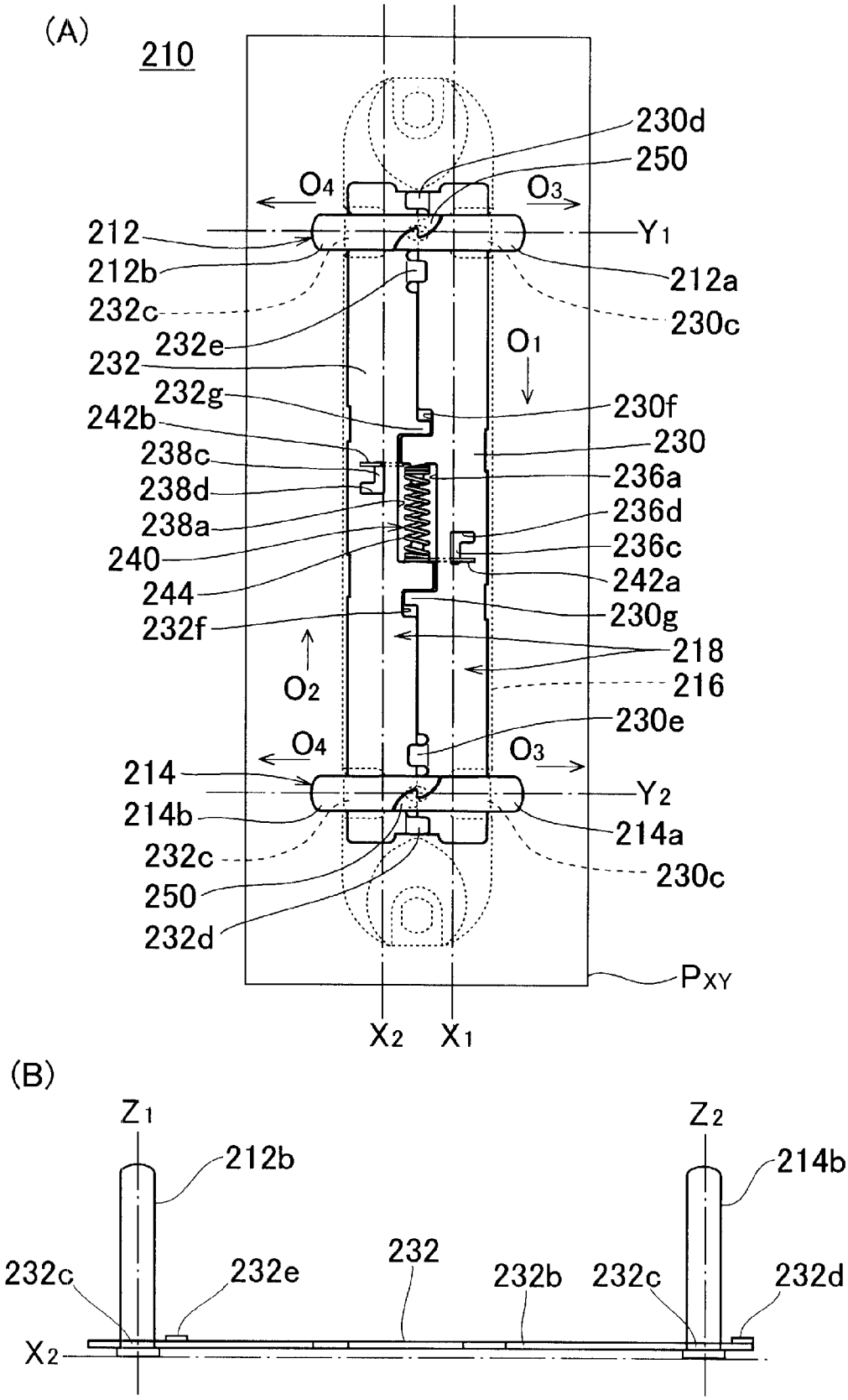
FIGS. 37(A) and 37(B) are schematic views of the binding rings and the operating member, FIG. 37(A) being a schematic plan view illustrating the binding rings and the operating member in a closed state, and FIG. 37(B) being a schematic right side view of a second operating piece.
Figure 38:
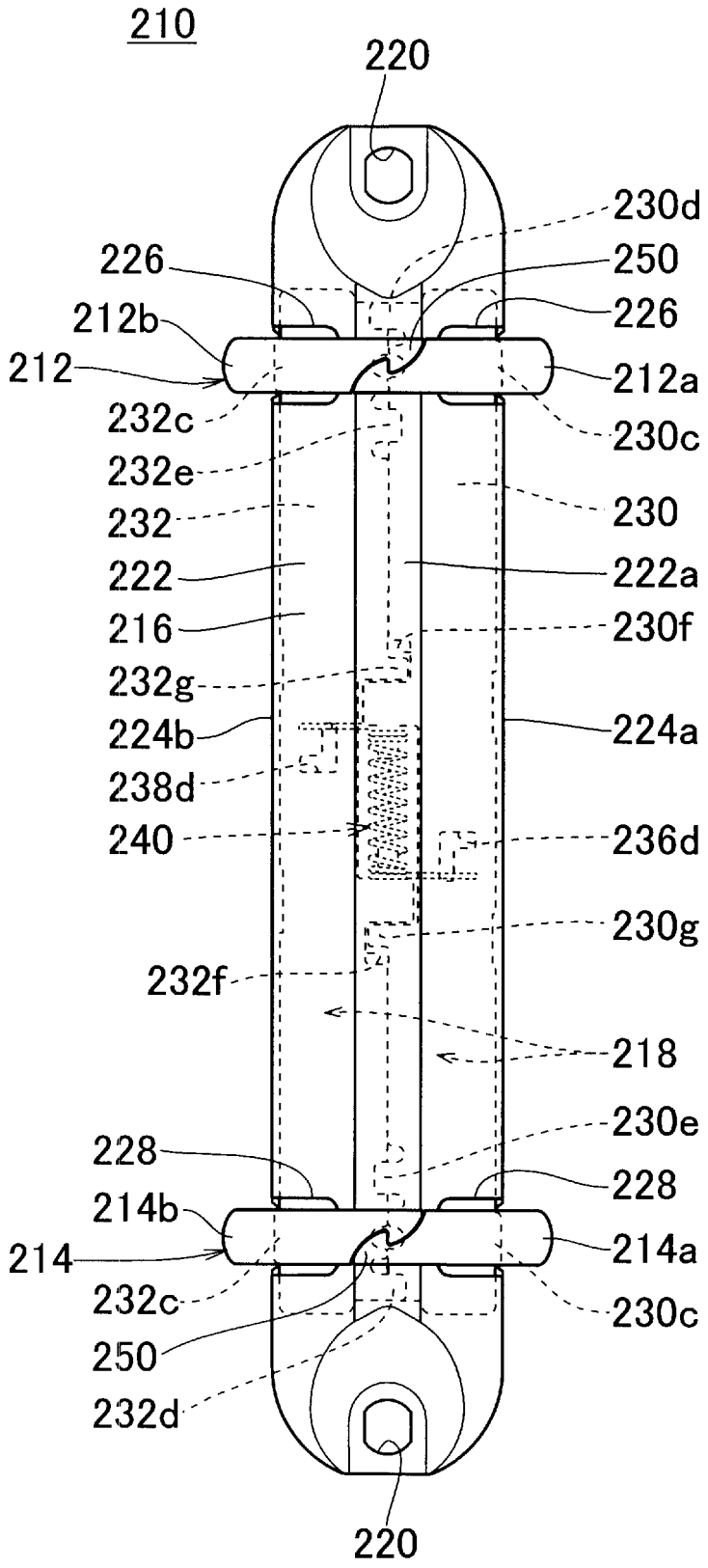
FIG. 38 is a plan view of the binding device in the closed state.
Figure 39:
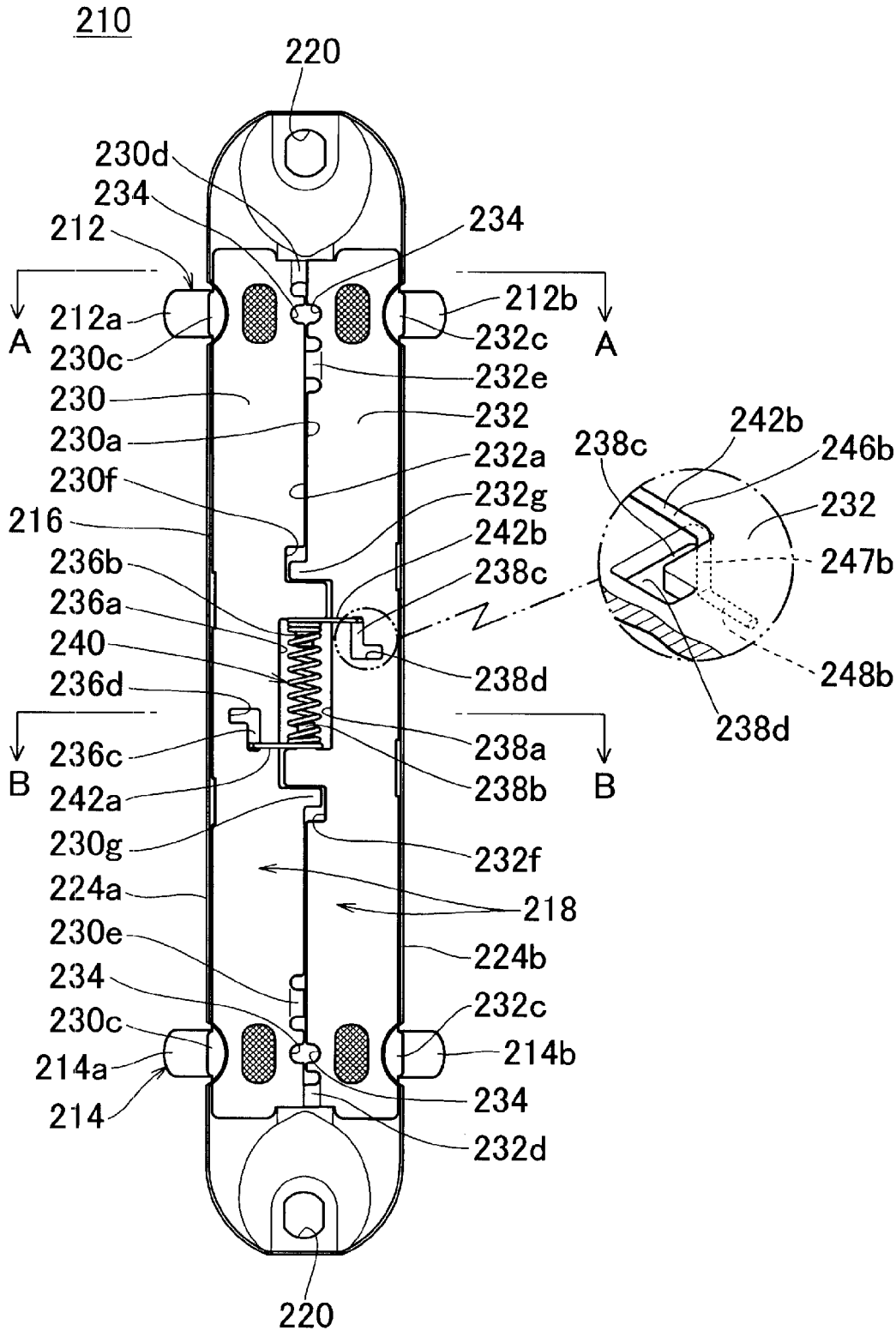
FIG. 39 is a bottom view of the binding device in the closed state.
Figure 40:
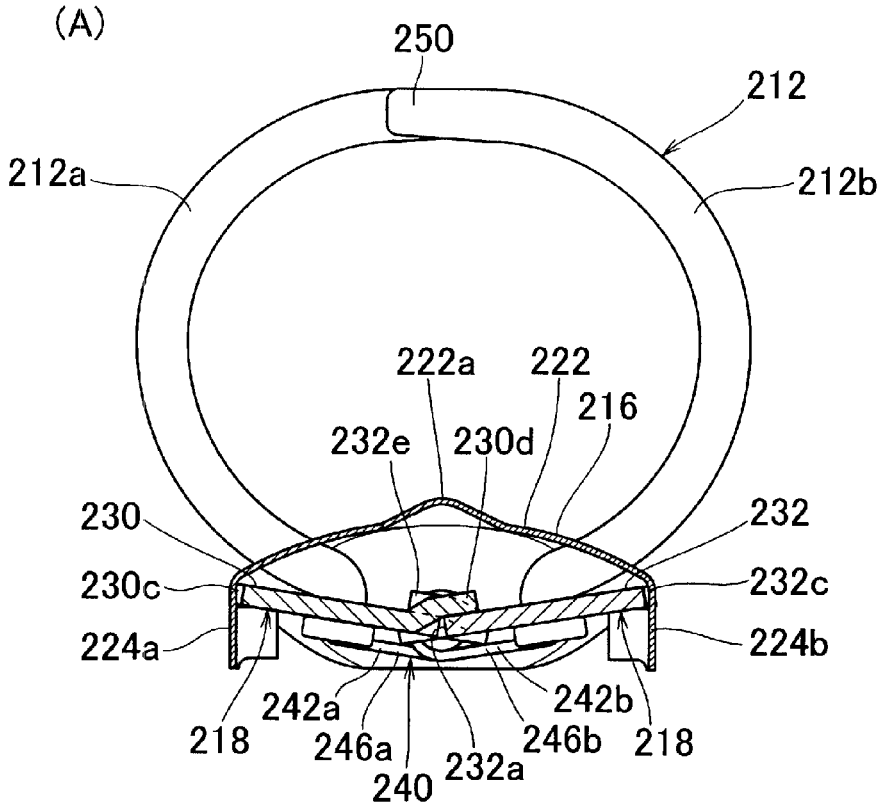
FIGS. 40(A) and 40(B) are cross-sectional side views of the binding device in the closed state, FIG. 40(A) being a cross-sectional view taken along the line A-A in FIG. 39, and FIG. 40(B) being a cross-sectional view taken along the line B-B in FIG. 39.
Figure 40:
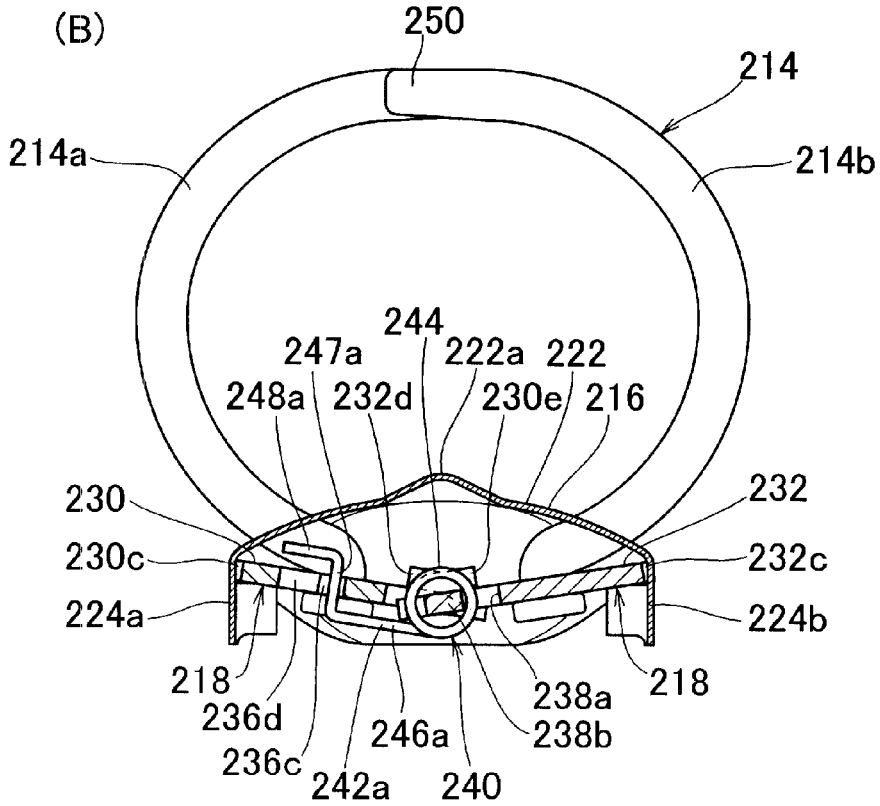
Figure 41:
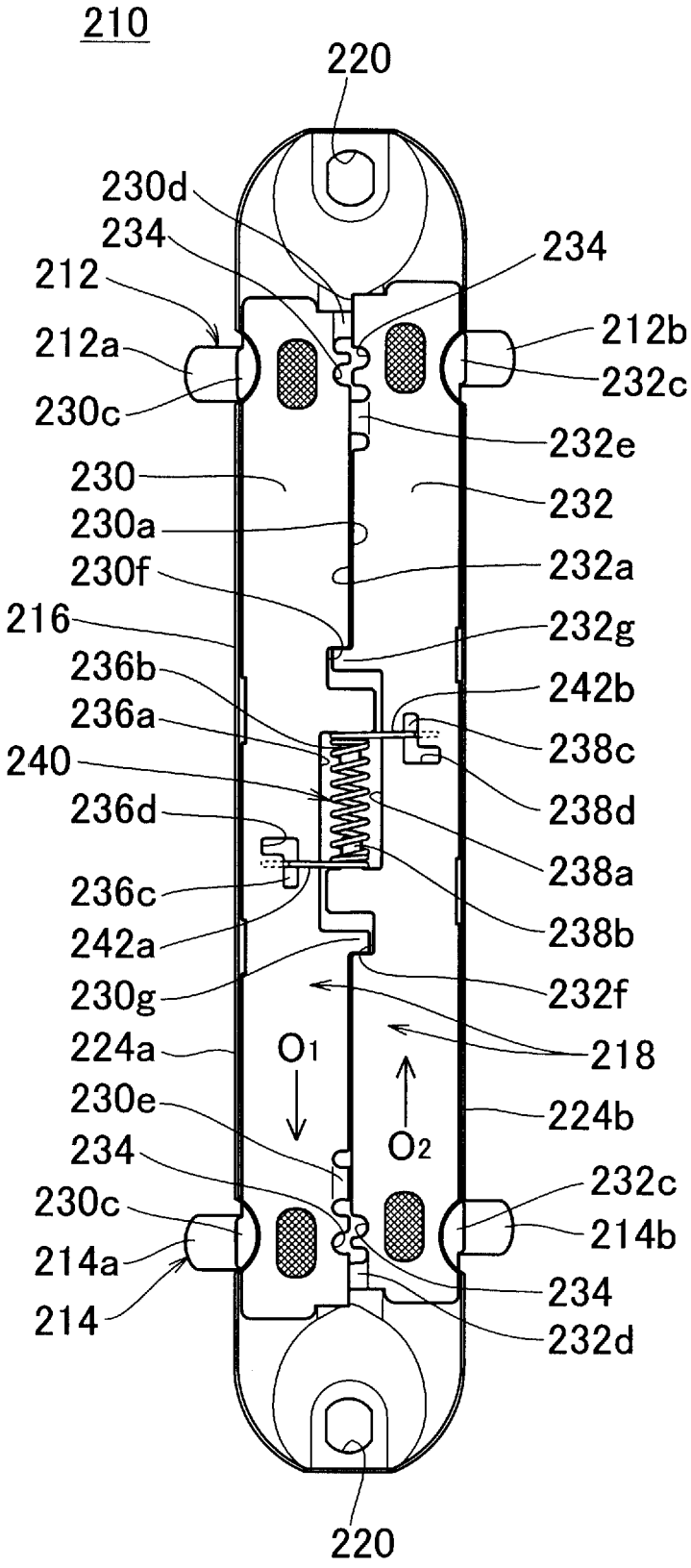
FIG. 41 is a bottom view of the binding device, illustrating a state in which the binding rings are being opened.
Figure 42:
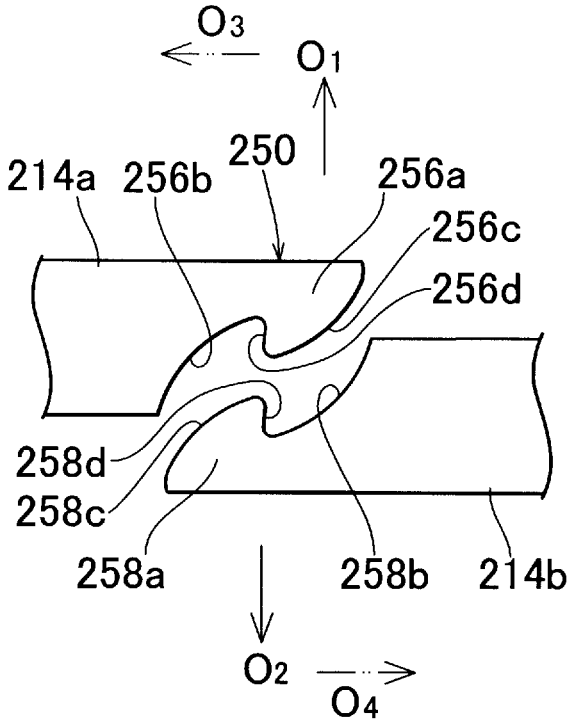
FIG. 42 is a schematic view of the binding rings of the binding device, illustrating the state in which the binding rings are being opened.
Figure 42:
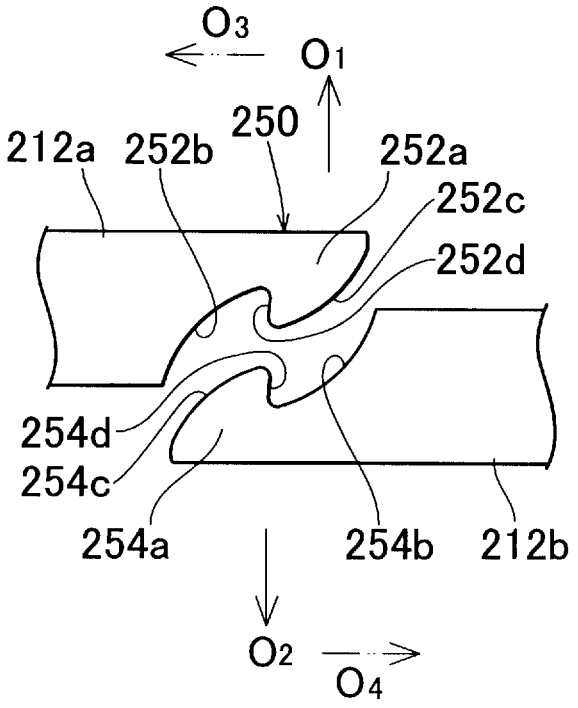
Figure 43:
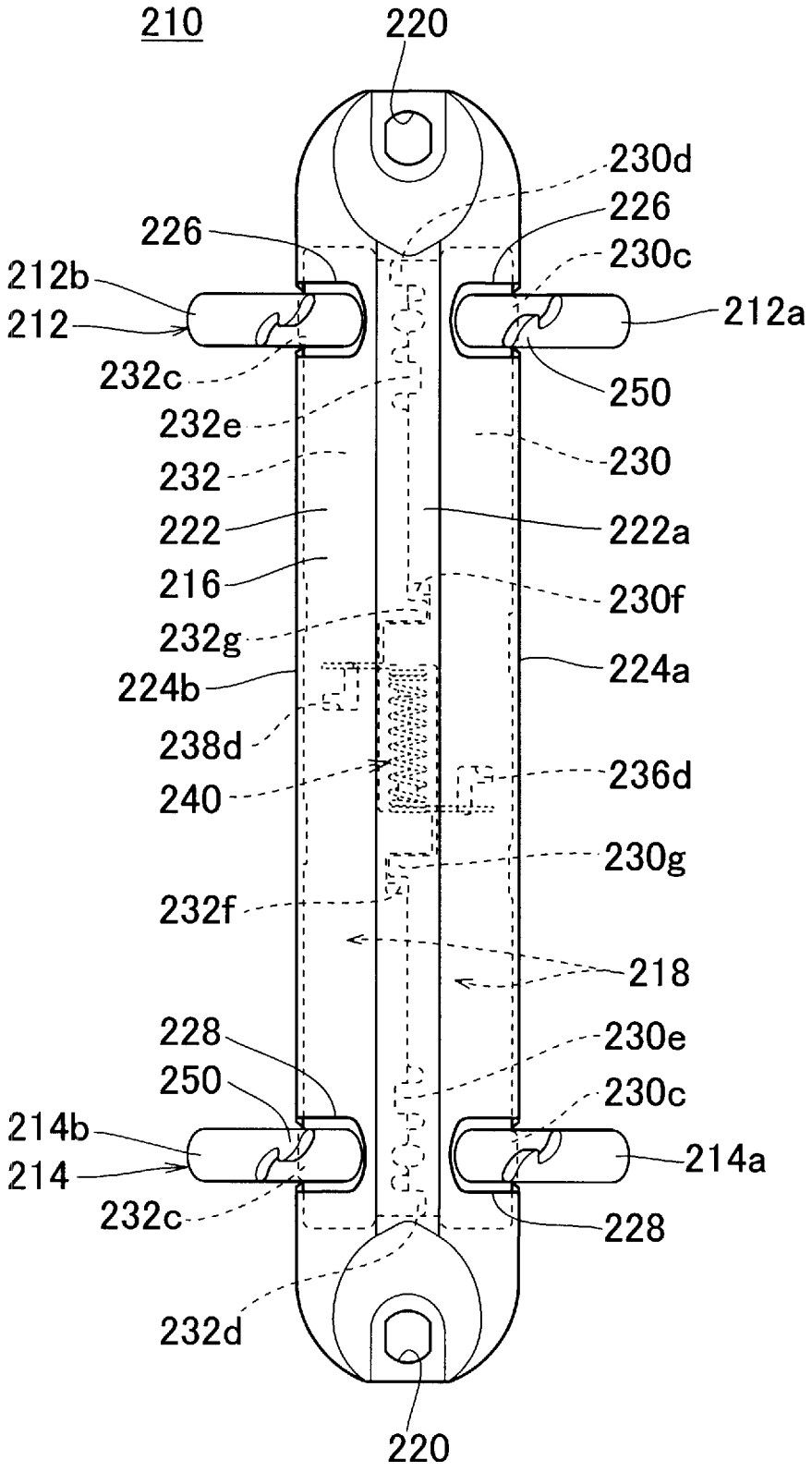
FIG. 43 is a plan view of the binding device in an opened state.

FIG. 31 is a perspective view illustrating a file using a binding device of one preferred embodiment according to the present invention. FIG. 32 is a perspective view illustrating one example of the binding device of the preferred embodiment according to the present invention, and FIG. 33 is a perspective view of a holding member. FIG. 34 is a schematic perspective view of an operating member and an opening-closing member. FIG. 35 is a plan view of the opening-closing member. FIG. 36 includes schematic side views of the opening-closing member, FIG. 36(A) being a schematic side view of an original state, and FIG. 36(B) being a schematic side view of a state in which a force is applied in a circumferential direction of a coil portion. FIG. 37 includes schematic views of the binding rings and the operating member, FIG. 37(A) being a schematic plan view illustrating the binding rings and the operating member in a closed state, and FIG. 37(B) being a schematic right side view of a second operating piece. FIG. 38 is a plan view of the binding device in the closed state. FIG. 39 is a bottom view of the binding device in the closed state. FIG. 40 includes cross-sectional side views of the binding device in the closed state, FIG. 40(A) being a cross-sectional view taken along the line A-A in FIG. 39, and FIG. 40(B) being a cross-sectional view taken along the line B-B in FIG. 39. FIG. 41 is a bottom view of the binding device, illustrating a state in which the binding rings are being opened. FIG. 42 is a schematic view of the binding rings of the binding device, illustrating the state in which the binding rings are being opened.

A binding device 210 shown in FIGS. 31 to 32 is fastened to the inner surface of a back cover between a pair of left and right fold lines provided substantially in the center of a cover A made of a relatively hard sheet material such as cardboard. As a fastening method, there is a method in which the binding device 210 is fastened by inserting a fastener such as a bolt with a nut and an eyelet into an attaching hole 220 (described later) formed in both the longitudinal end portions of the binding device 210 and is integrated with the back cover.

Here, a description is provided of the case in which a bolt with a nut is used as the fastener; however, the fastener is not limited thereto. For example, a screw, an eyelet, a rivet, or other suitable fastener may be used. Furthermore, fastening to the back cover may be performed by a fastening method such as ultrasonic welding or high frequency welding.

The binding device 210 includes a substantially annular first binding ring 212 and a substantially annular second binding ring 214 defining a pair with the first binding ring 212, which are made of metal and define a pair of annular binding rings, a holding member 216 having a length which allows the first and second binding rings 212 and 214 to be disposed with a spacing therebetween, and an operating member 218 having a surface to which the base portions of each of the first and second binding rings 212 and 214 are secured with a spacing between the first and second binding rings 212 and 214, the operating member 218 being movably secured inside the holding member 216 such that the first and second binding rings 212 and 214 are secured to the holding member 216.

This binding device 210 is an openable-closable two-hole type, i.e., the binding rings thereof include the first binding ring 212 functioning as a main binding ring and the second binding ring 214 serving as a subsidiary binding ring.

The first and second binding rings 212 and 214 are configured such that binding ring-engaging portions 250 thereof can be disengaged in the same direction using fingers.

In the above configuration, when the binding rings are closed, the first binding ring 212 functioning as the main binding ring is closed by directly holding the first binding ring 212 between, for example, thumb and index finger. In this configuration, when the first binding ring 212 is operated in a closing direction by holding between two fingers, the second binding ring 214 serving as the subsidiary binding ring follows the first binding ring 212.

The holding member 216 has a substantially rectangular shape in plan view having a length which allows the first and second binding rings 212 and 214 to be disposed with a predetermined spacing therebetween. Furthermore, both of the end portions of the holding member 216, or portions in the vicinity of the attaching hole 220 for attaching the holding member 216 to the cover A, have a substantially semicircular arc shape in plan view.

The holding member 216 has a bound object-mounting portion 222 which extends inwardly between the vicinities longitudinally outside the portions for securing the first and second binding rings 212 and 214 and which has a substantially semicircular arc shaped cross-section having a bulging portion at the center. In addition, the holding member 216 is configured to have a holding space inside the bound object-mounting portion 222 so that the operating member 218 and other elements are contained in the holding space.

Along both of the edges of the bound object-mounting portion 222 of the holding member 216, holding walls 224*a* and 224*b*, respectively, are provided each of which extends in the longitudinal direction substantially from one end of the bound object-mounting portion 222 to the other end and slidably holds the operating member 218. In this preferred embodiment, the holding walls 224*a* and 224*b* are provided consecutively so as to hang down from substantially entire portions, respectively, each extending, in the longitudinal direction of the holding member 216, inwardly between the vicinities outside the first and second binding rings 212 and 214. Furthermore, the holding walls 224*a* and 224*b* are substantially in parallel to each other and have substantially the same plate-like shape.

The operating member 218 to be described in detail later are contained in the holding space surrounded by the holding walls 224*a* and 224*b* and the bound object-mounting portion 222.

The bound object-mounting portion 222 of the holding member 216 is provided with first and second through holes 226 and 228 which allow the first and second binding rings 212 and 214, respectively, to loosely pass therethrough with a predetermined distance (a predetermined length defined by Japanese Industrial Standards or the like) between the binding rings 212 and 214.

Each of the first and second through holes 226 and 228 is provided in two portions, i.e., left and right portions which are separated by a predetermined distance in the width direction of the holding member 216 so as to conform to a first ring half 212*a* and a second ring half 212*b* defining the first binding ring 212 or a third ring half 214*a* and a fourth ring half 214*b* defining the second binding ring 214.

The operating member 218 includes a pair of a first operating piece 230 and a second operating piece 232 each made of a metal plate having a substantially rectangular shape in plan view.

The first and second operating pieces 230 and 232 include outside edges 230*b* and 232*b*, respectively, which are substantially in parallel with the holding walls 224*a* and 224*b*, respectively, in the longitudinal direction of the respective operating pieces and which slide along the inner surface of the holding walls 224*a* and 224*b*, respectively. In addition, the first and second operating pieces 230 and 232 include abutting edges 230*a* and 232*a*, respectively, which are substantially parallel to the outside edges 230*b* and 232*b*, respectively, and which are provided for abutting the pair of the first and second operating pieces 230 and 232 against each other. The first and second operating pieces 230 and 232 are symmetrical with respect to a point. Furthermore, when the first and second operating pieces 230 and 232 are juxtaposed along the longitudinal direction thereof in the holding space of the holding member 216, the first and second operating pieces 230 and 232 are engaged with each other at the inner edges thereof so as to be bendable. More specifically, the abutting edges 230*a* and 232*a* abut against each other, and the outside edges 230*b* and 232*b* are brought into contact with the inner surfaces of the holding walls 224*a* and 224*b*, respectively, of the holding member 216.

When no force is applied from the outside, the first and second operating pieces 230 and 332 form a V shape, i.e., are directed in a direction away from the inner surface of the bound object-mounting portion 222 of the holding member 216 (the abutting edges 230*a* and 232*a* are positioned below a plane $P_{xy}$ shown in FIG. 37). Alternatively, the first and second operating pieces 230 and 232 form an inverted V shape, i.e., are directed in a direction approaching the inner surface of the bound object-mounting portion 222 of the holding member 216 (the abutting edges 230*a* and 232*a* are positioned above the plane $P_{xy}$ shown in FIG. 37). The first and second operating pieces 330 and 332 are provided inside the holding space of the holding member 216 so as to maintain the V-shaped state or the inverted V-shaped state.

The plane $P_{xy}$ is a plane including left-right axes $Y_1$ and $Y_2$ and front-rear axes $X_1$ and $X_2$ (shown in FIG. 37) and passing portions on the first and second operating pieces 230 and 232, i.e., four portions to each of which one of the base portions of the first binding ring 212 or the second binding ring 214 is secured.

In the operating member 218, the base portion of the first ring half 212*a* defining the first binding ring 212 is secured to the surface (the upper surface) of one of the operating pieces, i.e., the first operating piece 230, which surface faces the inner surface of the bound object-mounting portion 222 of the holding member 216. In addition, the base portion of the third ring half 214*a* defining the second binding ring 214 is secured to this surface so as to be separated from the first ring half 212*a* by a predetermined distance.

Furthermore, the base portion of the second ring half 212*b* defining the first binding ring 212 is secured to the surface (the upper surface) of the other operating piece, i.e., the second operating piece 232, which surface faces the bound object-mounting portion 222 of the holding member 216. In addition, the base portion of the fourth ring half 214*b* defining the second binding ring 214 is secured to this surface so as to be separated from the second ring half 212*b* by a predetermined distance.

The pair of the operating pieces, i.e., the first and second operating pieces 230 and 232, include a protruding portion 230*c* and a protruding portion 232*c*, respectively, each of which is inserted in the through holes, i.e., the first and second through holes 226 and 228, provided in the holding member 216. The pair of the first and second operating pieces 230 and 232 abut against each other with the protruding portions 230*c* and 232*c*, which are inserted in the first and second through holes 226 and 228. The first and second operating pieces 230 and 232 are held in the holding member 216 so as to be rotationally movable in a direction of opening-closing the first and second binding rings 212 and 214, so that the abutting edges 230*a* and 232*a* are close to the inner surface of the holding member 216 when the binding rings, i.e., the first and second binding rings 212 and 214, are opened and that the abutting edges 230*a* and 232*a* are separated away from the inner surface of the holding member 216 when the first and second binding rings 212 and 214 are closed.

The first and second operating pieces 230 and 232 include the abutting edges 230*a* and 232*a*, respectively, on the inner side thereof. The abutting edges 230*a* and 232*a* are substantially linear, and the pair of the operating pieces abut against each other along the abutting edges 230*a* and 232*a*. Furthermore, the first and second operating pieces 230 and 232 include the outside edges 230*b* and 232*b*, respectively, on the outer side thereof, the outside edges 230*b* and 232*b* being substantially parallel to the abutting edges 230*a* and 232*a*, respectively, and being substantially linear.

The protruding portion 230*c* is formed at front and rear positions, i.e., at two positions close to the attachment positions of the base portions of the first and third ring halves 212*a* and 214*a*, respectively. In addition, the protruding portion 232*c* is formed at front and rear positions, i.e., at two positions close to the attachment positions of the base portions of the second and fourth ring halves 212*b* and 214*b*. The protruding portions 230*c* and 232*c* protrude outwardly from the holding walls 224*a* and 224*b* of the holding member 216, respectively, so as to allow the first and second binding rings 212 and 214 to be opened and closed.

The protruding portions 230*c* and 232*c* have a tongue-like shape which has a length for allowing them to protrude outwardly from the through holes (the first and second through holes 226 and 228) of the holding member 216 and has a width for allowing the operating member 218 to move in the longitudinal direction of the holding member 216.

The operating pieces are made of a thin plate of metal or plastic, and the operating pieces are formed integrally with the respective protruding portions.

The first operating piece 230 is provided with engaging portions 230*d* and 230*e* which are provided to engage the pair of the operating pieces with each other and protrude from the abutting edge 230*a* of the first operating piece 230 toward the abutting edge 232*a* of the second operating piece 232. In addition, engaging portions 232*d* and 232*e* for engaging the pair of the operating pieces with each other are provided to protrude from the abutting edge 232*a* of the second operating piece 232 toward the abutting edge 230*a* of the first operating piece 230.

The engaging portions 230*d* and 230*e* and the engaging portions 232*d* and 232*e* extend toward the upper side of the second and first operating pieces 232 and 230, respectively, opposed to each other and thus are formed to allow the first and second operating pieces 230 and 232 to oscillate about the abutting edges 230*a* and 232*a*.

Each of the engaging portions 230*d* and 230*e* and the engaging portions 232*d* and 232*e* has a substantially U shape in plan view having a base portion and a retaining portion, the base portion protruding an amount corresponding to the thickness of the operating member 218 toward the inner surface side of the bound object-mounting portion 222 of the holding member 216, the retaining portion protruding from the end of the base portion. The retaining portion prevents disengagement of the first operating piece 230 or the second operating piece 232, which is one of the pair of the operating pieces, i.e., the first and second operating pieces 230 and 232. Each of the engaging portions 230*d* and 230*e* and the engaging portions 232*d* and 232*e* protrudes toward the inner surface side of the bound object-mounting portion 222 of the holding member 216. The retaining portion comes into contact with the surface of the first operating piece 230 or the second operating piece 232, which is one of the operating pieces of the pair of the operating pieces, i.e., the first and second operating pieces 230 and 232, the surface being on the inner surface side of the bound object-mounting portion 222 of the holding member 216.

Each of the outermost engaging portions 230*e* and 232*e* has a width which allows the edge of the operating member 18 to be positioned within the width even when the first and second operating pieces 230 and 232 are moved in opposite directions.

The outermost engaging portions 230*e* and 232*e* are arranged to be separated from the inward engaging portions 230*d* and 232*d*, respectively, by an appropriate distance so that the portion attached to the base portion of the first binding ring 212 or the second binding ring 214 is located therebetween. A clearance portion 234 for inserting a rod-like jig G between the abutting edges 230*a* and 232*a* of the first and second operating pieces 230 and 232 is provided between the outermost engaging portion 230*e* and the inward engaging portion 232*d* and between the outermost engaging portion 32*e* and the inward engaging portion 230*d*.

Figure 45:
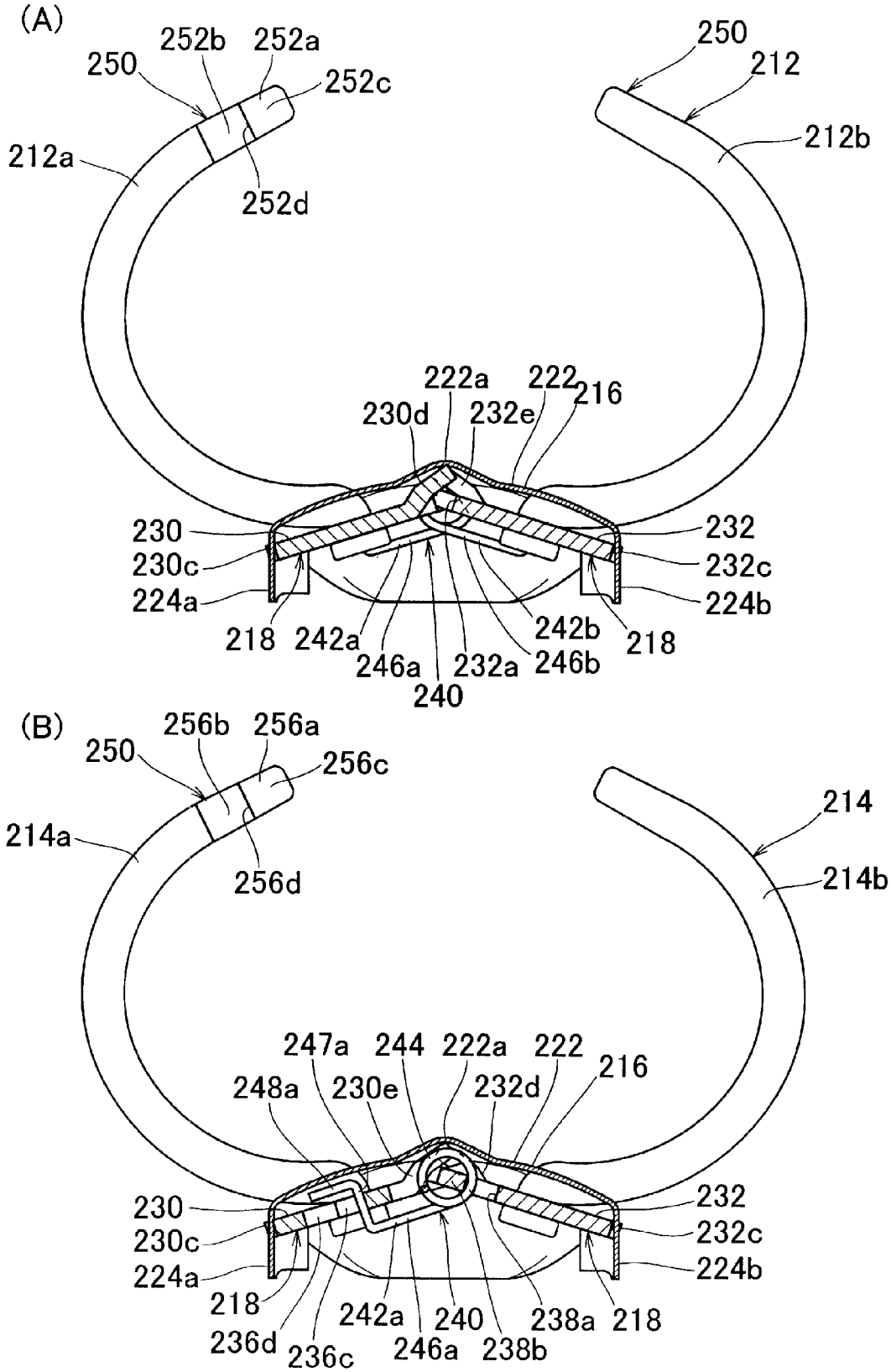
FIGS. 45(A) and 45(B) are cross-sectional side views of the binding device in the opened state.
Figure 46:
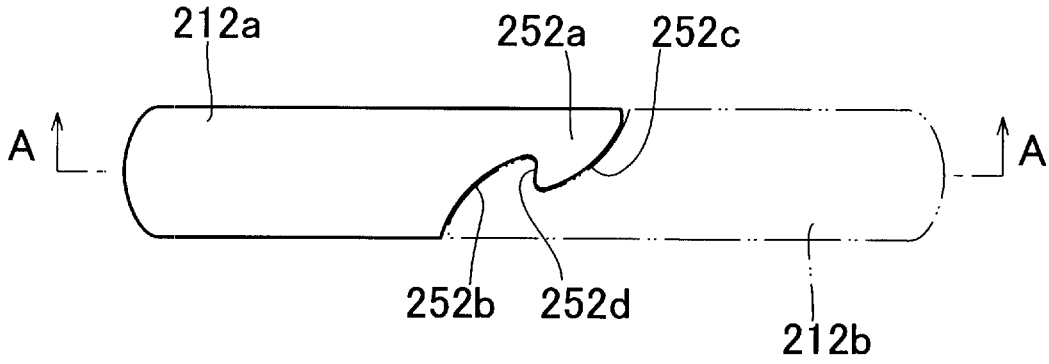
FIGS. 46(A), 46(B), and 46(C) are schematic views illustrating engaging portions of the binding rings, FIG. 46(A) being a schematic plan view, FIG. 46(B) being a schematic cross-sectional view taken along the line A-A in FIG. 46(A), and FIG. 46(C) being a schematic front view.
Figure 46:
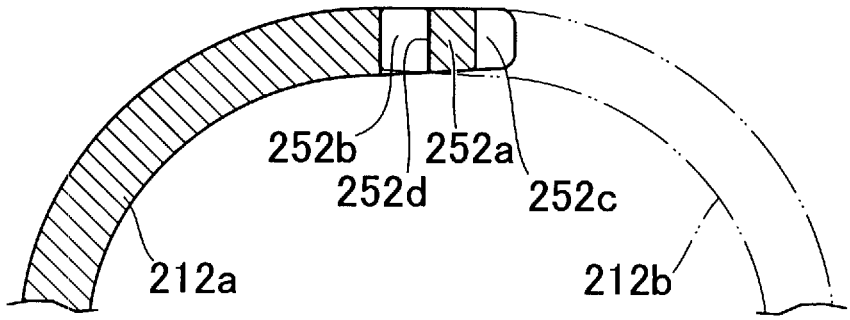
Figure 46:
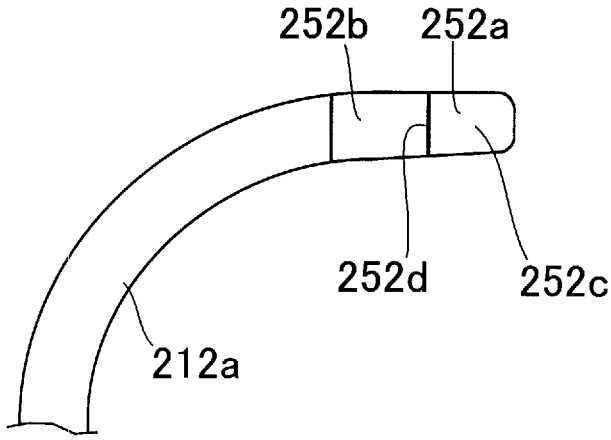
Figure 47:
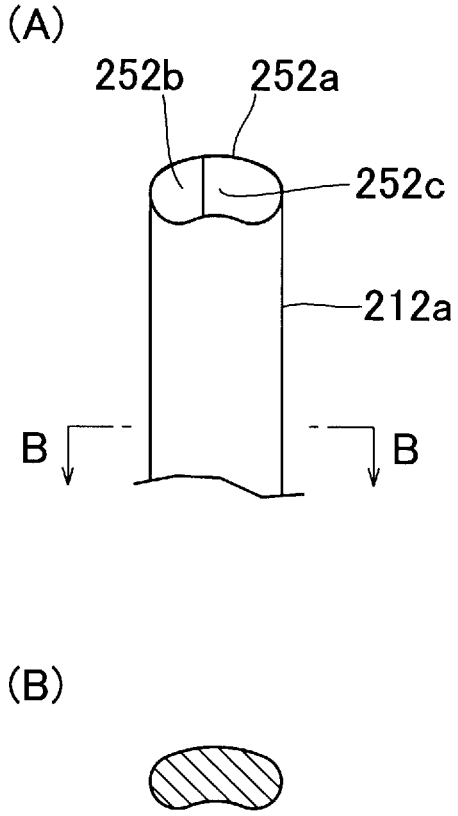
FIGS. 47(A) and 47(B) are schematic views illustrating the engaging portion of one of the binding rings, FIG. 47(A) being a schematic side view, and FIG. 47(B) being a schematic cross-sectional view taken along the line B-B in FIG. 47(A).
Figure 48:
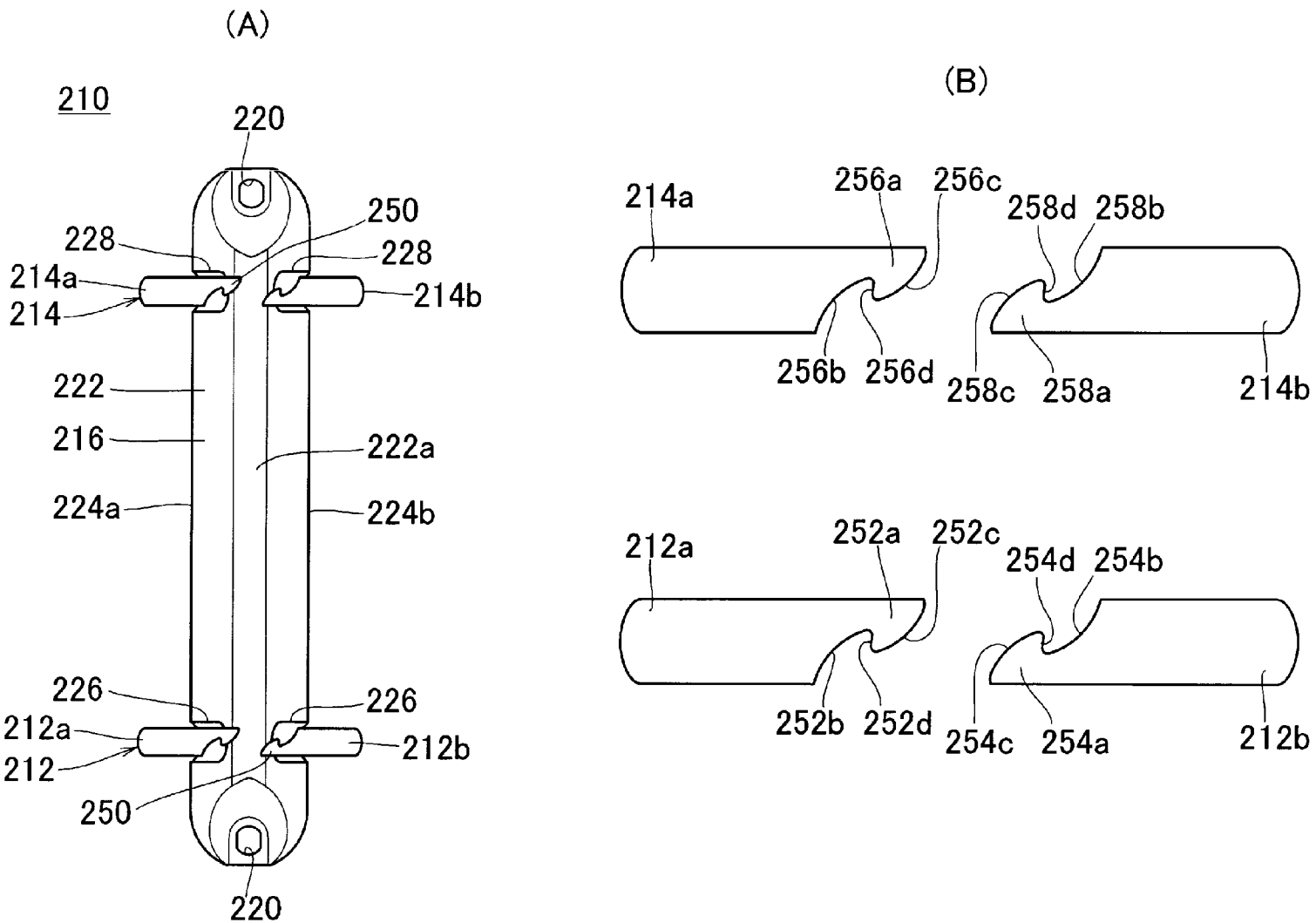
FIGS. 48(A) and 48(B) are schematic views of the binding rings, illustrating a state in which the binding rings are being closed, FIG. 48(A) being a schematic plan view, and FIG. 48(B) being schematic front views.

As shown in FIG. 40, when the first and second binding rings 212 and 214 are closed, the first and second operating pieces 230 and 232 defining the operating member 218 are secured in the space inside the holding member 216 so as to be held in a state (i.e., a V-shaped state) in which the abutting edges 230*a* and 232*a* of the first and second operating pieces 230 and 232 abut against each other with the abutting edges 230*a* and 232*a* directed in a direction away from the inner surface of the holding member 216 (the inner surface of the bound object-mounting portion 222). In addition, as shown in FIG. 45, when the first and second binding rings 212 and 214 are opened, the first and second operating pieces 230 and 232 defining the operating member 218 are secured in the space inside the holding member 216 so as to be held in a state (i.e., in an inverted V-shaped state) in which the abutting edge 232*a* of the second operating piece 232 abuts on the inner surface of the holding member 216 (the inner surface of the bound object-mounting portion 222) with the abutting edges 230*a* and 232*a* directed in a direction approaching the inner surface.

Furthermore, the first and second operating pieces 230 and 232 defining the operating member 218 are slidably disposed such that, when the operating pieces 230 and 232 are directed in a direction approaching the inner surface of the bound object-mounting portion 222 of the holding member 216, i.e., are in an inverted V-shaped state, the first and second operating pieces 230 and 232 can be movable in the longitudinal direction of the first and second operating pieces 230 and 232, i.e., a direction parallel to the line ($X_1$ in FIG. 37) connecting the first and third ring halves 212*a* and 214*a* secured to the first operating piece 230 and parallel to the line ($X_2$ in FIG. 37) connecting the second and fourth ring halves 212*b* and 214*b* secured to the second operating piece 232.

Each of the first and second operating pieces 230 and 232 includes a movement restricting portion, which is provided in the vicinities outside gap portions 236*a* and 238*a* and opening-closing member-securing portions 236*b* and 238*b*. The movement restricting portion is provided for restricting the movement of the first and second operating pieces 230 and 232 in the longitudinal direction.

The movement restricting portion includes a restricting recess 230*f*, a restricting projection 230*g*, a restricting recess 232*f*, and a restricting projection 232*g*, the restricting recess 230*f* and the restricting projection 230*g* being provided in the abutting edge 230*a* of the first operating piece 230, the restricting recess 232*f* and the restricting projection 232*g* being provided in the abutting edge 232*a* of the second operating piece 232.

The restricting recess 230*f* is a hole which is provided in the vicinity outside the opening-closing member-securing portion 236*b* and has a square U shape in plan view recessed from the abutting edge 230*a* in the width direction. The restricting projection 232*g* is a projection which has a square U shape in plan view and is configured so as to loosely fit into the restricting recess 230*f*. The restricting projection 232*g* and the restricting recess 230*f* are configured such that the restricting projection 232*g* fits loosely into the restricting recess 230*f* to allow the first and second operating pieces 230 and 232 to move in opposite longitudinal directions inside the restricting recess 230*f*.

The restricting recess 232*f* is a hole which is provided in the vicinity outside the opening-closing member-securing portion 238*b* and has a square U shape in plan view recessed from the abutting edge 232*a* in the width direction. The restricting projection 230*g* is a projection which has a square U shape in plan view and is configured so as to loosely fit into the restricting recess 232*f*. The restricting projection 230*g* and the restricting recess 232*f* are configured such that the restricting projection 230*g* fits loosely into the restricting recess 232*f* to allow the first and second operating pieces 230 and 232 to move in opposite longitudinal directions inside the restricting recess 232*f*.

An opening-closing member 240 for shifting the first and second binding rings 212 and 214 in the opening-closing direction is provided between the abutting edge 230*a* of the first operating piece 230 and the abutting edge 232*a* of the second operating piece 232.

The opening-closing member 240 is defined by a twisted coil spring including a coil portion 244 and securing end portions 242*a* and 242*b* which extend continuously from the respective ends of the coil portion 244 in a direction orthogonal to the central axis of the coil part 244. In an original state in which no twisting moment is generated, the securing end portions 242*a* and 242*b* protrude in the circumferential direction of the coil portion 244 so as to be parallel to each other, as shown in FIG. 36(A). The securing end portions 242*a* and 242*b* are provided with linear securing portions 246*a* and 246*b*, respectively, which protrude from the coil portion 244, intermediate portions 247*a* and 247*b*, respectively, which are provided on free end sides of the securing portions 246*a* and 246*b*, respectively, and engaging ends 248*a* and 248*b* which are provided on free end sides of the intermediate portions 247*a* and 247*b*, respectively, i.e., on respective one sides of the intermediate portions 247*a* and 247*b* which sides are opposite to the securing portions 246*a* and 246*b*. The securing portions 246*a* and 246*b* are substantially orthogonal to the intermediate portions 247*a* and 247*b*, respectively, and the intermediate portions 247*a* and 247*b* are substantially orthogonal to the engaging ends 248*a* and 248*b*, respectively.

In an original state in which no twisting moment is generated, the one securing portion 246*a* and the other securing portion 246*b* are configured so as to be substantially parallel to each other, and the one engaging end 248*a* and the other engaging end 248*b* are configured so as to be substantially parallel to each other.

A gap portion 236*a* is provided near a substantially central portion of the abutting edge 230*a* of the first operating piece 230 defining the binding device 210, and a gap portion 238*a* is provided near a substantially central portion of the abutting edge 232*a* of the second operating piece 232. In addition, the opening-closing member-securing portion 236*b* for engaging the opening-closing member 240 protrudes from one end of the gap portion 236*a*. Furthermore, the opening-closing member-securing portion 238*b* for engaging the opening-closing member 240 protrudes from one end of the gap portion 238*a*.

The opening-closing member-securing portions 236*b* and 238*b* are configured so as to be separated in a direction of the line $X_1$ or $X_2$, the line $X_1$ connecting the base portion for securing the first binding ring 212 to the first operating piece 230, the line $X_2$ connecting the base portion for securing the second binding ring 214 to the second operating piece 232.

Both ends of the coil portion 244 are engaged with the opening-closing member-securing portions 236*b* and 238*b*, respectively, and the opening-closing member 240 is contained in the gap portions 236*a* and 238*a*.

Furthermore, the operating member 218 includes supporting portions 236*c* and 238*c* in order to support the end portions extending from both the ends of the coil part 244 of the opening-closing member 240.

The securing end portions extending from both of the ends of the coil portion 244 of the opening-closing member 240 are engaged with and supported by the supporting portion 236*c* of the first operating piece 230 and the supporting portion 238*c* of the second operating piece 232, respectively.

More specifically, the one securing end portion 242*a* is supported by the supporting portion 236*c* of the first operating piece 230 opposed to the second operating piece 232 provided with the opening-closing member-securing portion 238*b* engaging with the end of the coil portion 244. Furthermore, the other securing end portion 242*b* is supported by the supporting portion 238*c* of the second operating piece 232 opposed to the first operating piece 230 provided with the opening-closing member-securing portion 236*b*.

Each of the securing portions 246*a* and 246*b* has a constant length, and the intermediate portions 247*a* and 247*b* are engaged with the supporting portions 236*c* and 238*c*, respectively, of the operating member 218. Therefore, the securing end portions 242*a* and 242*b* maintain the distance between the first and second operating pieces 230 and 232 constant, the first and second operating pieces 230 and 232 abutting against each other along the abutting edge 230*a* of the first operating piece 230 and the abutting edge 232*a* of the second operating piece 232. In addition, the securing end portions 242*a* and 242*b* bring the first and second operating pieces 230 and 232 close to each other to maintain an optimal state of the positional relationship between the first and second operating pieces 230 and 232.

Therefore, when the first and second binding rings 212 and 214 defining the binding rings are opened or closed, the first and second operating pieces 230 and 232 oscillate about the a butting edges 230*a* and 232*a* each providing a pivot. In this case, even when the sum of the width of the first operating piece 230 and the width of the second operating piece 232 reaches a maximum, i.e., even when the first and second operating pieces 230 and 232 are in a planar state (a neutral state), an appropriate gap is generated between the outermost edge of the first operating piece 230 and the holding wall 224*a* of the holding member 216 and between the outermost edge of the second operating piece 232 and the holding wall 224*b* of the holding member 16. In addition, the first and second operating pieces 230 and 232 of the operating member 218 can be smoothly moved in the holding space of the holding member 216.

In a state in which each of the first and second binding rings 212 and 214 is formed by combining the corresponding ring halves, the distance, in the longitudinal direction of the holding member 216, between both the end portions of the opening-closing member 240 (the distance between the engaging end 248*a* of the securing end portion 242*a* and the engaging end 248*b* of the securing end portion 242*b*) is substantially the same as the distance between both the ends of the coil portion 244.

Furthermore, by moving the pair of the first and second operating pieces 230 and 232 oppositely in the longitudinal direction of the holding member 216, each of the first and second binding rings 212 and 214 defined by combining the corresponding ring halves is separated. When each of the first and second binding rings 212 and 214 is separated, both of the end portions of the opening-closing member 240 are first brought into a state in which they are substantially parallel to each other in plan view. Then, both of the end portions of the opening-closing member 240 are bent in directions for separating them slightly from each other and then are brought into a substantially parallel state. In this state, the opening-closing member 240 urges the first and second operating pieces 230 and 232 to thereby release the first and second ring halves 212*a* and 212*b* from each other and the third and fourth ring halves 214*a* and 214*b* from each other.

The opening-closing member-securing portions 236*b* and 238*b* protrude toward the center of the gap portions 236*a* and 238*a*, respectively, so as to align along the linear abutting edges 230*a* and 232*a*, respectively, and have a thickness and length suitable for being inserted into a through hole formed inside the coil portion 244 of the opening-closing member 240.

The supporting portions 236*c* and 238*c* are fine holes extending in the respective longitudinal directions of the first and second operating pieces 230 and 232, respectively, (an $O_1$ direction for the first operating piece 230 and an $O_2$ direction for the second operating piece 232 (see FIG. 37)). Furthermore, the supporting portions 236*c* and 238*c* are provided so as to be continuous with insertion holes 236*d* and 238*d*, respectively, for inserting the securing end portions 242*a* and 242*b* from one principal surface of the first and second operating pieces 230 and 232, respectively, toward the other principal surface.

As shown in FIG. 36(A), the one securing end portion 242*a* is substantially parallel to the other securing end portion 242*b* in an original state. However, the securing end portions 242*a* and 242*b* are extended in a direction substantially perpendicular to the longitudinal direction of the first and second operating pieces 230 and 232, respectively. In other words, the securing end portions 242*a* and 242*b* are extended in a direction substantially perpendicular to the line ($X_1$ shown in FIG. 37) connecting the portion for securing the first ring half 212*a* and the portion for securing the third ring half 214*a* on the first operating piece 230 and in a direction substantially perpendicular to the line ($X_2$ shown in FIG. 37) connecting the portion for securing the second ring half 212*b* and the portion for securing the fourth ring half 214*b* on the second operating piece 232, respectively.

Furthermore, when the opening-closing member 240 starts opening, the securing end portion 242*a* (in particular, the securing portion 246*a*) and the securing end portion 242*b* (in particular the securing portion 246*b*), which are originally substantially parallel and close to each other, are separated slightly from each other as shown in FIG. 41. Thus, the securing end portion 242*a* is engaged with the second operating piece 232, and the securing end portion 242*b* is engaged with the first operating piece 230, thereby generating a twisted state.

The securing end portion 242*a* is extended from the side of the gap portion 238*a* of the second operating piece 232 through the underside of the opening-closing member-securing portion 238*b* and reaches the topside of the supporting portion 236*c* from the underside of the first operating piece 230.

The securing end portion 242*b* is extended from the side of the gap portion 236*a* of the first operating piece 230 through the underside of the opening-closing member-securing portion 236*b* and reaches the topside of the supporting portion 238*c* from the underside of the second operating piece 232.

Therefore, the securing end portion 242*a* is easily attached to the first operating piece 230 and functions to rotate and open the first operating piece 230 with a strong force acting downwardly. Furthermore, the securing end portion 242*b* is easily attached to the second operating piece 232 and functions to rotate and open the second operating piece 232 with a strong force acting downwardly.

When the first and second binding rings 212 and 214 start being opened with a hand, i.e., when the binding ring-engaging portions 250 of each of the first and second binding rings 212 and 214 are disengaged, the elasticity of the opening-closing member 240 causes the first and second operating pieces 230 and 232 defining the operating member 218 to move in directions which cause the first and second ring halves 212*a* and 212*b* of the first binding ring 212 to be separated from each other (the first ring half 212*a* to move in the $O_1$ direction and the second ring half 212*b* to move in the $O_2$ direction (see FIG. 37)) and which cause the third and fourth ring halves 214*a* and 214*b* of the second binding ring 214 to be separated from each other (the third ring half 214*a* to move in the $O_1$ direction and the fourth ring half 214*b* to move in the $O_2$ direction (see FIG. 37)). At this time, the twisted opening-closing member 240 attempts to return to the original state and thus acts to separate the first and second ring halves 212*a* and 212*b* and the third and fourth ring halves 214*a* and 214*b* in the circumferential direction of the coil portion 244 (an $O_3$ direction for first and third ring halves 212*a* and 214*a* and an $O_4$ direction for the second and fourth ring halves 212*b* and 214*b*).

That is, the elasticity of the opening-closing member 240 causes the first operating piece 230 to move in the direction for disengaging the binding ring-engaging portions 250 (the $O_1$ direction) and causes the second operating piece 232 to move in the direction for disengaging the binding ring-engaging portions 250 (the $O_2$ direction).

Then, the elasticity of the opening-closing member 240 causes the first operating piece 230 defining the operating member 218 to move in a direction toward a position for closing the binding ring-engaging portions 250 (the direction opposite to $O_1$) and causes the second operating piece 232 to move in a direction toward a position for closing the binding ring-engaging portions 250 (the direction opposite to $O_2$).

Specifically, the V-shaped state of the first and second operating pieces 230 and 232 is gradually changed to the planar state (the neutral state), and the planar state (the neutral state) is changed to the inverted V-state. The first and second binding rings 212 and 214 rotate in respective opening directions (the $O_3$ direction for the first and third ring halves 212*a* and 214*a*, and the $O_4$ direction for the second and fourth ring halves 212*b* and 214*b*) and are opened.

In a state in which the first and second binding rings 212 and 214 are opened, the opening-closing member 240 acts to hold the abutting edge 230*a* of the first operating piece 230 and the abutting edge 232*a* of the second operating piece 232 in the inverted V-shaped state, i.e., in a state in which the abutting edges 230*a* and 232*a* are brought close to the inner surface of the bound object-mounting portion 222 of the holding member 216.

The bound object-mounting portion 222 of the holding member 216 includes a bulging portion 222*a* which extends in the longitudinal direction of the bound object-mounting portion 222. The bulging portion 222*a* is configured to extend in the longitudinal direction of the bound object-mounting portion 222 so as to prevent the engaging portions 230*d*, 230*e*, 232*d*, and 232*e* and the opening-closing member 240 moves upwardly from abutting against the inner surface of the bound object-mounting portion 222 when the engaging portions 230*d* and 232*e* and the engaging portions 230*e* and 232*d* rotate upwardly and the opening-closing member 240 moves upwardly.

The first binding ring 212 includes the first and second ring halves 212*a* and 212*b* each having a semicircular arc shape so as to form a substantially annular shape, and the second binding ring 214 includes the third and fourth ring halves 214*a* and 214*b* each having a semicircular arc shape so as to form a substantially annular shape. Furthermore, the binding ring-engaging portion 250 is provided at the end of the first and second ring halves 212*a* and 212*b* and at the end of the third and fourth ring halves 214*a* and 214*b*, i.e., at the top portion of each of the first and second binding rings 212 and 214, in order to allow sheets S to be bound by inserting the ring halves into binding holes provided in the sheets S in advance.

The first and second binding rings 212 and 214 defining the binding rings may be formed by widening a metal-made wire rod having a circular cross-section in a direction for disengaging the binding ring-engaging portions 250 ($O_1$ and $O_2$ directions of FIG. 37) and by pressing the central portion of the wire rod to bend in a direction for closing the binding rings. Each of the first and second binding rings 212 and 214 is formed into a shape having a substantially bean-shaped cross-section. In the substantially bean-shaped cross-section, the central portion thereof protrudes in a direction for opening the binding ring (the $O_3$ direction in FIG. 37 for the first and third ring halves 212*a* and 214*a* and the $O_4$ direction in FIG. 37 for the second and fourth ring halves 212*b* and 214*b*), and the both edges thereof are bent in a direction for closing the binding ring.

Specifically, when the annular first and second binding rings 212 and 214 are viewed from the opening-closing direction, a wavy surface is provided on the inner side of the first and second binding rings 212 and 214, and the outer side of the first and second binding rings 212 and 214 has a semicircular arc shape. Furthermore, as viewed from a direction for disengaging the binding rings, each of the first and second binding rings 212 and 214 has opposite outside edges having a semicircular arc shape.

Conventional binding rings having a circular cross-section do not resist deformation when the diameter is small. When the diameter is increased, the cross-sectional area increases which increases the cost for the material therefor. Furthermore, since binding holes in sheets are usually circular holes, conventional binding rings having a substantially rectangular cross-section are not well suited for the binding holes of the sheets and are likely to damage the binding holes of the sheets.

Meanwhile, when the first and second binding rings 212 and 214 defining the binding rings are thin, the binding ring-engaging portions 250 may not be securely fitted with each other.

Thus, it is desirable to increase the width of the first and second binding rings 212 and 214. However, even when a wire rod having a small cross-sectional area is used as a raw wire rod, it is desirable to ensure a required width for a binding ring by machining the raw metal-made wire rod.

Therefore, in the binding rings according to the present invention, the central portion of a wire rod for forming the binding rings is pressed to deform the wire rod into a bean-like shape, whereby the width as a whole is increased. That is, the binding rings are formed such that the entire width of the binding rings is increased in a direction for disengaging the binding ring-engaging portions 250, whereby the binding ring-engaging portions 250 can be completely engaged with each other.

In this preferred embodiment, the first and second ring halves 212*a* and 212*b* defining the first binding ring 212 and the third and fourth ring halves 214*a* and 214*b* defining the second binding ring 214 have substantially the same shape, i.e., substantially the same curvature (radius of curvature).

The first and second ring halves 212*a* and 212*b* defining the first binding ring 212 are annularly connected by engaging the binding ring-engaging portion 250 on a free end of the first ring half 212*a* with the binding ring-engaging portion 250 on a free end of the second ring half 212*b*.

Furthermore, the third and fourth ring halves 214*a* and 214*b* defining the second binding ring 214 are annularly connected by engaging the binding ring-engaging portion 250 on a free end of the third ring half 214*a* with the binding ring-engaging portion 250 on a free end of the fourth ring half 214*b*.

The first and second binding rings 212 and 214 stand on the first and second operating pieces 230 and 232 so as to form a plane substantially perpendicular to the plane $P_{xy}$ including the left-right axes $Y_1$ and $Y_2$ and the front-rear axes $X_1$ and $X_2$ (shown in FIG. 37) and passing portions on the first and second operating pieces 230 and 232, i.e., four portions to each of which one of the base portions of the first binding ring 212 or the second binding ring 214 is secured. Furthermore, in this configuration, a circular surface defined by an axis $Z_1$ (shown in FIG. 37) of the first binding ring 212 is substantially parallel to a circular surface defined by an axis $Z_2$ (shown in FIG. 37) of the second binding ring 214, and these circular surfaces are perpendicular to the plane $P_{xy}$ passing the portions at which the first and second binding rings 212 and 214 are secured to the first and second operating pieces 230 and 232.

As shown in FIGS. 46 to 51, the binding rings include the first binding ring 212 functioning as the main binding ring which is closed directly with fingers and the second binding ring 214 functioning as the subsidiary binding ring which follows the motion of the first binding ring 212 in a closing direction.

Furthermore, the first and second binding rings 212 and 214 are configured such that the binding ring-engaging portions 250 thereof can be disengaged with fingers in the same direction (the $O_1$ and $O_2$ directions in FIG. 41).

The binding ring-engaging portion 250 provided at the end of the first ring half 212*a* defining the first binding ring 212 includes a projection 252*a* at the end portion of the binding ring-engaging portion 250 and a recess 252*b* following the projection 252*a*. Furthermore, the binding ring-engaging portion 250 of the second ring half 212*b* includes a projection 254*a* at the end of the binding ring-engaging portion 250 and a recess 254*b* following the projection 254*a*. The projections 252*a* and 254*a* and the recesses 252*b* and 254*b* are configured so as to be protruded or recessed in mutually opposite directions, so that they are engaged with each other when the first binding ring 212 is closed.

The projections 252*a* and 254*a* include inclined facing surfaces 252*c* and 254*c*, respectively, each having a convex curved surface extending from the end portion toward the inside and with inclined facing surfaces 252*d* and 254*d*, respectively, which are continuous with the inclined facing surfaces 252*c* and 254*c*, respectively, and gradually extend from the rear end portion (the base side) of the projections 252*a* and 254*a*, respectively, to the tip end side (a closing direction). The vicinity of the rear end of each of the projections 252*a* and 254*a* has a hook-like shape, and each of the projections 252*a* and 254*a* as a whole is formed into a hooked nose-like shape.

The recess 252*b* is provided with an inclined facing surface having a concave curved surface extending from the base portion side toward the tip end portion. Similarly, the recess 254*b* is provided with an inclined facing surface having a concave curved surface extending from the base portion side toward the tip end portion.

Moreover, the binding ring-engaging portion 250 provided at the end of the third ring half 214*a* defining the second binding ring 214 includes a projection 256*a* and a recess 256*b* following the projection 256*a*. Furthermore, the binding ring-engaging portion 250 of the fourth ring half 214*b* includes a projection 258*a* at the end of the binding ring-engaging portion 250 and a recess 258*b* following the projection 258*a*. The projections 256*a* and 258*a* and the recesses 256*b* and 258*b* are configured so as to be protruded or recessed in mutually opposite directions, so that they are engaged with each other when the second binding ring 214 is closed.

The projections 256*a* and 258*a* include inclined facing surfaces 256*c* and 258*c*, respectively, each having a convex curved surface extending from the end portion toward the inside and with inclined facing surfaces 256*d* and 258*d*, respectively, which are continuous with the inclined facing surfaces 256*c* and 258*c*, respectively, and gradually extend from the rear end portion (the base side) of the projections 256*a* and 258*a*, respectively, to the tip end portion (a closing direction). The vicinity of the rear end of each of the projections 256*a* and 258*a* has a hook-like shape, and each of the projections 256*a* and 258*a* as a whole is formed into a hooked nose-like shape.

The recess 256*b* is provided with an inclined facing surface having a concave curved surface extending from the base portion side toward the tip end portion. Similarly, the recess 258*b* is provided with an inclined facing surface having a concave curved surface extending from the base portion side toward the tip end portion.

The projection 252*a* defining the binding ring-engaging portion 250 of the first ring half 212*a* and the projection 256*a* defining the binding ring-engaging portion 250 of the third ring half 214*a* are configured so as to protrude in the same direction. Furthermore, these projections 252*a* and 256*a* are provided with a convex curved surface configured to extend from the tip end to the base side and are configured into substantially the same shape.

The recess 252*b* defining the binding ring-engaging portion 250 of the first ring half 212*a* and the recess 256*b* defining the binding ring-engaging portion 250 of the third ring half 214*a* are configured so as to be recessed in the same direction. Furthermore, these recesses 252*b* and 256*b* are provided with a concave curved surface configured to extend from the rear end of the projections 252*a* and 256*a* to the base side and configured substantially into the same shape.

The projection 254*a* defining the binding ring-engaging portion 250 of the second ring half 212*b* and the projection 258*a* defining the binding ring-engaging portion 250 of the fourth ring half 214*b* are configured so as to protrude in the same direction. Furthermore, these projections 254*a* and 258*a* are provided with a convex curved surface configured to extend from the tip end to the base side and are configured into substantially the same shape.

The recess 254*b* defining the binding ring-engaging portion 250 of the second ring half 212*b* and the recess 258*b* defining the binding ring-engaging portion 250 of the fourth ring half 214*b* are configured so as to be recessed in the same direction. Furthermore, these recesses 254*b* and 258*b* are provided with a concave curved surface configured to extend from the rear end of the projections 254*a* and 258*a* to the base side and configured into substantially the same shape.

The projection 252*a* and the recess 252*b* of the first ring half 212*a* and the projection 254*a* and the recess 254*b* of the second ring half 212*b* are arranged so as to be symmetric with respect to a point, and the projection 256*a* and the recess 256*b* of the third ring half 214*a* and the projection 258*a* and the recess 258*b* of the projection 256*a* are arranged so as to be symmetric with respect to a point.

The inclined facing surface 252*c* of the projection 252*a* of the first binding ring 212 and the inclined facing surface of the recess 254*b* are arranged so as to obliquely intersect the direction of the axis of the first binding ring 212. When the first binding ring 212 is opened or closed, the inclined facing surface 252*c* and the inclined facing surface of the recess 254*b* come into contact with each other in an inscribed relation with one point shared thereby.

The inclined facing surface 252*c* of the projection 252*a* of the first binding ring 212 and the inclined facing surface 254*c* of the projection 254*a* are arranged so as to obliquely intersect the direction of the axis of the first binding ring 212. When the first binding ring 212 is opened or closed, the inclined facing surfaces 252*c* and 254*c* come into contact with each other in a circumscribed relation with one point shared thereby.

The inclined facing surface 256*c* of the projection 256*a* of the second binding ring 214 and the inclined facing surface of the recess 258*b* are arranged so as to obliquely intersect the direction of the axis of the second binding ring 214. When the second binding ring 214 is opened or closed, the inclined facing surface 256*c* and the inclined facing surface of the recess 258*b* come into contact with each other in an inscribed relation with one point shared thereby.

The inclined facing surface 256*c* of the projection 256*a* of the second binding ring 214 and the inclined facing surface 258*c* of the projection 258*a* are arranged so as to obliquely intersect the direction of the axis of the second binding ring 214. When the second binding ring 214 is opened or closed, the inclined facing surfaces 256*c* and 258*c* come into contact with each other in a circumscribed relation with one point shared thereby.

Figure 49:
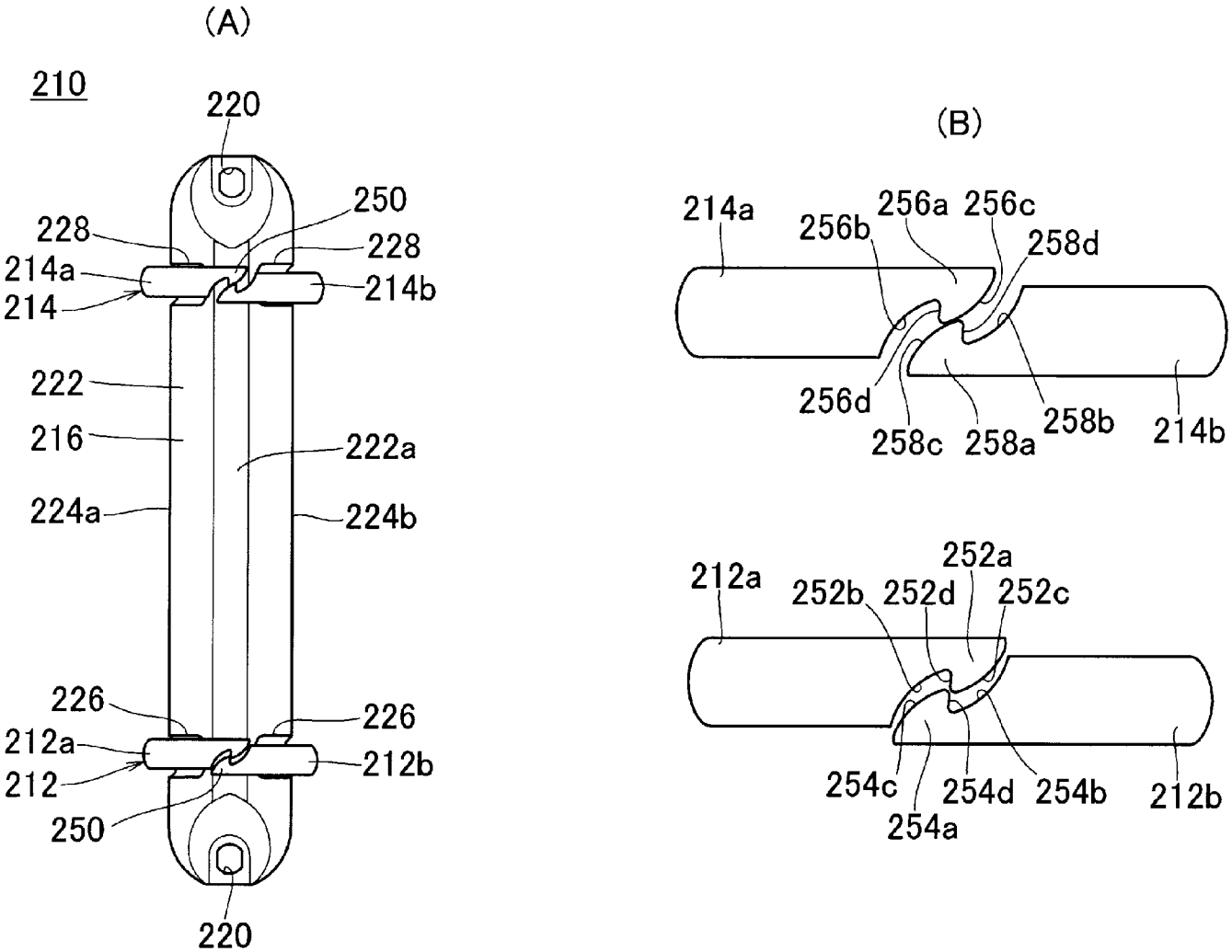
FIGS. 49(A) and 49(B) are schematic views of the binding rings, illustrating the state in which the binding rings are being closed.
Figure 50:
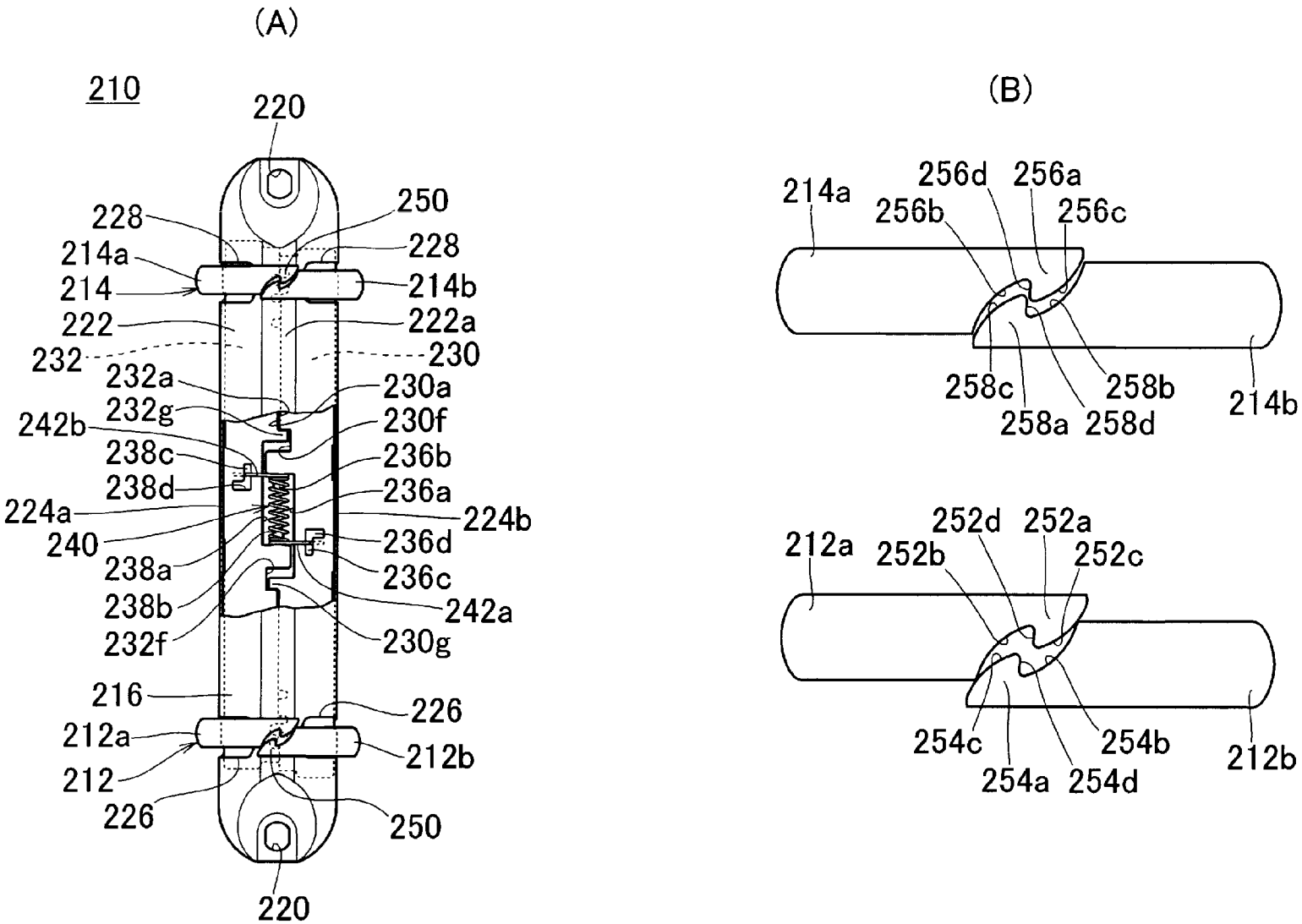
FIGS. 50(A) and 50(B) are schematic views of the binding rings, illustrating the state in which the binding rings are being closed.
Figure 51:
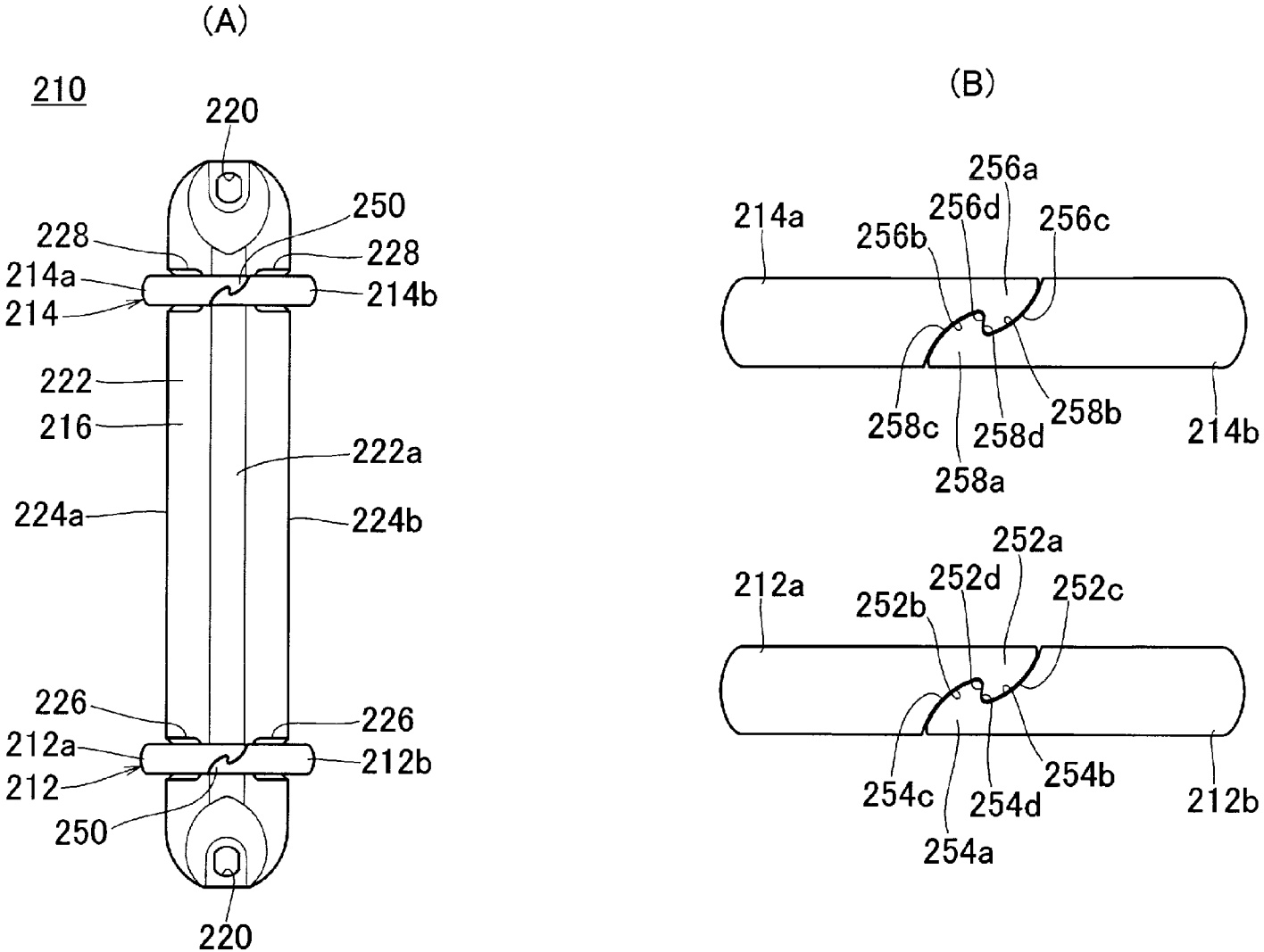
FIGS. 51(A) and 51(B) are schematic views of the binding rings, illustrating the state in which the binding rings are being closed.
Figure 52:
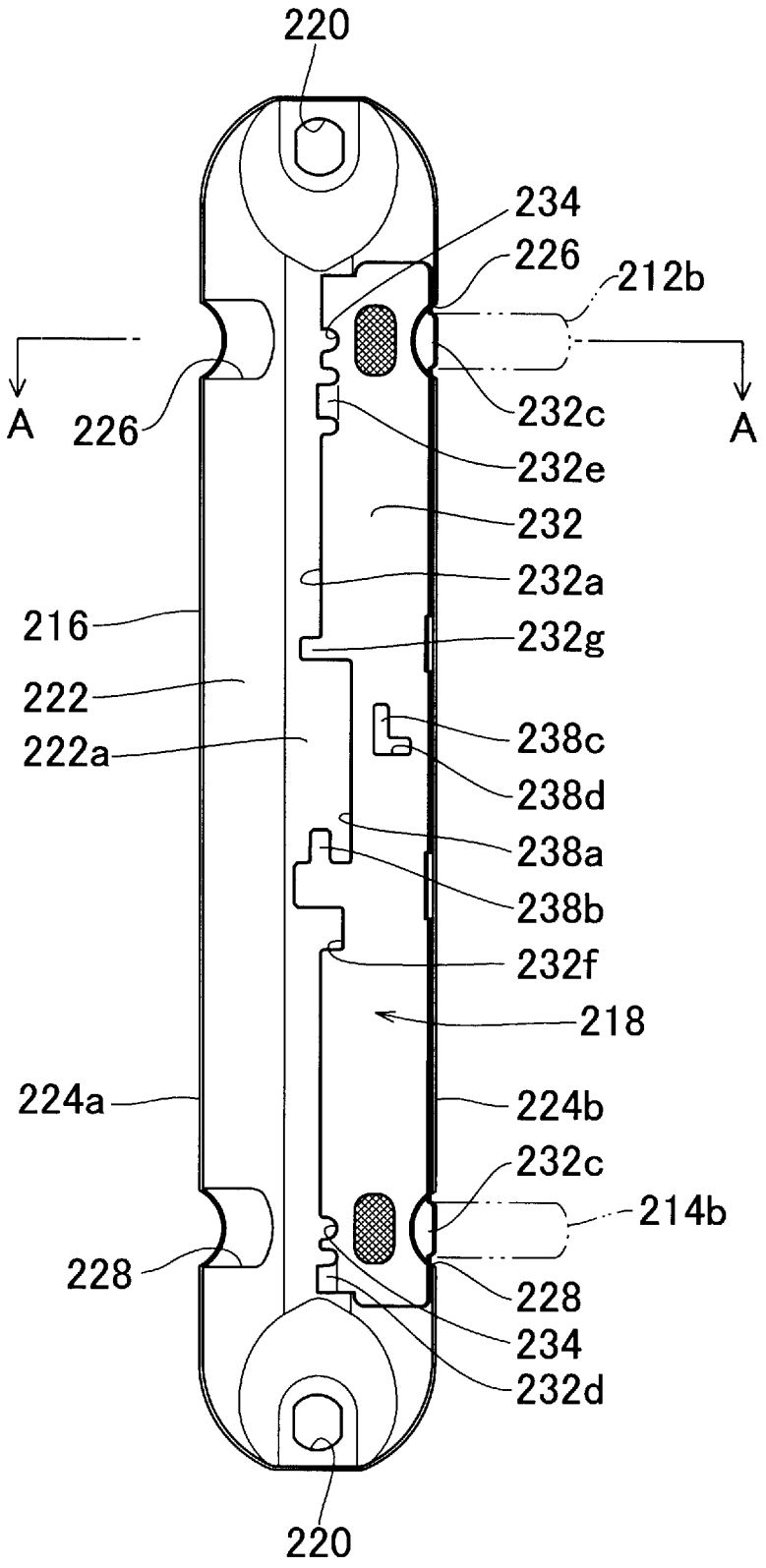
FIG. 52 is a bottom view illustrating the manner of attaching the operating member.
Figure 53:
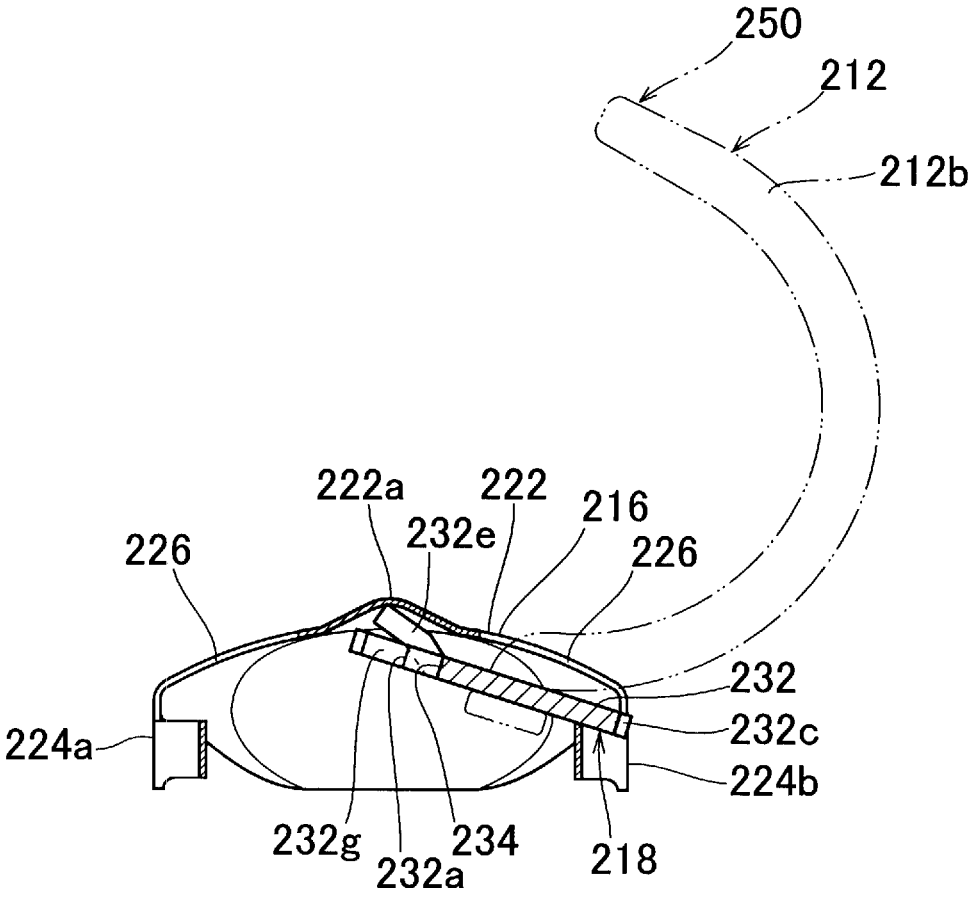
FIG. 53 is a cross-sectional side view illustrating the manner of attaching the operating member.
Figure 54:
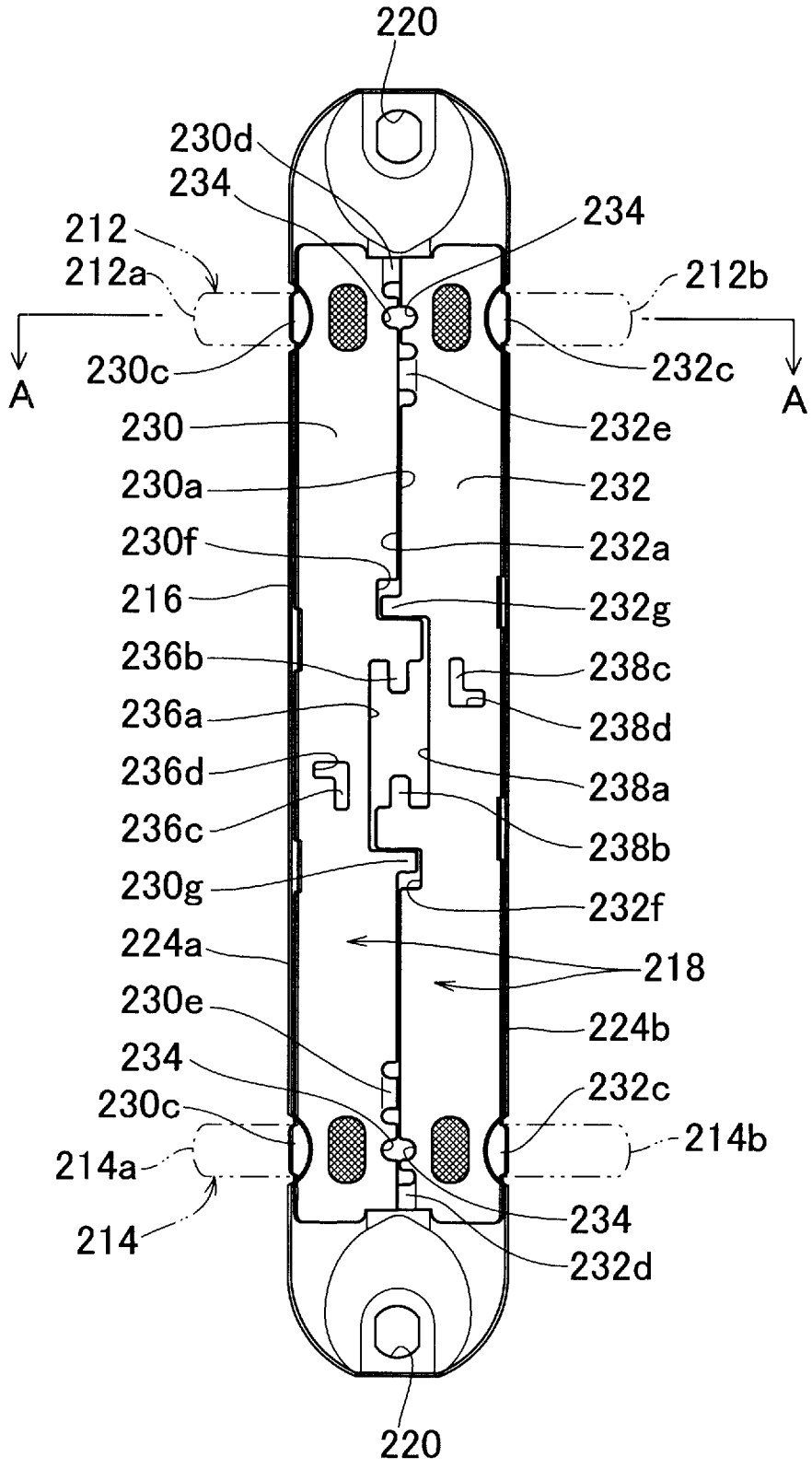
FIG. 54 is a bottom view illustrating the manner of attaching the operating member.
Figure 55:
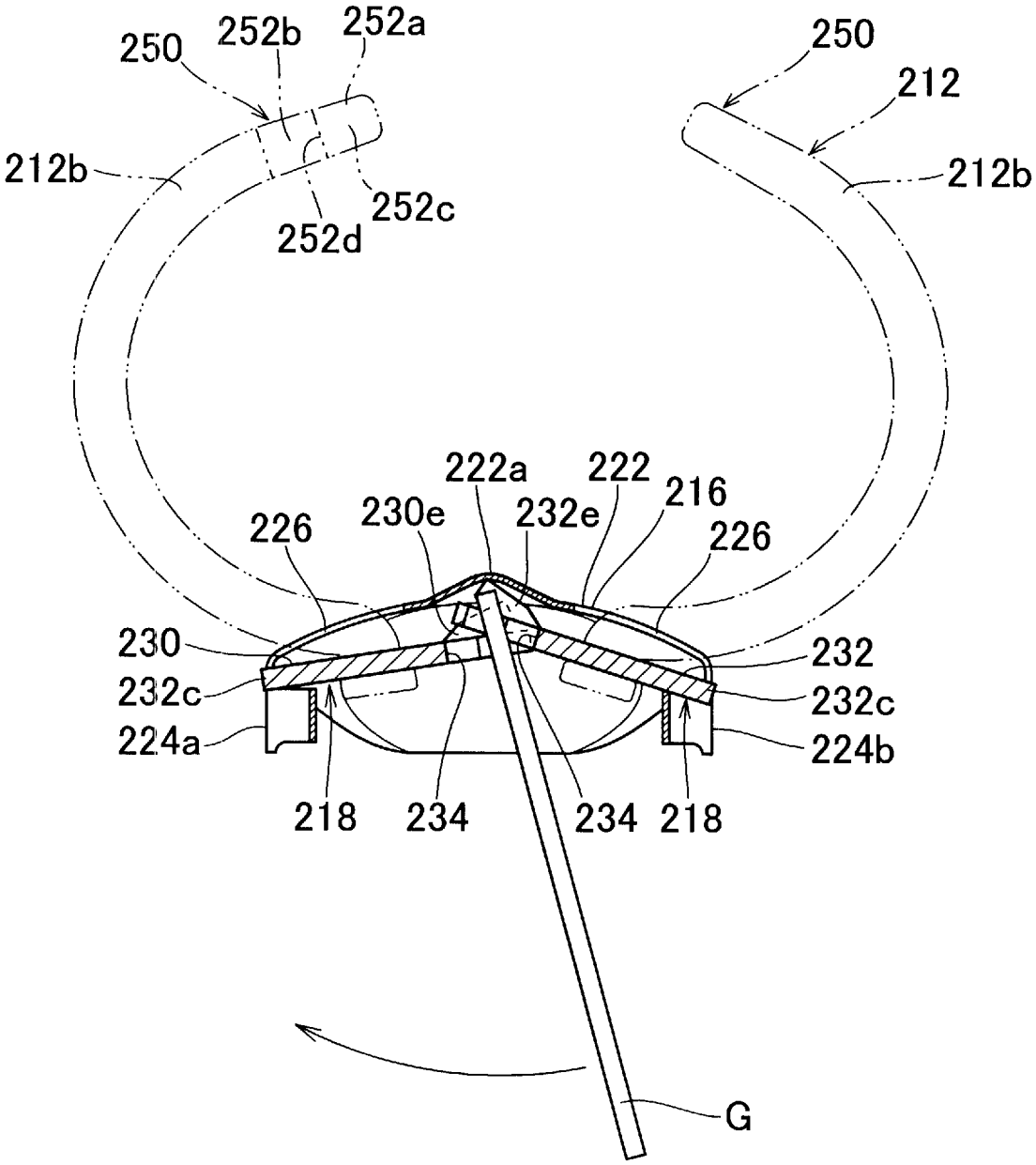
FIG. 55 is a schematic cross-sectional side view illustrating the manner of attaching operating pieces.
Figure 56:
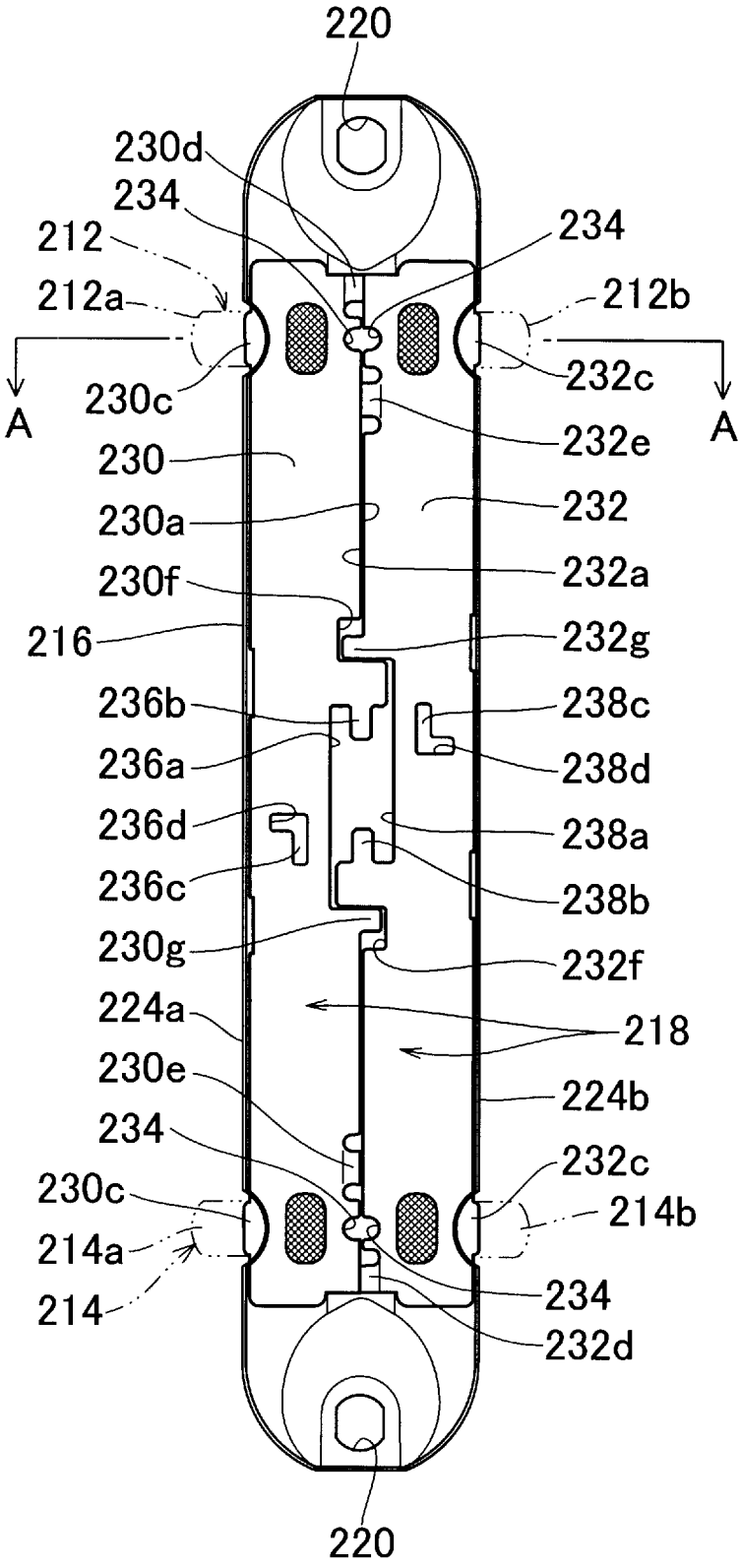
FIG. 56 is a bottom view illustrating the manner of attaching the operating pieces.
Figure 57:
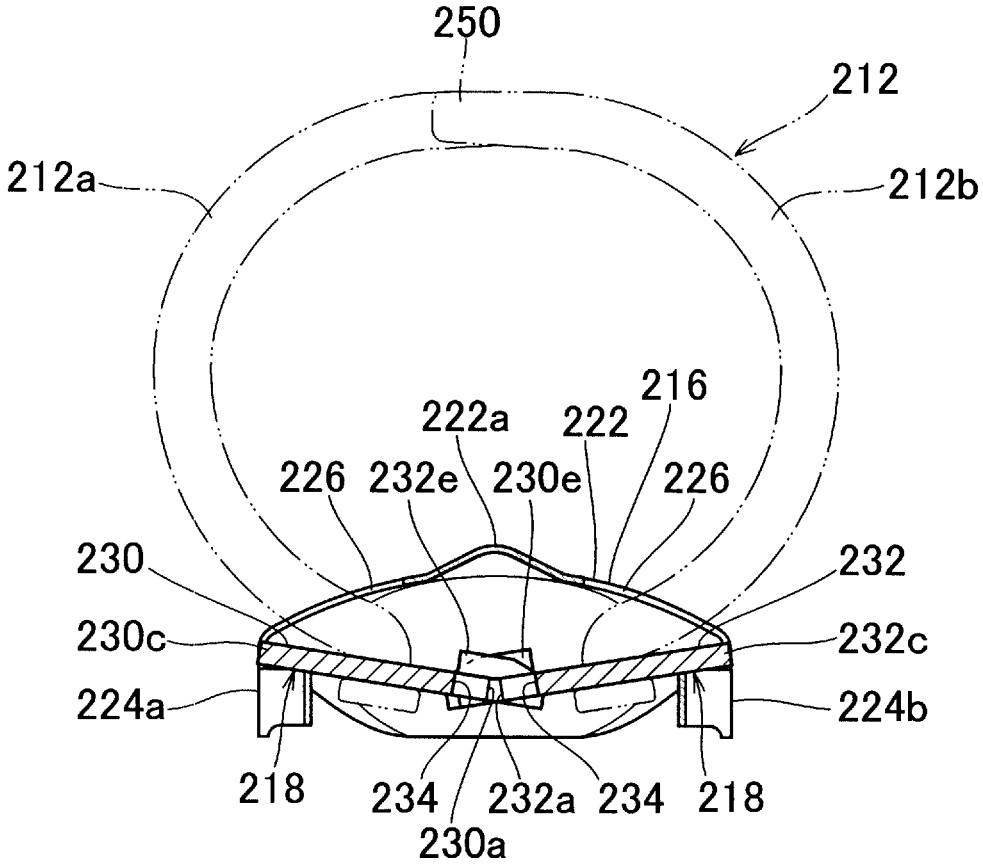
FIG. 57 is a cross-sectional side view illustrating the manner of attaching the operating pieces.

When the first binding ring 212 functioning as the main binding ring is held with two fingers to start closing the binding rings, the projection 252*a* of the first ring half 212*a* of the first binding ring 212 and the projection 254*a* of the second ring half 212*b* of the first binding ring 212 abut against each other before the projection 256*a* of the third ring half 214*a* of the second binding ring 214 and the recess 258*b* of the fourth ring half 214*b* of the second binding ring 214 abut against each other (see FIG. 49). Furthermore, by operating the first binding ring 212 so as to be closed, the recess 252*b* of the first ring half 212*a* of the first binding ring 212 slides on the projection 254*a* of the second ring half 212*b*. Then, the projection 252*a* of the first ring half 212*a* of the first binding ring 212 moves past a normal engagement position where the projection 252*a* fits into the recess 254*b* of the second ring half 212*b*, and the projection 252*a* of the first ring half 212*a* slides upward on the inclined facing surface of the recess 254*b* of the second ring half 212*b* (see FIG. 50).

Thus, by operating the first binding ring 212 in the closing direction, the projection 256*a* of the third ring half 214*a* of the second binding ring 214 abuts against the projection 258*a* of the fourth ring half 214*b* of the second binding ring 214. Furthermore, by operating the first binding ring 212 so as to be closed, the projection 256*a* of the third ring half 214*a* of the second binding ring 214 slides on the inclined facing surface 258*c* of the projection 258*a* of the fourth ring half 214*b* (see FIG. 49). Furthermore, the projection 252*a* of the first ring half 212*a* of the first binding ring 212 slides upward on the inclined facing surface of the recess 254*b* of the second ring half 212*b*. Then, the projection 256*a* of the third ring half 214*a* of the second binding ring 214 (the projection 258*a* of the fourth ring half 214*b*) fits into the recess 258*b* of the fourth ring half 214*b* (the recess 256*b* of the third ring half 214*a*) (see FIG. 50).

Thereafter, the fingers are removed from the first binding ring 212 to release the closing force. Then, the action of the opening-closing member 240 causes the first binding ring 212 to return slightly in the opening direction. Thus, in the first binding ring 212 as in the second binding ring 214, the projection 252*a* of the first ring half 212*a* (the projection 254*a* of the second ring half 212*b*) fits into the recess 254*b* of the second ring half 212*b* (the recess 252*b* of the first ring half 212*a*) (see FIG. 51).

When the binding rings are closed, the inverted V-shaped state (see FIG. 45) of the first and second operating pieces 230 and 232 is gradually changed to the planar state (neutral state), and the planar state (neutral state) is changed to the V-shaped state (see FIG. 40). At this time, the first and second operating pieces 230 and 232 in a regularly arranged state are temporarily moved in the respective directions for disengaging the binding ring-engaging portions 250 (the $O_1$ direction for the first operating piece 230 and the $O_2$ direction for the second operating piece 232) and thus are arranged in a staggered state (see FIG. 50). Subsequently, the first and second operating pieces 230 and 232 are moved back and arranged regularly.

Thus, the restricting projection 230*g* of the first operating piece 230 defining the movement restricting portion is moved inside the restricting recess 232*f* of the second operating piece 232 and abuts on an edge of the restricting recess 232*f*, the edge being on the side opposite to the direction for disengaging the binding ring-engaging portions 250. In addition, the restricting projection 232*g* of the second operating piece 232 defining the movement restricting portion is moved inside the restricting recess 230*f* of the first operating piece 230 and abuts on an edge of the restricting recess 230*f*, the edge being on the side opposite to the direction for disengaging the binding ring-engaging portions 250 (see FIG. 50). Therefore, when the binding rings are closed, the projection 252*a* of the first ring half 212*a* of the first binding ring 212 moves past the normal stop position where the projection 252*a* fits into the recess 254*b* of the second ring half 212*b*, and the projection 252*a* of the first ring half 212*a* slides upward on the inclined facing surface of the recess 254*b* of the second ring half 212*b*, thereby causing overrun. At this time, the overrun is stopped at an appropriate position by restricting the distance of movement of the first binding ring 212. Thus, when the fingers are removed from the binding ring-engaging portions 250 of the first binding ring 212, the restoring force of the opening-closing member 240 causes the first and second operating pieces 230 and 232 to move temporarily in the respective directions for disengaging the binding ring-engaging portions 250 (the $O_1$ direction for the first operating piece 230 and the $O_2$ direction for the second operating piece 232) and thus are arranged in a staggered state. Subsequently, the first and second operating pieces 230 and 232 arranged in the staggered state are moved back and arranged regularly, and the binding ring-engaging portions 250 fit into each other (see FIGS. 39 and 40).

Thus, when the first binding ring 212 functioning as the main binding ring starts closing, the second binding ring 214, which functions as the subsidiary binding ring and is not closed directly with fingers, starts moving in the closing direction. Furthermore, when the first binding ring 212 is closed and moves past the normal engagement position, the engagement of the second binding ring 214 progresses, and the engagement of the second binding ring 214 is completed before the engagement of the first binding ring 212 is completed. Therefore, after the second binding ring 214, which functions as the subsidiary binding ring and is not closed directly with fingers, is securely engaged, the first binding ring 212 serving as the main binding ring is securely engaged.

Therefore, when the first binding ring 212 is held with fingers to move ahead in the closing direction, and when the first binding ring 212 is held so as to cause overrun, the second binding ring 214 can be securely engaged at the normal position and can be closed by operating only the first binding ring 212.

As described above, by operating the first binding ring 212 with fingers, the second binding ring 214 can also be closed, thereby improving the usability as one-touch binding devices.

When the binding ring-engaging portions 250 of the first binding ring 212 are disengaged by twisting the top portion of the first binding ring 212 with fingers, the restoring force of the opening-closing member 240 is exerted on the first and second operating pieces 230 and 232, and thus the first binding ring 212 is opened. Here, the restoring force of the opening-closing member 240 is a force for restoring the one securing end portion 242*a* and the other securing end portion 242*b* to the original state in which they are substantially parallel to each other along the circumferential direction of the coil portion 244 as shown in FIG. 36(A).

Then, the binding ring-engaging portions 250 of the first and second binding rings 212 and 214 are disengaged (see FIG. 41), and the V-shaped state of the first and second operating pieces 230 and 232 is gradually changed to the planar state (neutral state), and the planar state is changed to the inverted V-shaped state. At this time, the first and second operating pieces 230 and 232 are moved in the respective directions for disengaging the binding ring-engaging portions 250 (the $O_1$ direction for the first operating piece 230 and the $O_2$ direction for the second operating piece 232). Thus, the restricting projection 230*g* of the first operating piece 230 defining the movement restricting portion is moved inside the restricting recess 232*f* of the second operating piece 232 and abuts on an edge of the restricting recess 232*f*, the edge being on the side opposite to the direction for disengaging the binding ring-engaging portions 250. In addition, the restricting projection 232*g* of the second operating piece 232 defining the movement restricting portion is moved inside the restricting recess 230*f* of the first operating piece 230 and abuts on an edge of the restricting recess 230*f*, the edge being on the side opposite to the direction for disengaging the binding ring-engaging portions 250.

Figure 44:
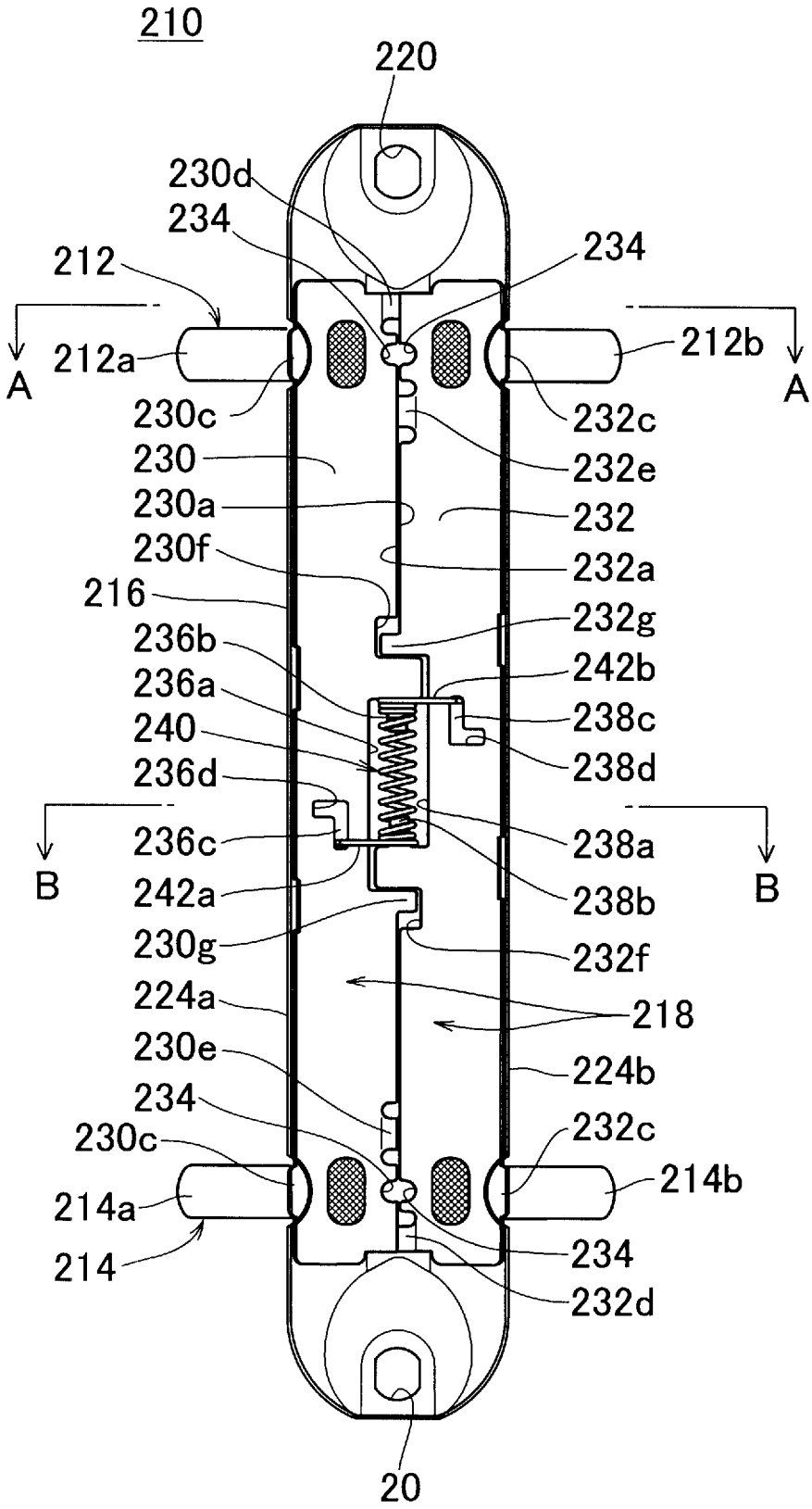
FIG. 44 is a bottom view of the binding device in the opened state.

When the hand is removed from the first binding ring 212, a force is exerted on the first and second operating pieces 230 and 232, for restoring the one securing end portion 242*a* and the other securing end portion 242*b* of the opening-closing member 240 to the original state in which they are substantially parallel to each other along the circumferential direction of the coil portion 244 as shown in FIG. 36(A). Therefore, the first and second binding rings 212 and 214 are opened further (the first and third ring halves 212*a* and 214*a* are opened in the $O_3$ direction and the second and fourth ring halves 212*b* and 214*b* are opened in the $O_4$ direction). In addition, a force for arranging the one securing end portion 242*a* and the other securing end portion 242*b* of the opening-closing member 240 substantially in parallel to each other in plan view is exerted to cause the first and second operating pieces 230 and 232 to move in directions opposite to each other (see FIG. 44).

Specifically, the operating member 218 and the opening-closing member 240 exert an action in the direction for opening the projection 256*a* of the third ring half 214*a* and the projection 258*a* of the fourth ring half 214*b* constituting the second binding ring 214, and an action in the direction for separating the projection 252*a* of the first ring half 212*a* of the first binding ring 212 from the projection 254*a* of the second ring half 212*b*. In addition, the operating member 218 and the opening-closing member 240 works such that the projection 256*a* of the third ring half 214*a* and the projection 258*a* of the fourth ring half 214*b* constituting the second binding ring 214 are separated from each other.

As described above, in this preferred embodiment, by twisting the top portion of the first binding ring 212 or the second binding ring 214 with fingers, the binding ring-engaging portions 250 of the first and second ring halves 212*a* and 212*b* of the first binding ring 212 can be disengaged, and the binding ring-engaging portions 250 of the third and fourth ring halves 214*a* and 214*b* of the second binding ring 214 can also be disengaged.

When the engagement between the binding ring-engaging portions 250 of the first and second ring halves 212*a* and 212*b* of the first binding ring 212 and the engagement between the binding ring-engaging portions 250 of the third and fourth ring halves 214*a* and 214*b* of the second binding ring 214 are released, a force is exerted on the operating member 218 to urge the one securing end portion 242*a* and the other securing end portion 242*b* of the opening-closing member 240 to come close to each other in the circumferential direction of the coil portion 244. Therefore, the abutting edge 230*a* of the first operating piece 230 and the abutting edge 232*a* of the second operating piece 232 are brought into an inverted V-shaped state.

Next, a method for mounting the operating member 218 in the holding space of the holding member 216 is described with reference to FIGS. 52 to 57.

First, the first operating piece 230 is mounted in the holding member 216, and then the second operating piece 232 is mounted in the holding member 216.

At this time, one of the protruding portions 230*c* passes through one of the first through holes 226 (the right through hole 226 in a plan view of the left-right pair of the through holes 226), and one of the protruding portions 232*c* passes through one of the second through holes 228 (the right through hole 228 in a plan view of the left-right pair of the through holes 228). The engaging portions 230*d* and 230*e* and the engaging portions 232*d* and 232*e* are positioned on the lower side of the first and second operating pieces 230 and 232, respectively, i.e., on a side opposite to the bound object-mounting portion 222 of the holding member 216.

Then, the rod-like jig G is pressed into the gap between the clearance portion 234 of the first operating piece 230 and the clearance portion 234 of the second operating piece 232 to increase the distance between the first and second operating pieces 230 and 232, and the engaging portions 230*d* and 230*e* and the engaging portions 232*d* and 232*e* are put onto the upper side of the first and second operating pieces 230 and 232, respectively, i.e., on the bound object-mounting portion 222 side of the holding member 216. Thereafter, the rod-like jig G is pulled out, whereby the abutting edges 230*a* and 232*a* are abutted against each other.

Figure 58:
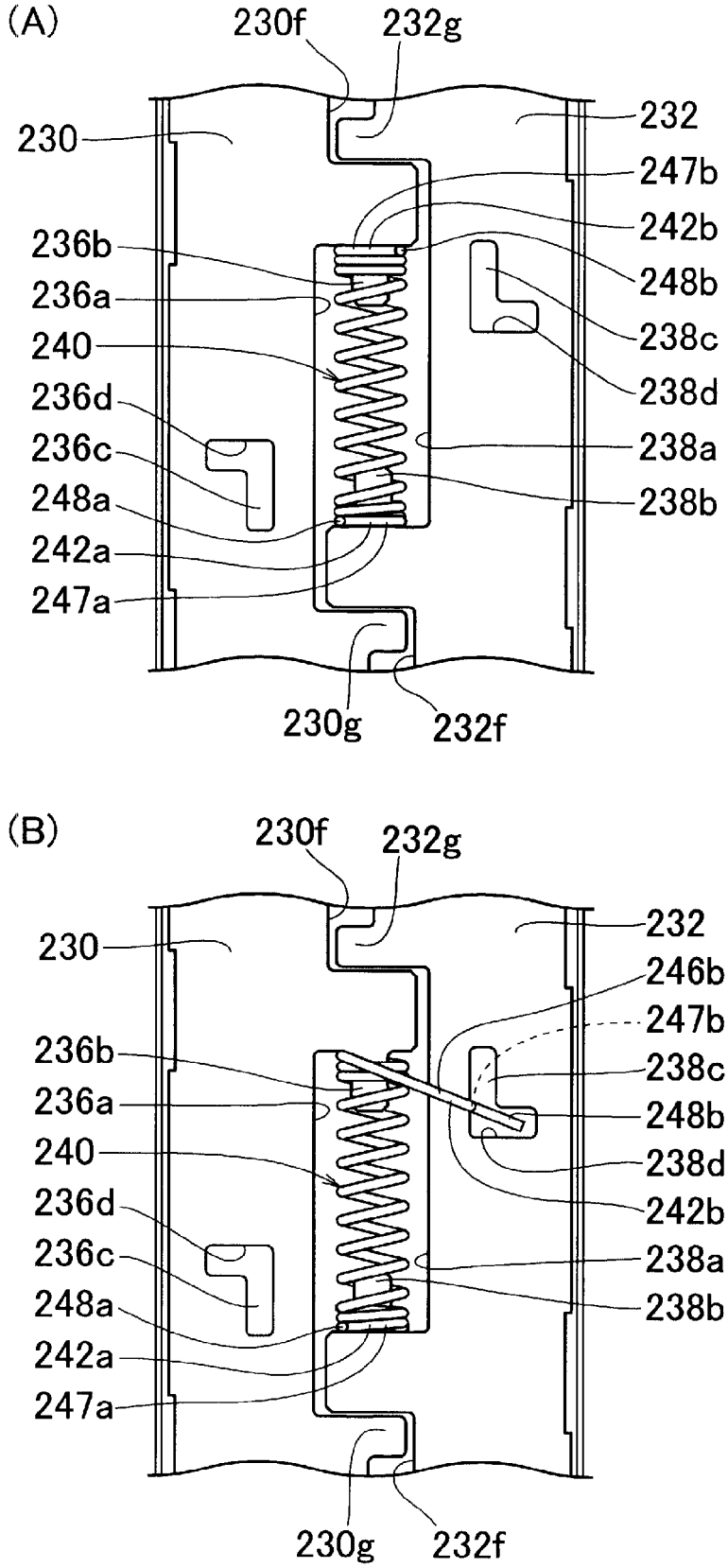
FIGS. 58(A) and 58(B) are a set of schematic bottom views illustrating the manner of attaching the opening-closing member.
Figure 59:
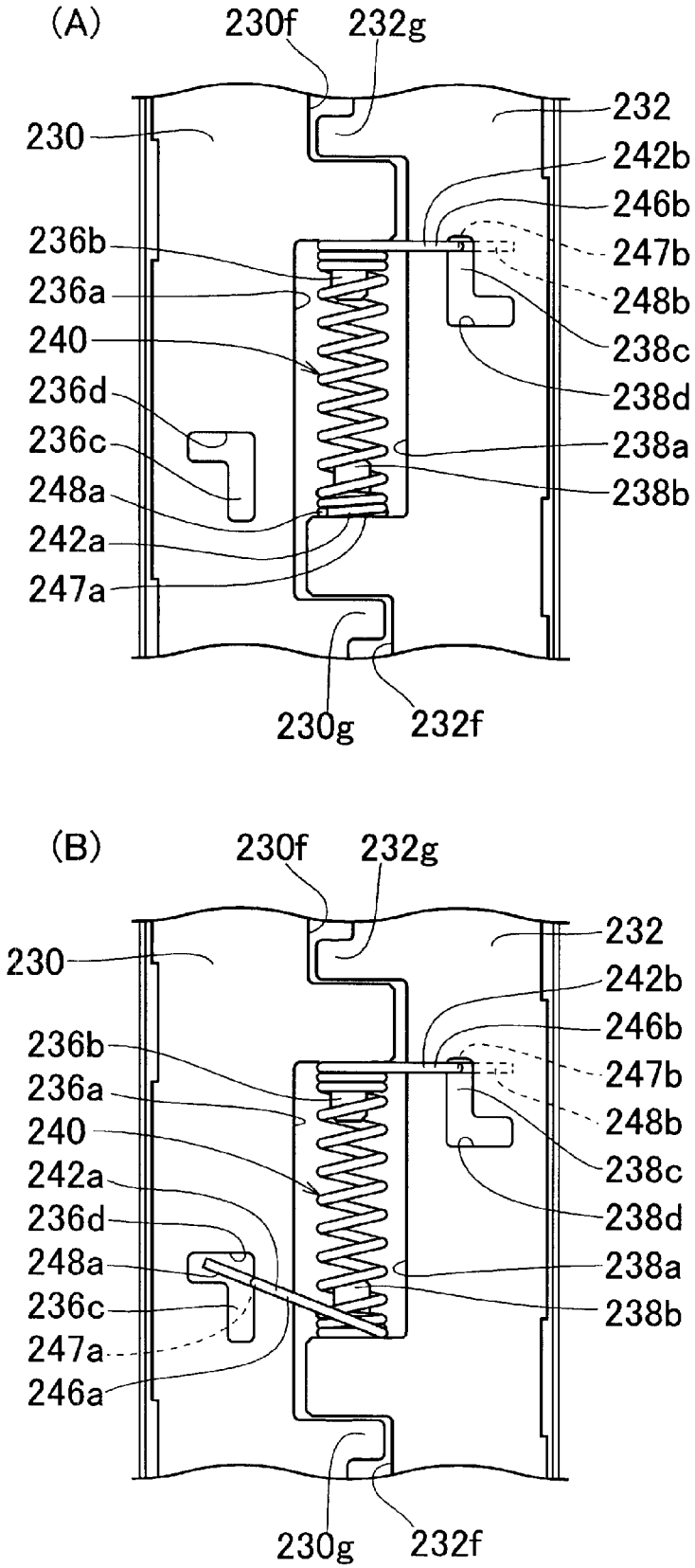
FIGS. 59(A) and 59(B) are a set of schematic bottom views illustrating the manner of attaching the opening-closing member.
Figure 60:
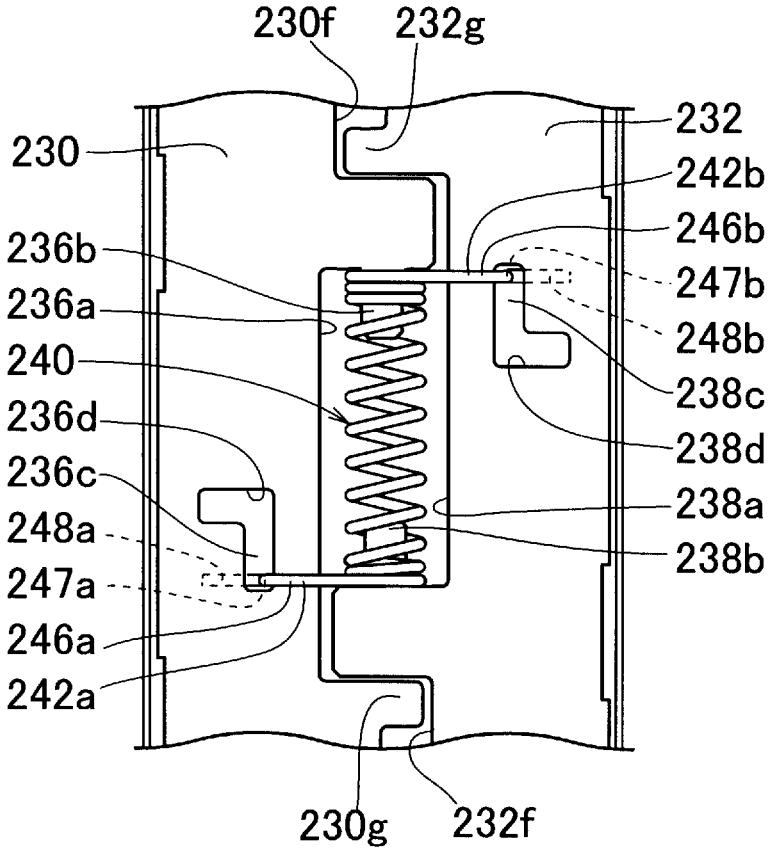
FIG. 60 is a bottom view illustrating the manner of attaching the opening-closing member.
Figure 61:
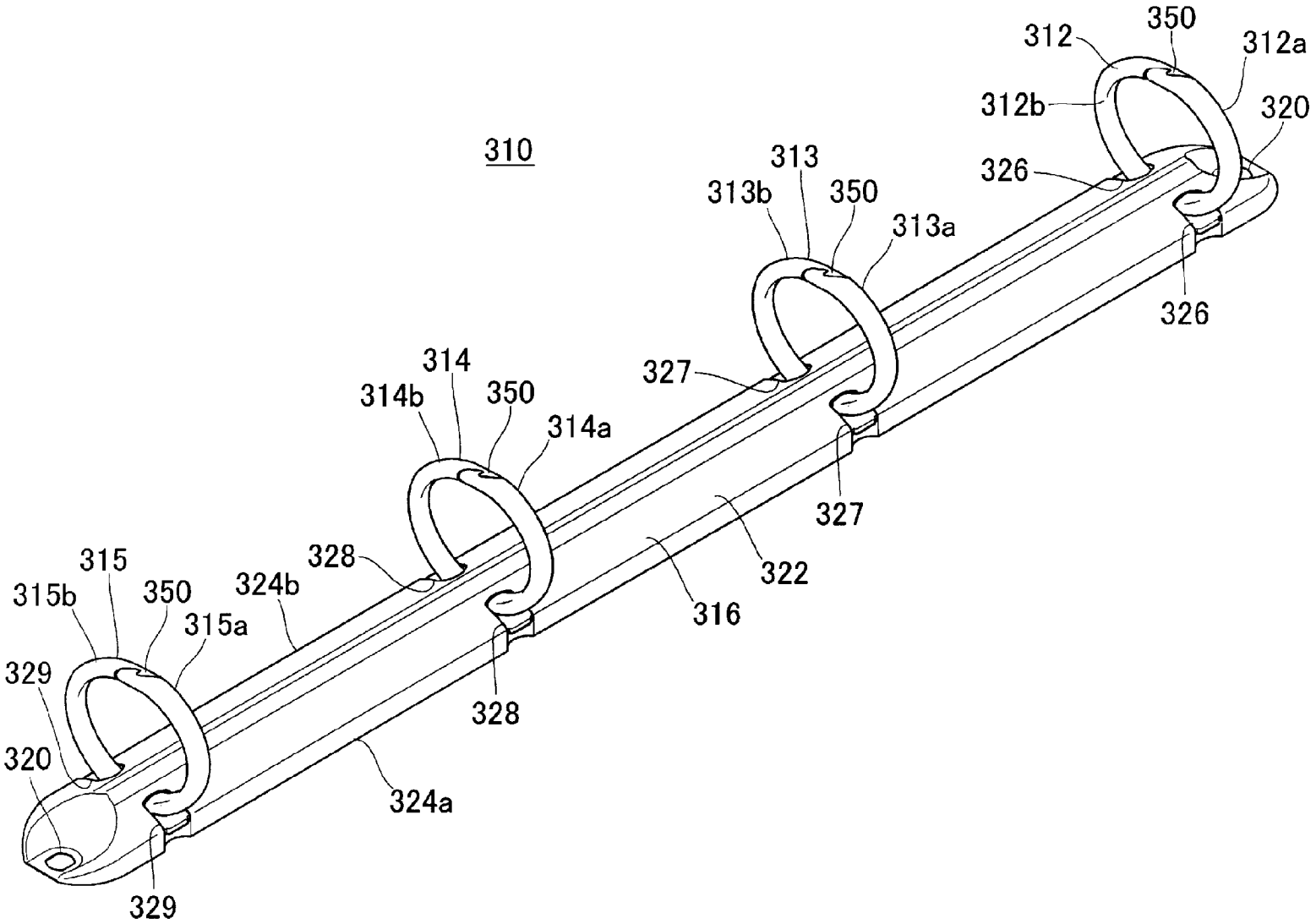
FIG. 61 is a perspective view illustrating an example of a binding device of another preferred embodiment of the present invention.
Figure 62:
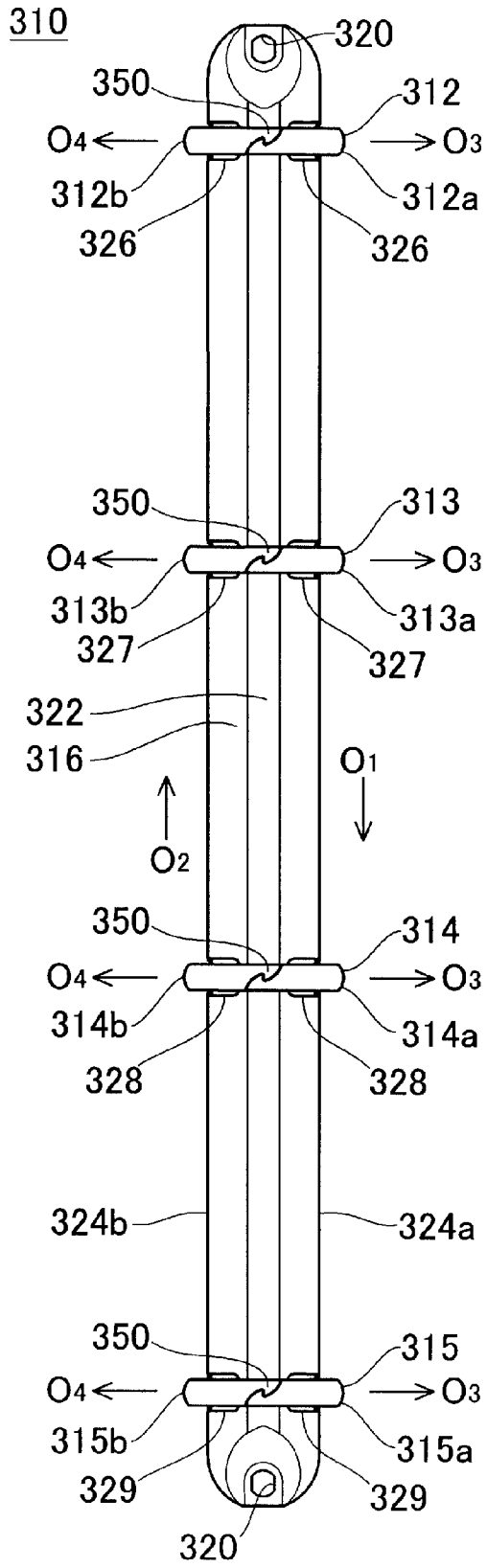
FIG. 62 is a plan view illustrating the example of the binding device of the another preferred embodiment of the present invention.
Figure 63:
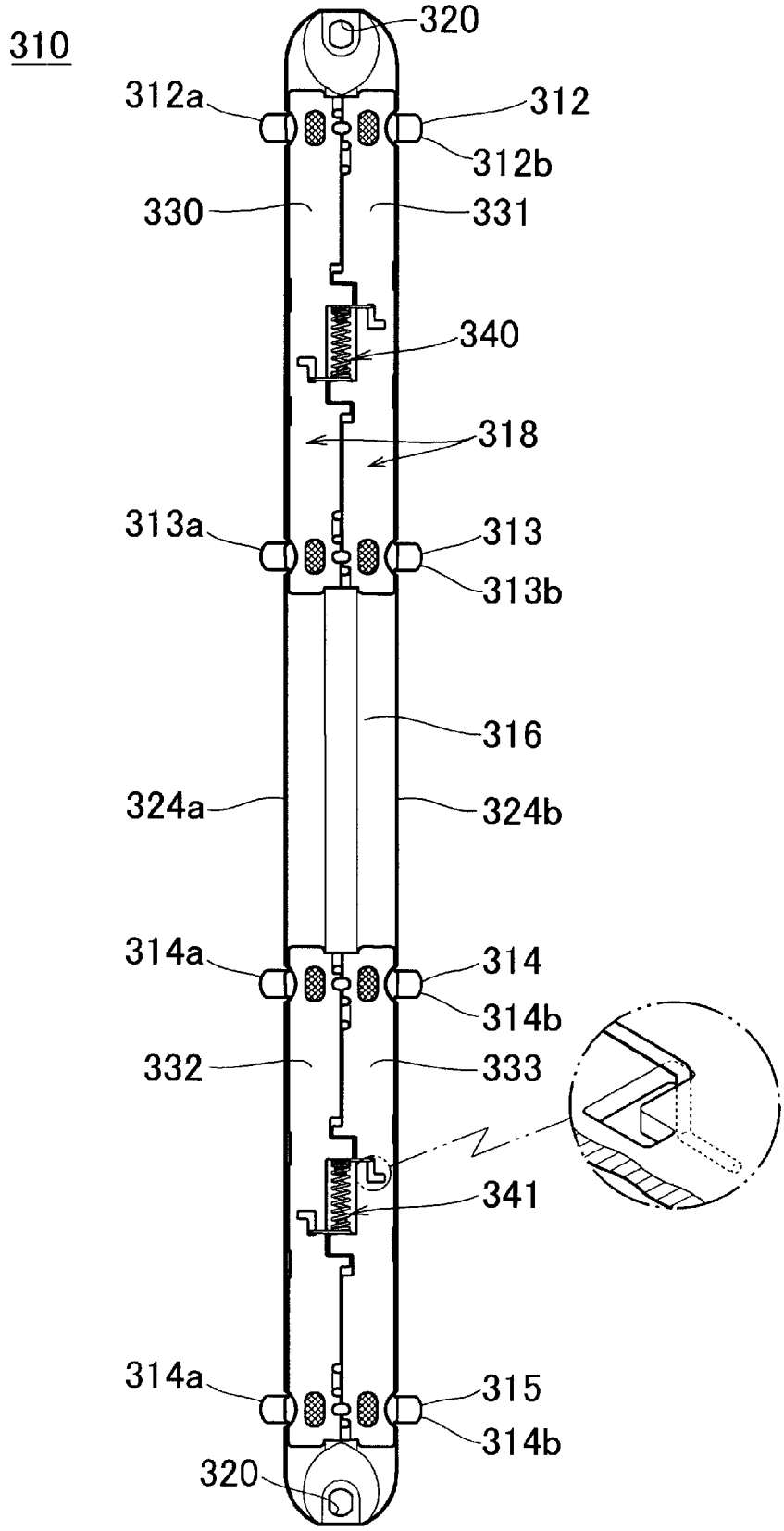
FIG. 63 is a bottom view illustrating the example of the binding device of the another preferred embodiment of the present invention.
Figure 64:
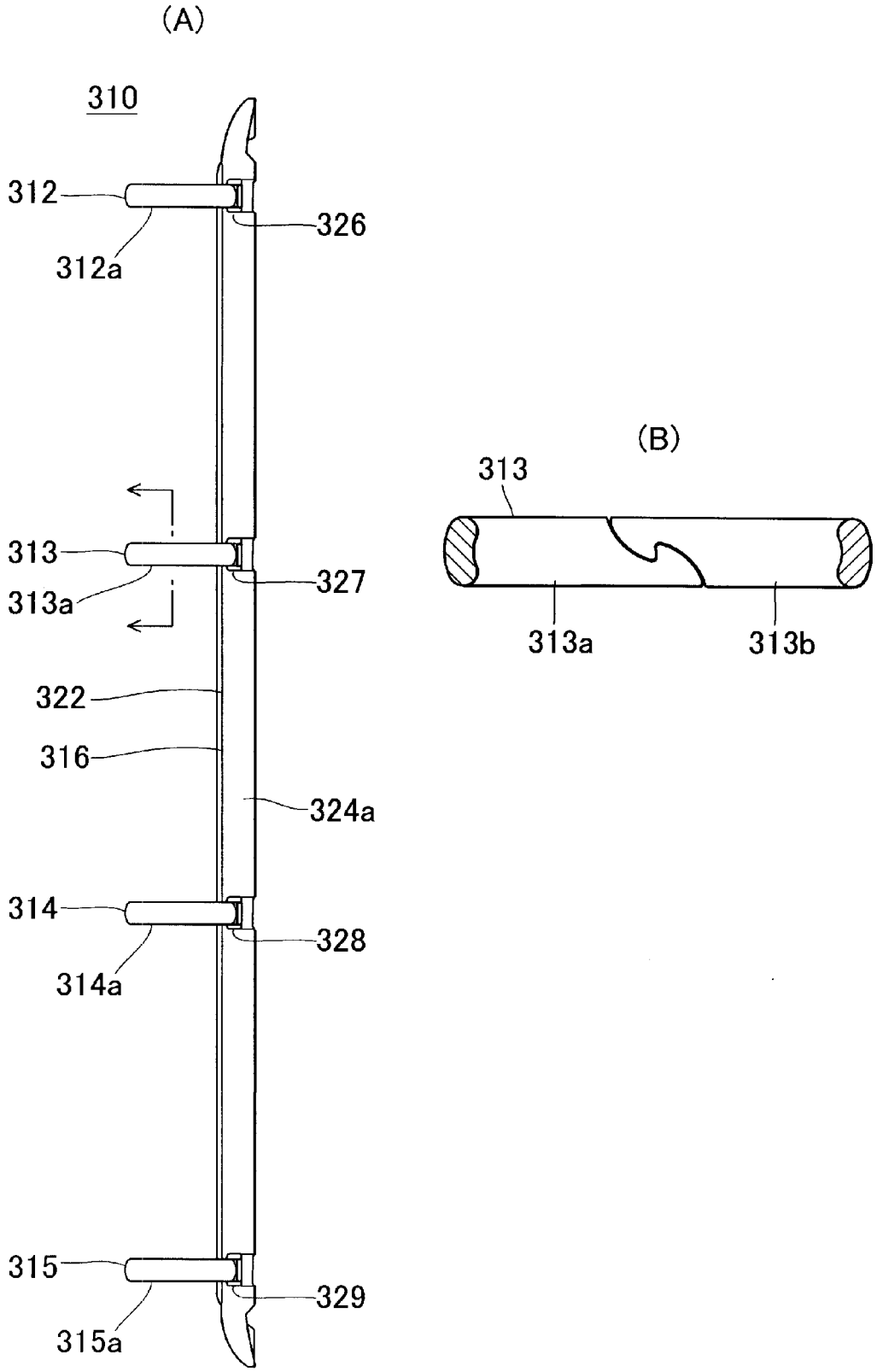
FIGS. 64(A) and 64(B) are views illustrating the example of the binding device of the another preferred embodiment of the present invention, FIG. 64(A) being a side view, and FIG. 64(B) being a cross-sectional view of a binding ring.
Figure 65:
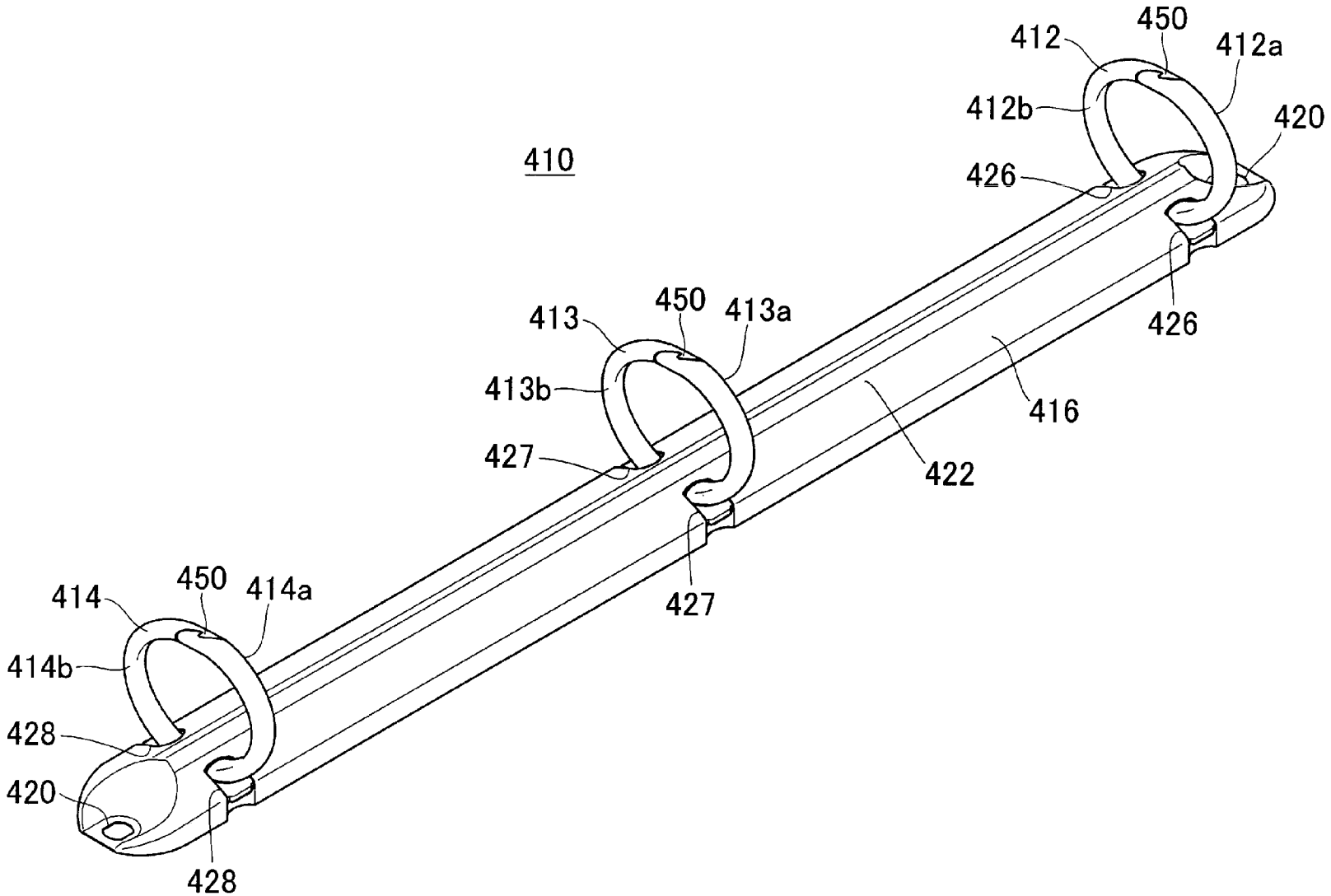
FIG. 65 is a perspective view illustrating an example of a binding device of another preferred embodiment of the present invention.
Figure 66:
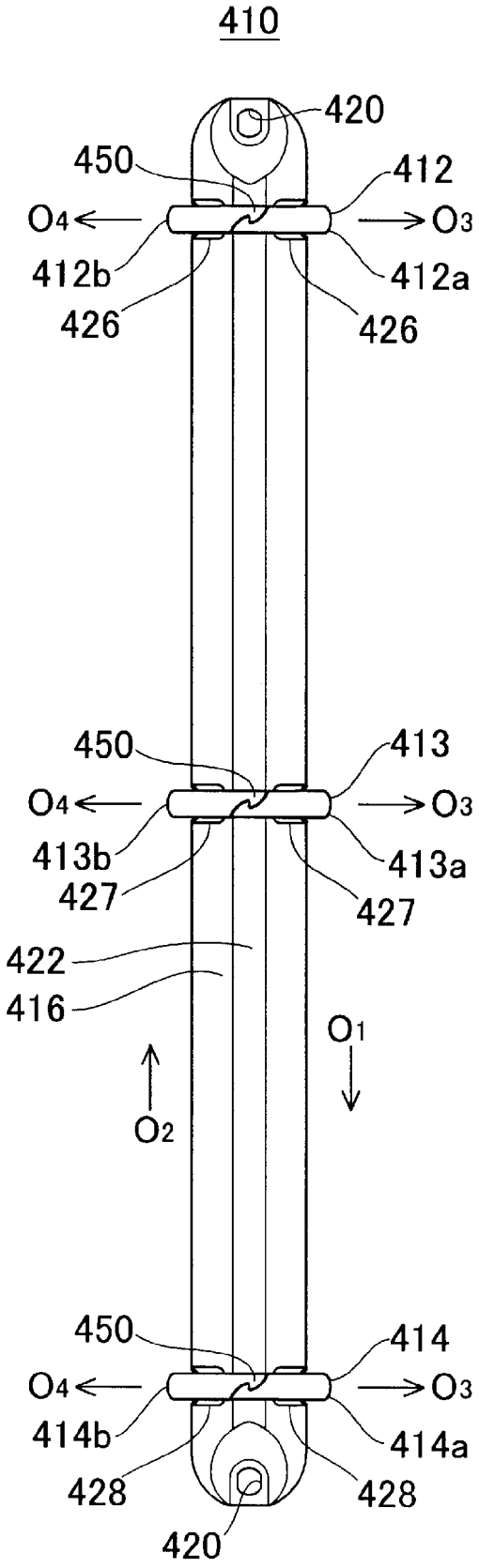
FIG. 66 is a plan view illustrating the example of the binding device of the another preferred embodiment of the present invention.
Figure 67:
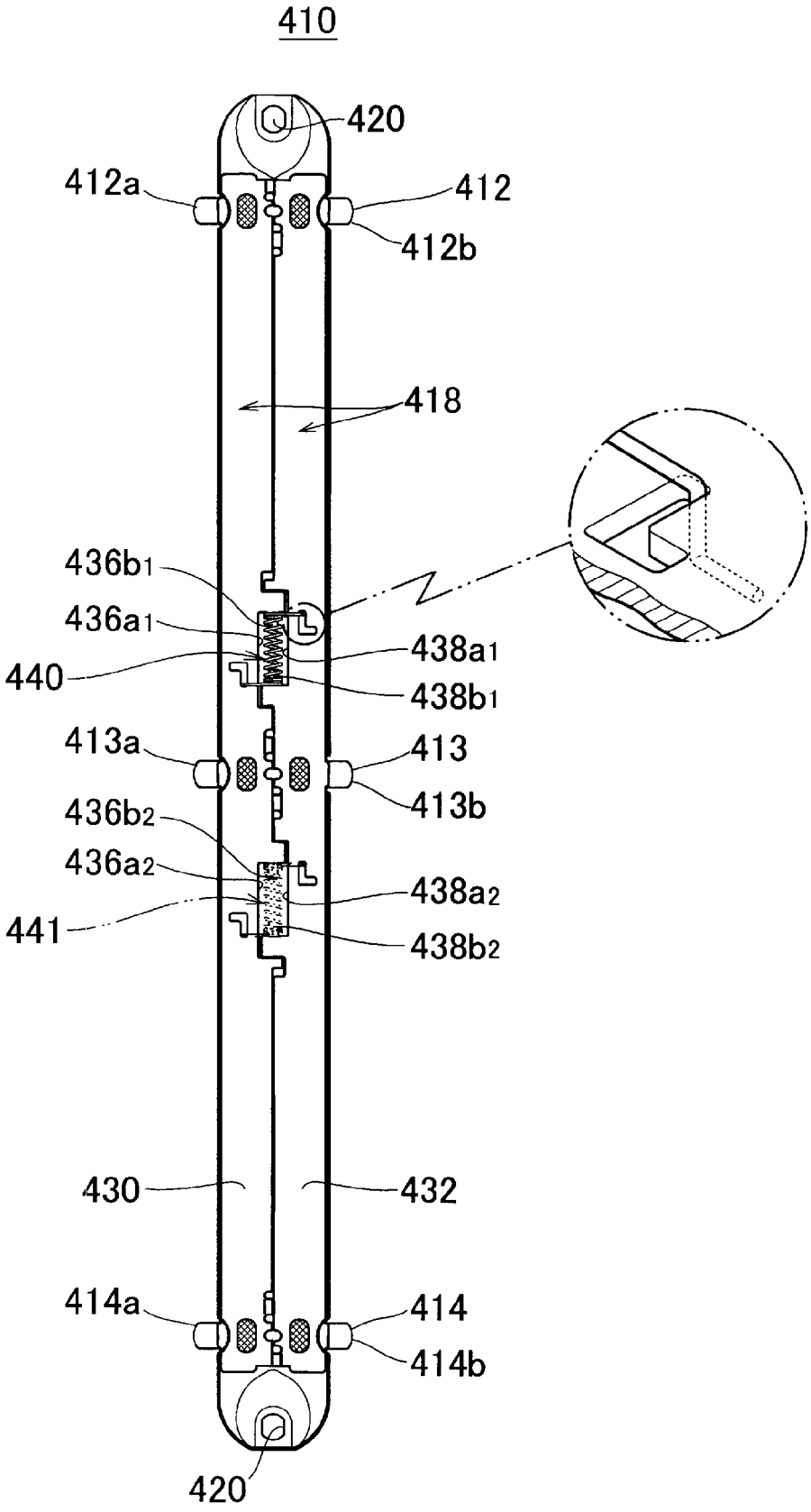
FIG. 67 is a bottom view illustrating the example of the binding device of the another preferred embodiment of the present invention.
Figure 68:
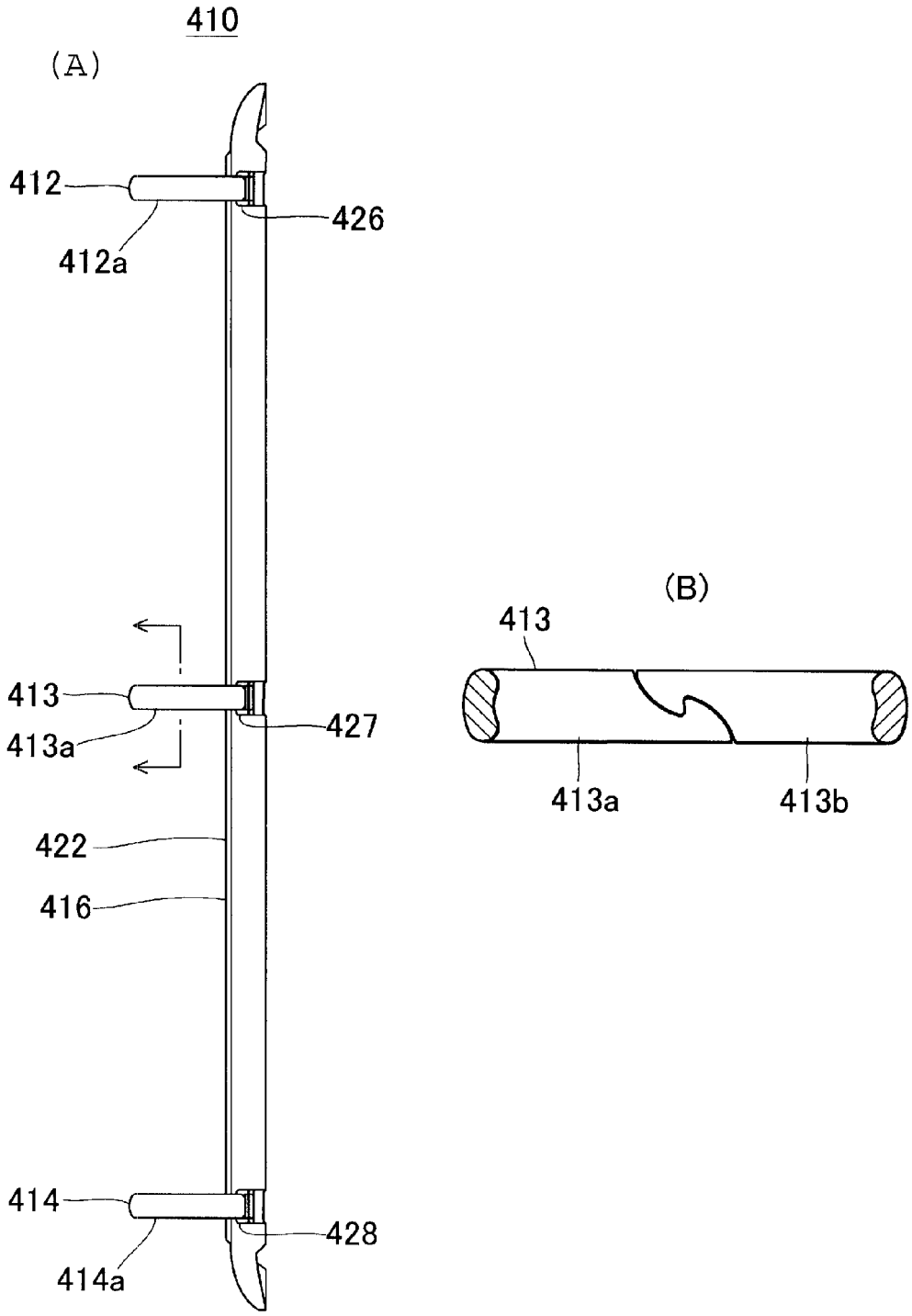
FIGS. 68(A) and 68(B) are views illustrating the example of the binding device of the another preferred embodiment of the present invention, FIG. 68(A) being a side view, and FIG. 68(B) being a cross-sectional view of a binding ring.

Next, a method for mounting the opening-closing member 240 to the operating member 218 is described with reference to FIGS. 58 to 60.

The side from which the securing end portions 242*a* and 242*b* extend is directed to the lower side, i.e., the side opposite to the bound object-mounting portion 222 of the holding member 216. The opening-closing member-securing portions 236*b* and 238*b* are inserted into the through hole of the coil portion 244, and the opening-closing member 240 is mounted between the gap portions 236*a* and 238*a*.

L-shaped supporting portions (the intermediate portion 247*a* and the engaging end 248*a*) of the securing end portion 242*a*, which are brought on the first operating piece 230 side, are inserted into the insertion hole 236*d* of the first operating piece 230, and are displaced slightly to engage with the supporting portion 236*c*.

Furthermore, L-shaped supporting portions (the intermediate portion 247*b* and the engaging end 248*b*) of the securing end portion 242*b* are brought on the second operating piece 232 side, are inserted into the insertion hole 238*d* of the second operating piece 232, and are displaced slightly to engage with the supporting portion 238*c*.

The binding device 210 may be attached to the cover A using bolts with nuts through the attaching holes 220 with the lower edges of the holding walls 224*a* and 224*b* joined to the cover A.

Furthermore, in the above preferred embodiment, a description has been given of a two-hole type binding devise having two holes such as the first and second binding rings 212 and 214. However, a binding device may be any multi-hole type binding device having more binding rings, such as 3-, 4-, 20-, 26-, or 30-hole type binding device.

Next, a description is given of another preferred embodiment of the present invention with reference to FIGS. 61 to 64.

A binding device 310 of this preferred embodiment has a configuration substantially the same as the configuration of the binding device 210 of the preferred embodiment described above. However, the configuration of the holding member, the configuration of the operating member, and the configuration of the opening-closing member are different since the number of binding rings is increased. Therefore, a description is primarily provided of these differences.

The binding device 310 includes a pair of substantially annular first and second binding rings 312 and 313 and a pair of substantially annular third and fourth binding rings 314 and 315, each of which is made of metal, a holding member 316 having a length which allows the first to fourth binding rings 312 to 315 to be disposed with a spacing therebetween, and an operating member 318 having a surface to which the base portions of each of the first to fourth binding rings 312 to 315 are secured with a spacing therebetween, the operating member 318 being movably secured inside the holding member 316 such that the first to fourth binding rings 312 to 315 are secured to the holding member 316.

The binding rings are a four-hole type and include four binding rings, i.e., the first to fourth binding rings 312 to 315. The first binding ring 312 is provided with first and second ring halves 312*a* and 312*b*, and the second binding ring 313 is provided with third and fourth ring halves 313*a* and 313*b*. The third binding ring 314 is provided with fifth and sixth ring halves 314*a* and 314*b*, and the fourth binding ring 115 is provided with seventh and eighth ring halves 315*a* and 315*b*.

A binding ring-engaging portion 350 is provided at the end of the first and second ring halves 312*a* and 312*b*, at the end of the third and fourth ring halves 313*a* and 313*b*, at the end of the fifth and sixth ring halves 314*a* and 314*b*, and at the seventh and eighth ring halves 315*a* and 315*b*, i.e., at the top portion of each of the first to fourth binding rings 312 to 315, in order to allow sheets S to be bound by inserting the ring halves into binding holes provided in the sheets S in advance. These ring halves are annularly engaged with each other by engaging the respective binding ring-engaging portions 350.

The first to fourth binding rings 312 to 315 defining the binding rings are formed by widening a metal-made wire rod having a circular cross-section in a direction for disengaging the binding ring-engaging portions 350 ($O_1$ and $O_2$ directions of FIG. 62) and pressing the central portion of the wire rod to bend in a direction for closing the binding rings. The first to fourth binding rings 312 to 315 are formed into a shape having a substantially bean-shaped cross-section. In the substantially bean-shaped cross-section, the central portion thereof protrudes in a direction for opening the binding ring (the $O_3$ direction in FIG. 62 for the first, third, fifth, and seventh ring halves 312*a*, 313*a*, 314*a*, and 315*a* and the $O_4$ direction in FIG. 62 for the second, fourth, sixth, and eighth ring halves 312*b*, 313*b*, 314*b*, and 315*b*), and the both edges thereof are bent in a direction for closing the binding ring.

Specifically, when the annular first to fourth binding rings 312 to 315 are viewed from the opening-closing direction, a wavy surface is provided on the inner side of the first to fourth binding rings 312 to 315, and the outer side of the first to fourth binding rings 312 to 315 has a semicircular arc shape. Furthermore, as viewed from a direction for disengaging the binding rings, each of the first to fourth binding rings 312 to 315 has opposite outside edges having a semicircular arc shape.

Conventional binding rings having a circular cross-section do not resist deformation when the diameter is small. When the diameter is increased, the cross-sectional area increases which increases the cost for the material therefor. Since binding holes formed in sheets are usually circular holes, conventional binding rings having a substantially rectangular cross-section are not well suited for the binding holes of sheets and are likely to damage the binding holes of the sheets.

Meanwhile, when the first to fourth binding rings 312 to 315 defining the binding rings are thin, the binding ring-engaging portions 350 may not be securely fitted with each other.

Thus, it is desirable to increase the width of the first to fourth binding rings 312 to 315. However, even when a wire rod having a small cross-sectional area is used as a raw wire rod, it is desirable to ensure a required width for a binding ring by machining the raw metal-made wire rod.

Therefore, in the binding rings according to the present invention, the central portion of a wire rod for forming the binding rings is pressed to deform the wire rod into a bean-like shape, whereby the width as a whole is increased. That is, the binding rings are formed such that the entire width of the binding rings is increased in a direction for disengaging the binding ring-engaging portion 350, whereby the binding ring-engaging portions 350 can be completely engaged with each other.

The holding member 316 has a substantially rectangular shape in plan view having a length which allows the first to fourth binding rings 312 to 315 to be disposed with a predetermined spacing therebetween. Furthermore, both of the end portions of the holding member 316, or portions in the vicinity of an attaching hole 320 for attaching the holding member 316 to a cover A, have a substantially semicircular arc shape in plan view.

The holding member 316 is configured to have a holding space inside a bound object-mounting portion 322, and the operating member 318 and other elements are contained in the holding space.

Along both edges of the bound object-mounting portion 322 of the holding member 316, holding walls are provided each of which extends in the longitudinal direction of the bound object-mounting portion 322 substantially from one end of the bound object-mounting portion 322 to the other end and slidably holds the operating member 318. In this preferred embodiment, holding walls 324*a* and 324*b* are provided consecutively so as to hang down from substantially entire portions extending, in the longitudinal direction of the holding member 316, inwardly between the vicinities outside the first to fourth binding rings 312 to 315. Furthermore, the holding walls 324*a* and 324*b* are substantially in parallel with each other and have substantially the same plate-like shape. The operating member 318 to be described in detail later is contained in the holding space surrounded by the holding walls 324*a* and 324*b* and the bound object-mounting portion 322.

The bound object-mounting portion 322 of the holding member 316 is provided with first and second through holes 326 and 327 which allow the first and second binding rings 312 and 313, respectively, to loosely pass therethrough with a predetermined distance (a predetermined length defined by Japanese Industrial Standards or the like) between the first and second binding rings 312 and 313. In addition, the bound object-mounting portion 322 of the holding member 316 is also provided with third and fourth through holes 328 and 329 which allow the third and fourth binding rings 314 and 315, respectively, to loosely pass therethrough with a predetermined distance (a predetermined length defined by Japanese Industrial Standards or the like) between the third and fourth binding rings 314 and 315.

Each of the first to fourth through holes 326 to 329 is provided in two portions, i.e., left and right portions which are separated by a predetermined distance in the width direction of the holding member 316 so as to conform to the ring halves constituting the respective binding rings.

In contrast to the operating pieces of the binding device of the above preferred embodiments, the operating pieces defining the operating member 318 have two pairs of operating pieces.

A first operating piece 330 and a second operating piece 331 are configured similarly to the first and second operating pieces 230 and 232, respectively, of the preferred embodiment described above, the base portion of the first and third ring halves 312*a* and 313*a* being secured to the first operating piece 330, the base portion of the second and fourth ring halves 312*b* and 313*b* being secured to the second operating piece 331. Furthermore, a third operating piece 332 and a fourth operating piece 333 are configured similarly to the first and second operating pieces 230 and 232, respectively, of the preferred embodiment described above, the base portion of the fifth and seventh ring halves 314*a* and 315*a* being secured to the third operating piece 332, the base portion of the sixth and eighth ring halves 314*b* and 315*b* being secured to the fourth operating piece 333.

In the binding devices of the preferred embodiments described above, one opening-closing member is mounted on one pair of the operating pieces. However, in the binding device of this preferred embodiment, one opening-closing member is mounted on each of the two pairs of operating pieces, and thus two opening-closing members, i.e., opening-closing members 340 and 341, are provided.

Next, a description is given of another preferred embodiment of the present invention with reference to FIGS. 65 to 68.

A binding device 410 of this preferred embodiment has a configuration substantially the same as the configuration of the binding device 210 of the preferred embodiment described above. However, the configuration of the holding member, the configuration of the operating member, and the configuration of the opening-closing member are different since the number of binding rings is increased. Therefore, a description is primarily provided of these differences.

The binding device 410 is provided with a set of substantially annular first, second, and third binding rings 412, 413, and 414, each of which is made of metal, a holding member 416 having a length which allows the first to third binding rings 412 to 414 to be disposed with a spacing therebetween, and an operating member 418 having a surface to which the base portions of the first to third binding rings 412 to 414 are secured with a spacing therebetween, the operating member 418 being movably secured inside the holding member 416 such that the first to third binding rings 412 to 414 are secured to the holding member 416.

The binding rings are a three-hole type and include three binding rings, i.e., the first to third binding rings 412 to 414. The first binding ring 412 is provided with first and second ring halves 412*a* and 412*b*, and the second binding ring 413 is provided with third and fourth ring halves 413*a* and 413*b*. The third binding ring 414 is provided with fifth and sixth ring halves 414*a* and 414*b*.

A binding ring-engaging portion 450 is provided at the end of the first and second ring halves 412*a* and 412*b*, at the end of the third and fourth ring halves 413*a* and 413*b*, and at the end of the fifth and sixth ring halves 414*a* and 414*b*, i.e., at the top portion of each of the first to third binding rings 412 to 414, in order to allow sheets S to be bound by inserting the ring halves into binding holes provided in the sheets S in advance.

The first to third binding rings 412 to 414 defining the binding rings are formed by widening a metal-made wire rod having a circular cross-section in a direction for disengaging the binding ring-engaging portions 450 ($O_1$ and $O_2$ directions of FIG. 66) and pressing the central portion of the wire rod to bend in a direction for closing the binding rings. The first to third binding rings 412 to 414 are formed into a shape having a substantially bean-shaped cross-section. In the substantially bean-shaped cross-section, the central portion thereof protrudes in a direction for opening the binding ring (the $O_3$ direction in FIG. 66 for the first, third, and fifth ring halves 412*a*, 413*a*, and 414*a* and the $O_4$ direction in FIG. 66 for the second, fourth, and sixth ring halves 412*b*, 413*b*, and 414*b*), and the opposite edges thereof are bent in a direction for closing the binding ring.

Specifically, when the annular first to third binding rings 412 to 414 are viewed from the opening-closing direction, a wavy surface is provided on the inner side of the first to third binding rings 412 to 414, and the outer side of the first to third binding rings 412 to 414 has a semicircular arc shape. Furthermore, as viewed from a direction for disengaging the binding rings, each of the first to third binding rings 412 to 414 has opposite outside edges formed into a semicircular arc shape.

Conventional binding rings having a circular cross-section do not resist deformation when the diameter is small. When the diameter is increased, the cross-sectional area increases which increases the cost for the material therefor. Since binding holes formed in sheets are usually circular holes, conventional binding rings having a substantially rectangular cross-section are not well suited for the binding holes of sheets and are likely to damage the binding holes of the sheets.

Meanwhile, when the first to third binding rings 412 to 414 defining the binding rings are thin, the binding ring-engaging portions 450 may not be securely fitted with each other.

Thus, it is desirable to increase the width of the first to third binding rings 412 to 414. However, even when a wire rod having a small cross-sectional area is used as a raw wire rod, it is desirable to ensure a required width for a binding ring by machining the raw metal-made wire rod.

Therefore, in the binding rings according to the present invention, the central portion of a wire rod for forming the binding rings is pressed to deform the wire rod into a bean-like shape, whereby the width as a whole is increased. That is, the binding rings are formed such that the entire width of the binding rings is increased in a direction for disengaging the binding ring-engaging portions 450, whereby the binding ring-engaging portions 450 can be completely engaged with each other.

The holding member 416 has a substantially rectangular shape in plan view having a length which allows the first to third binding rings 412 to 414 to be disposed with a predetermined spacing therebetween. Furthermore, both of the end portions of the holding member 416, or portions in the vicinity of an attaching hole 420 for attaching the holding member 416 to a cover A, are formed a substantially semicircular arc shape in plan view.

The holding member 416 is configured to have a holding space inside a bound object-mounting portion 422, and the operating member 418 and other elements are contained in the holding space.

Along both edges of the bound object-mounting portion 422 of the holding member 416, holding walls are provided each of which extends in the longitudinal direction of the bound object-mounting portion 422 substantially from one end of the bound object-mounting portion 422 to the other end and slidably holds the operating member 418. In this preferred embodiment, holding walls 424*a* and 424*b* are provided consecutively so as to hang down from substantially entire portions extending, in the longitudinal direction of the holding member 416, inwardly between the vicinities outside the first to third binding rings 412 to 414. Furthermore, the holding walls 424*a* and 424*b* are substantially in parallel with each other and have substantially the same plate-like shape. The operating member 418 to be described in detail later are contained in the holding space surrounded by the holding walls 424*a* and 424*b* and the bound object-mounting portion 422.

The bound object-mounting portion 422 of the holding member 416 is provided with first to third through holes 426 to 428 which allow the first to third binding rings 412 to 414, respectively, to loosely pass therethrough with a predetermined distance (a predetermined length defined by Japanese Industrial Standards or the like) between the first to third binding rings 412 to 414.

Each of the first to third through holes 426 to 428 is provided in two portions, i.e., left and right portions which are separated by a predetermined distance in the width direction of the holding member 416 so as to conform to the ring halves defining the respective binding rings.

As in the operating pieces of the binding device 210 of the above preferred embodiment, the operating pieces defining the operating member 418 have a left-right pair of operating pieces.

A first operating piece 430 and a second operating piece 432 are provided similarly to the first and second operating pieces 230 and 232, respectively, of the preferred embodiment described above, the base portion of the first, third, and fifth ring halves 412*a*, 413*a*, and 414*a* being secured to the first operating piece 430, the base portion of the second, fourth, and sixth ring halves 412*b*, 413*b*, and 414*b* being secured to the second operating piece 432.

The first and second operating pieces 430 and 432 include two pairs of gap portions, respectively, i.e., a pair of gap portions $436a_1$ and $436a_2$ and a pair of gap portions $438a_1$ and $438a_2$, respectively. A movement restricting portion for restricting the movement of the first and second operating pieces 430 and 432 in the longitudinal direction is provided in two positions, i.e., the vicinity outside a pair of opening-closing member-securing portions $436b_1$ and $436b_2$ and the vicinity outside a pair of opening-closing member-securing portions $438b_1$ and $438b_2$.

In the binding device of the above preferred embodiments, one opening-closing member is mounted on one pair of the operating pieces. However, in the binding device of this preferred embodiment, one opening-closing member 440 may be mounted on a pair of operating pieces, or two opening-closing members 440 and 441 may be mounted on a pair of operating pieces.

In the preferred embodiments described above, each operating piece includes a protruding portion to be inserted into a through hole in a holding member. Therefore, even when the base portions of binding rings are secured to the operating piece by, for example, swaging, the area can be increased in order to reduce stress applied to the operating piece. Therefore, the strength of the operating piece as a whole is increased.

In addition, a common through hole can be used as a through hole for inserting the protruding portion of the operating piece and a through hole for inserting the binding rings. Therefore, the structure of the holding member can be simplified, thereby achieving cost reduction.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A binding device comprising:

a plurality of annular binding rings each including two ring halves each including a binding ring-engaging portion at a free end thereof, the binding ring-engaging portions being engaged with each other to define the plurality of annular binding rings;

a holding member having a length which enables the binding rings to be arranged with a space therebetween;

an operating member including a surface to which base portions of the respective binding rings are secured, such that the binding rings are arranged with the space therebetween, the operating member including a pair of a first operating piece and a second operating piece disposed inside the holding member, the first and second operating pieces being movable within the holding member in a longitudinal direction of the holding member along substantially an entire longitudinal length of the first and second operating pieces and also being movable in a direction parallel to a line connecting respective binding rings such that the binding rings are secured to the holding member with the space therebetween; and an opening-closing member which, when the binding rings are opened, moves the first and second operating pieces disposed in the holding member in the longitudinal direction of the holding member and causes the binding rings to be moved in an opening direction such that abutting edges of the first and second operating pieces are displaced in a direction approaching an inner surface of the holding member; wherein each of the first and second operating pieces includes a gap portion arranged to accommodate the opening-closing member therein, an opening-closing member-securing portion arranged to secure the opening-closing member in the gap portions of the first and second operating pieces, and a movement restricting portion arranged outside of the gap portion and the opening-closing member-securing portion to restrict movement of the first and second operating pieces in opposite directions to one another along longitudinal directions of the first and second operating pieces;

the opening-closing member includes a coil element and first and second securing end portions extending from first and second ends of the coil element, respectively;

the first and second operating pieces of the operating member include supporting portions arranged to support the first and second securing end portions extending from the first and second ends of the coil element of the opening-closing member, the supporting portions are defined by holes extending in longitudinal directions of the first and second operating pieces, and the holes are arranged so as to be continuous with insertion holes in the first and second operating pieces into which the first and second securing end portions of the opening-closing member are inserted from one principal surface of the first and second operating pieces toward another principal surface of the first and second operating pieces;

the coil element of the opening-closing member is an elastic member, the elastic member being stored in the gap portion of the operating member, and both ends of the coil element are engaged with opening-closing securing portions;

the opening-closing member is provided as an operating unit such that a distance between the first and second operating pieces in an opening-closing direction of the binding rings is maintained at a distance that enables the first and second operating pieces to be moved to approach the inner surface of the holding portion and being arranged so as to move the first and second operating pieces of the operating member relative to each other in opposite directions to one another and the longitudinal direction of the holding member so as to elastically bias the first and second operating pieces in a direction to enable the binding rings to be maintained in an opened state;

one of the first and second securing end portions is secured to the supporting portion of the second operating piece opposed to the first operating piece by inserting the one of the first and second securing end portions from one principal surface of the second operating piece toward another principal surface of the second operating piece and the other one of the first and second securing end portions is secured to the supporting portion of the first operating piece by inserting the other one of the first and second securing end portion from one principal surface of the first operating piece toward another principal surface of the first operating piece;

the first operating piece, with the elastic member, moves in the longitudinal directions of the first and second operating pieces which is a direction to disengage the binding ring-engaging portions and the second operating piece with, the elastic member, moves to a direction to disengage the binding ring-engaging portions, and a V-shaped state of the first and second operating pieces, with the elastic member, is changed to an inverted V-shaped in the direction approaching the inner surface of the holding member;

the operating member is arranged to restrict movement of the first and second operating pieces in directions opposite to one another through movement restricting portions; and each of the movement restricting portions includes a restricting recess and a restricting projection provided in abutting edges of the first and second operating pieces at which the first and second operating pieces abut against each other, the restricting projection fits loosely in the restricting recess such that the restricting projection moves in the longitudinal directions of the first and second operating pieces inside the restricting recess, and the restricting recess and the restricting projection are arranged so as to restrict movement of the first and second operating pieces such that the restricting projection of one of the first and second operating pieces abuts on an edge of the restricting recess of the other one of the first and second operating pieces, the edge being disposed on a side opposite to a direction to disengage the binding ring-engaging portions when the pair of the operating pieces are moved in the longitudinal direction of the holding member and the direction parallel to the line connecting respective binding rings secured to the holding member with the space therebetween while the binding ring-engaging portions of the binding rings are disengaged.

2. A binding device comprising:

a plurality of annular binding rings each including two ring halves each including a binding ring-engaging portion at a free end thereof, the binding ring-engaging portions being engaged with each other to define the plurality of annular binding rings;

a holding member having a length which enables the binding rings to be arranged with a space therebetween;

an operating member including a surface to which base portions of the respective binding rings are secured, such that the binding rings are arranged with the space therebetween, the operating member including a pair of a first operating piece and a second operating piece disposed inside the holding member, the first and second operating pieces being movable within the holding member in a longitudinal direction of the holding member along substantially an entire longitudinal length of the first and second operating pieces and also being movable in a direction parallel to a line connecting respective binding rings such that the binding rings are secured to the holding member with the space therebetween; and an opening-closing member which, when the binding rings are opened, moves the first and second operating pieces disposed in the holding member in the longitudinal direction of the holding member and causes the binding rings to be moved in an opening direction such that abutting edges of the first and second operating pieces are displaced in a direction approaching an inner surface of the holding member; wherein each of the first and second operating pieces includes a gap portion arranged to accommodate the opening-closing member therein, a first opening-closing member-securing portion of the first operating piece and a second opening-closing member-securing portion of the second operating piece arranged to secure the opening-closing member in the gap portions of the first and second operating pieces, and a movement restricting portion arranged outside of the gap portion and the first and second opening-closing member-securing portions to restrict movement of the first and second operating pieces in opposite directions to one another along longitudinal directions of the first and second operating pieces;

the opening-closing member includes a coil element and first and second securing end portions extending from first and second ends of the coil element, respectively;

the first and second the operating pieces of the operating member include supporting portions arranged to support the first and second securing end portions extending from the first and second ends of the coil element of the opening-closing member, the supporting portions are defined by holes arranged to be continuous with insertion holes in the first and second operating pieces into which the first and second securing end portions of the opening-closing member are inserted from one principal surface of the first and second operating pieces toward another principal surface of the first and second operating pieces;

the coil element of the opening-closing member is an elastic member, the elastic member being stored in the gap portion of the operating member, and both ends of the coil element are engaged with opening-closing securing portions;

one of the first and second securing end portions of the opening-closing member is intersected from a side of the gap portion of the second operating piece through the opening-closing securing portion, while the one of the first and second securing end portions of the opening-closing member is intersected from a lower side of the gap portion of the first operating piece to an upper side of the holding member of the first operating member;

another one of the first and second securing end portions of the opening-closing member is intersected from a side of the gap portion of the first operating piece through the opening-closing securing portion, while the another one of the first and second securing end portions is intersected from a lower side of the second operating piece to an upper side of the holding member of the second operating member;

the one of the first and second securing end portions and the another one of the first and second securing end portions of the opening-closing member obliquely intersect in the longitudinal direction of the first and second operating pieces, and the first and second operating pieces of the opening-closing member are defined as an operating unit so as to elastically bias the first and second operating pieces in a direction to enable the binding rings to be maintained in an opened state approaching the inner surface of the holding member; and the first operating piece, with the elastic member, moves in the longitudinal directions of the first and second operating pieces which is a direction to disengage the binding ring-engaging portions and the second operating piece with, the elastic member, moves to a direction to disengage the binding ring-engaging portions, and a V-shaped state of the first and second operating pieces, with the elastic member, is changed to an inverted V-shaped in the direction approaching the inner surface of the holding member;

the operating member is arranged to restrict movement of the first and second operating pieces in directions opposite to one another through movement restricting portions; and each of the movement restricting portions includes a restricting recess and a restricting projection provided in abutting edges of the first and second operating pieces at which the first and second operating pieces abut against each other, the restricting projection fits loosely in the restricting recess such that the restricting projection moves in the longitudinal directions of the first and second operating pieces inside the restricting recess, and the restricting recess and the restricting projection are arranged so as to restrict movement of the first and second operating pieces in the longitudinal direction of the holding member such that the restricting projection of one of the first and second operating pieces abuts on an edge of the restricting recess of the other one of the first and second operating pieces, the edge being disposed on a side opposite to a direction to disengage the binding ring-engaging portions when the pair of the operating pieces are moved in the longitudinal direction of the holding member and the direction parallel to the line connecting respective binding rings secured to the holding member with the space therebetween while the binding ring-engaging portions of the binding rings are disengaged.

3. A binding device comprising:

a plurality of annular binding rings each including two ring halves each including a binding ring-engaging portion at a free end thereof, the binding ring-engaging portions being engaged with each other to define the plurality of annular binding rings;

a holding member having a length which enables the binding rings to be arranged with a space therebetween;

an operating member including a surface to which base portions of the respective binding rings are secured, such that the binding rings are arranged with the space therebetween, the operating member including a pair of a first operating piece and a second operating piece disposed inside the holding member, the first and second operating pieces being movable within the holding member in a longitudinal direction of the holding member such that the binding rings are secured to the holding member; and an opening-closing member which, when the binding rings are opened, moves the first and second operating pieces disposed in the holding member in the longitudinal direction of the holding member and causes the binding rings to be moved in an opening direction such that the first and second operating pieces are displaced in a direction approaching an inner surface of the holding member; wherein the opening-closing member includes a coil element and first and second securing end portions extending from first and second ends of the coil element, respectively;

the first and second the operating pieces of the operating member include supporting portions arranged to support the first and second securing end portions extending from the first and second ends of the coil element of the opening-closing member, the supporting portions are defined by holes extending in longitudinal directions of the first and second operating pieces;

the coil element of the opening-closing member is an elastic member, the elastic member being provided in the operating member such that a distance between the first and second operating pieces in an opening-closing direction of the binding rings is maintained at a distance that enables the first and second operating pieces to be moved and being arranged so as to move the first and second operating pieces of the operating member relative to each other in opposite directions to one another and so as to elastically bias the first and second operating pieces in a direction to enable the binding rings to be maintained in an opened state;

each of the first and second securing end portions of the coil element includes a securing portion extending from the coil element and an intermediate portion extending from the securing portion; and the securing portions of the first and second securing end portions have substantially the same length, and the intermediate portion of the first securing end portion of the coil element and the intermediate portion of the second securing end portion of the coil element are engaged with the supporting portions of the first and second operating pieces of the operating member, and the first securing end portion and the second end portion of the coil element are arranged to maintain a constant distance between the first and second operating pieces such that the first and second operating pieces abut against each other along abutting edges of the first and second operating pieces, and the first and second securing end portions are arranged to hold the first and second operating pieces close to each other so as to maintain the positional relationship between the first and second operating pieces.

4. A binding device according to claim 1, wherein each of the first and second securing end portions of the coil element includes a securing portion extending from the coil element and an intermediate portion extending from the securing portion;

the securing portions of the first and second securing end portions have substantially the same length, and the intermediate portion of the first securing end portion of the coil element and the intermediate portion of the second securing end portion of the coil element are engaged with the supporting portions of the first and second operating pieces of the operating member, and the first securing end portion and the second end portion of the coil element are arranged to maintain a constant distance between the first and second operating pieces such that the first and second operating pieces abut against each other along abutting edges of the first and second operating pieces, and the first and second securing end portions are arranged to hold the first and second operating pieces close to each other so as to maintain the positional relationship between the first and second operating pieces.

* * * * *